US011672388B2

(12) United States Patent
Tonderys et al.

(10) Patent No.: US 11,672,388 B2
(45) Date of Patent: Jun. 13, 2023

(54) HAND-HELD SURFACE CLEANING DEVICE

(71) Applicant: SharkNinja Operating, LLC, Needham, MA (US)

(72) Inventors: Daniel Tonderys, Needham, MA (US); Andre D. Brown, Natick, MA (US); Daniel Innes, West Roxbury, MA (US); Bastin Antonisami, Needham, MA (US); Jason B. Thorne, Dover, MA (US); Kai Xu, Suzhou (CN); Heliang Chen, Suzhou (CN); Adam Udy, Sutton (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 16/649,469

(22) PCT Filed: Sep. 20, 2018

(86) PCT No.: PCT/US2018/051978
§ 371 (c)(1),
(2) Date: Mar. 20, 2020

(87) PCT Pub. No.: WO2019/060564
PCT Pub. Date: Mar. 28, 2019

(65) Prior Publication Data

US 2020/0297172 A1 Sep. 24, 2020

Related U.S. Application Data

(60) Provisional application No. 62/619,309, filed on Jan. 19, 2018, provisional application No. 62/616,908,
(Continued)

(51) Int. Cl.
*A47L 5/24* (2006.01)
*A47L 9/00* (2006.01)
(Continued)

(52) U.S. Cl.
CPC ..... *A47L 5/24* (2013.01); *A47L 5/225* (2013.01); *A47L 5/26* (2013.01); *A47L 9/009* (2013.01);
(Continued)

(58) Field of Classification Search
CPC ... A47L 5/24; A47L 9/02; A47L 9/102; A47L 9/106; A47L 9/20; A47L 9/2873; A47L 9/322; A47L 5/225
(Continued)

(56) References Cited

U.S. PATENT DOCUMENTS 4,573,234 A 3/1986 Kochte et al.
5,020,187 A 6/1991 Kosten et al.
(Continued)

FOREIGN PATENT DOCUMENTS

CN 201299513 Y 9/2009
CN 202173358 3/2012
(Continued)

OTHER PUBLICATIONS

Australian Examination Report dated May 1, 2020, received in Australian Application No. 2018336913, 8 pgs.
(Continued)

*Primary Examiner* — Katina N. Henson
(74) *Attorney, Agent, or Firm* — Grossman Tucker Perreault & Pfleger, PLLC

(57) ABSTRACT

In general, the present disclosure is directed to a hand-held surface cleaning device that includes a relatively compact form-factor to allow users to store the same in a nearby location (e.g., in a drawer, in an associated charging dock, on a table top) for easy access to perform relatively small cleaning tasks that would otherwise require retrieving a full-size vacuum from storage. A hand-held surface cleaning device consistent with aspects of the present disclosure
(Continued)

includes a body (or body portion) with a motor, power source and dust cup disposed therein. The body portion also functions as a handgrip to allow the hand-held surface cleaning device to be operated by one hand, for example.

28 Claims, 41 Drawing Sheets

Related U.S. Application Data filed on Jan. 12, 2018, provisional application No. 62/585,320, filed on Nov. 13, 2017, provisional application No. 62/561,851, filed on Sep. 22, 2017.

(51) Int. Cl.

| | |
|---|---|
| ***A47L 9/02*** | (2006.01) |
| ***A47L 9/20*** | (2006.01) |
| ***A47L 9/32*** | (2006.01) |
| ***A47L 11/24*** | (2006.01) |
| ***A47L 9/12*** | (2006.01) |
| ***A47L 9/10*** | (2006.01) |
| ***A47L 5/22*** | (2006.01) |
| ***A47L 9/28*** | (2006.01) |
| ***A47L 9/04*** | (2006.01) |
| ***A47L 9/16*** | (2006.01) |
| ***A47L 5/26*** | (2006.01) |

(52) U.S. Cl.

CPC ..... *A47L 9/0018* (2013.01); *A47L 9/02* (2013.01); *A47L 9/0466* (2013.01); *A47L 9/0477* (2013.01); *A47L 9/106* (2013.01); *A47L 9/12* (2013.01); *A47L 9/165* (2013.01); *A47L 9/1691* (2013.01); *A47L 9/20* (2013.01); *A47L 9/2873* (2013.01); *A47L 9/2884* (2013.01); *A47L 9/322* (2013.01); *A47L 9/325* (2013.01); *A47L 11/24* (2013.01); *A47L 9/102* (2013.01); *A47L 9/1683* (2013.01); *A47L 2201/00* (2013.01); *A47L 2201/02* (2013.01); *A47L 2201/022* (2013.01)

(58) Field of Classification Search

USPC ..... 15/323, 350, 344, 415.1, 416, 420, 422, 15/329

See application file for complete search history.

(56) References Cited

U.S. PATENT DOCUMENTS

| | | | | |
|---|---|---|---|---|
| 5,379,483 | A * | 1/1995 | Pino | A47L 5/225 15/323 |
| 5,561,885 | A | 10/1996 | Zahuranec et al. | |
| 6,108,864 | A | 8/2000 | Thomas et al. | |
| 6,459,955 | B1 | 10/2002 | Bartsch et al. | |
| 6,493,903 | B1 | 12/2002 | Super | |
| 7,163,568 | B2 | 1/2007 | Sepke et al. | |
| 7,412,749 | B2 * | 8/2008 | Thomas | A47L 5/225 15/347 |
| 7,422,614 | B2 | 9/2008 | Sepke et al. | |
| 7,507,269 | B2 | 3/2009 | Murphy et al. | |
| 7,628,832 | B2 | 12/2009 | Sepke et al. | |
| 7,882,593 | B2 | 2/2011 | Beskow et al. | |
| 7,958,597 | B2 | 6/2011 | Frantzen et al. | |
| 8,069,529 | B2 | 12/2011 | Groff et al. | |
| 8,156,609 | B2 | 4/2012 | Milne et al. | |
| 8,387,204 | B2 | 3/2013 | Dyson | |
| 8,424,154 | B2 | 4/2013 | Beskow et al. | |
| 8,444,731 | B2 | 5/2013 | Gomiciaga-Pereda et al. | |
| 8,549,704 | B2 | 10/2013 | Milligan et al. | |
| 8,595,894 | B1 | 12/2013 | Kakish | |
| 8,607,406 | B2 | 12/2013 | Miefalk et al. | |
| 8,769,764 | B2 | 7/2014 | Crouch et al. | |
| 8,806,702 | B2 | 8/2014 | Wolfe, Jr. et al. | |
| 9,211,046 | B2 | 12/2015 | Peace | |
| 9,499,134 | B2 | 11/2016 | Camiller | |
| 9,591,952 | B2 | 3/2017 | Conrad | |
| 9,980,620 | B2 | 5/2018 | Sjoberg | |
| 11,013,382 | B2 | 5/2021 | Hwang et al. | |
| 11,213,177 | B2 | 1/2022 | Tonderys et al. | |
| 2004/0216264 | A1 | 11/2004 | Shaver et al. | |
| 2006/0090290 | A1 | 5/2006 | Lau | |
| 2006/0162117 | A1 | 7/2006 | Thomas et al. | |
| 2009/0144931 | A1 * | 6/2009 | Milligan | A47L 9/2857 15/344 |
| 2010/0115726 | A1 | 5/2010 | Groff et al. | |
| 2011/0289720 | A1 | 12/2011 | Han et al. | |
| 2011/0314630 | A1 | 12/2011 | Conrad | |
| 2013/0335900 | A1 | 12/2013 | Jang | |
| 2014/0129170 | A1 | 5/2014 | Ramachandran et al. | |
| 2015/0223651 | A1 * | 8/2015 | Kuhe | A47L 11/4025 15/301 |
| 2016/0106284 | A1 | 4/2016 | Mantyla et al. | |
| 2017/0105591 | A1 | 4/2017 | Bernhard-Tanis | |
| 2017/0188763 | A1 | 7/2017 | Hu | |
| 2018/0177363 | A1 | 6/2018 | Ni | |

FOREIGN PATENT DOCUMENTS

| | | | |
|---|---|---|---|
| CN | 202776167 | | 3/2013 |
| CN | 106923739 | A | 7/2017 |
| CN | 106923745 | | 7/2017 |
| CN | 206295328 | U | 7/2017 |
| CN | 107049138 | | 8/2017 |
| CN | 207152536 | | 3/2018 |
| CN | 107928544 | | 4/2018 |
| CN | 208211971 | | 12/2018 |
| CN | 209826545 | | 12/2019 |
| CN | 210354542 | | 4/2020 |
| CN | 111466820 | | 7/2020 |
| CN | 211324705 | | 8/2020 |
| CN | 211609590 | | 10/2020 |
| CN | 211862669 | | 11/2020 |
| CN | 212015446 | | 11/2020 |
| CN | 212037365 | | 12/2020 |
| CN | 212234298 | | 12/2020 |
| CN | 212661752 | | 3/2021 |
| CN | 212879123 | | 4/2021 |
| CN | 213155648 | | 5/2021 |
| DE | 2401429 | A1 | 7/1974 |
| DE | 102012100050 | | 7/2013 |
| EP | 0008117 | | 2/1980 |
| EP | 0215165 | A1 | 3/1987 |
| EP | 1523916 | A2 | 4/2005 |
| EP | 1969988 | A2 | 9/2008 |
| EP | 1977672 | | 10/2008 |
| EP | 3195778 | A1 | 7/2017 |
| GB | 2155314 | | 9/1985 |
| GB | 2468797 | | 9/2010 |
| JP | 49025163 | | 7/1974 |
| JP | 53145375 | | 11/1978 |
| JP | S5927063 | | 2/1984 |
| JP | 60008814 | | 3/1985 |
| JP | S60188124 | A | 9/1985 |
| JP | S61222431 | | 10/1986 |
| JP | 62010850 | | 1/1987 |
| JP | 62142532 | | 6/1987 |
| JP | S63127734 | A | 5/1988 |
| JP | S63129551 | A | 6/1988 |
| JP | 2006333925 | | 12/2006 |
| JP | 2013202212 | A | 10/2013 |
| JP | 2015202410 | A | 11/2015 |
| JP | 2016131777 | A | 7/2016 |
| JP | S48020449 | U | 7/2016 |
| JP | 006706715 | | 5/2020 |
| JP | 2020534090 | | 11/2020 |
| KR | 19860001634 | | 10/1986 |
| KR | 1019930011949 | | 7/1993 |
| KR | 1020010027468 | | 4/2001 |
| KR | 1020050001766 | | 1/2005 |
| KR | 1020120003054 | | 10/2013 |

(56) References Cited

FOREIGN PATENT DOCUMENTS

| | | | |
|---|---|---|---|
| WO | 2007117196 | | 10/2007 |
| WO | 2013071190 | A1 | 5/2013 |
| WO | 2014113806 | A1 | 7/2014 |
| WO | 2016192260 | | 12/2016 |

OTHER PUBLICATIONS

PCT Search Report and Written Opinion dated Jul. 25, 2019, received in PCT Application No. PCT/US19/29796, 10 pgs.
PCT International Search Report and Written Opinion dated Dec. 7, 2018, received in corresponding PCT Application No. PCT/US18/51978, 10 pgs.
Japanese Office Action with translation, dated Oct. 14, 2020, received in JP Application No. 2020-516621, 6 pgs.
Chinese Office Action dated Jul. 1, 2020, received in Chinese Application No. 201811114067.2, 16 pgs.
Korean Preliminary Rejection dated Aug. 31, 2020, received in Korean Application No. 10-2020-7005226, 15 pgs.
Korean Preliminary Rejection dated Aug. 31, 2020, received in Korean Application No. 10-2020-7014700, 15 pgs.
Chinese Office Action with English translation dated Jan. 8, 2021, received in Chinese Patent Application No. 202020166985.6, 3 pages.
Korean Notice of Final Rejection with English translation dated Feb. 25, 2021, received in Korean Patent Application No. 10-2020-7014700, 7 pages.
Chinese Office Action with translation dated Apr. 22, 2021, received in CN Application No. 202010302794.2, 22 pgs.
Supplemental EP Search Report dated May 7, 2021, received in EP Application No. 18857772.0, 11 pgs.
EP Search Report dated May 7, 2021, received in EP Application No. 20217725.0, 7 pgs.
Chinese Office Action with translation dated May 7, 2021, received in CN Application No. 2021042902881440, 17 pgs.
Korean Office Action with English translation dated Jun. 18, 2021, received in Korean Patent Application No. 10-2020-7005226, 8 pages.
U.K. Examination Report dated Oct. 1, 2021, received in U.K. Patent Application No. GB2109055.0, 5 pages.
U.K. Examination Report dated Oct. 5, 2021, received in U.K. Patent Application No. GB2005612.3, 3 pages.
U.K. Examination Report dated Oct. 1, 2021, received in U.K. Patent Application No. GB2109060.0, 5 pages.
U.S. Office Action dated Jan. 19, 2021, received in U.S. Appl. No. 16/136,934, 5 pages.
U.S. Office Action dated May 7, 2021, received in U.S. Appl. No. 16/136,934, 8 pages.
U.S. Office Action dated Jul. 15, 2021, received in U.S. Appl. No. 16/136,934, 9 pages.
Japanese Submission for Publication submitted Aug. 24, 2021, in Japanese Patent Application No. 2021-000867, with machine translation, 41 pages.
Extended European Search Report dated Aug. 18, 2021 received in European Patent Application No. 18857772.0, 9 pages.
Extended European Search Report dated Oct. 6, 2021 received in European Patent Application No. 21181376.1, 7 pages.
Japanese Submission for Publication submitted Sep. 21, 2021 in Japanese Patent Application No. 2021-000867, with machine translation, 27 pages.
Korean Office Action dated Feb. 24, 2021 received in Korean Patent Application No. 10-2020-7005226, with English translation, 26 pages.
Korean Office Action dated Apr. 15, 2021 received in Korean Patent Application No. 10-2020-7014700, with English translation, 7 pages.
Japanese Office Action with English translation dated Feb. 1, 2022, received in Japanese Patent Application No. 2021-000867, 11 pages.
Chinese Office Action with English translation dated Feb. 22, 2022, received in Chinese Patent Application No. 202110525107.8, 14 pages.
U.K. Patent Application dated Mar. 1, 2022, received in U.K. Patent Application No. GB2005612.3, 1 page.
U.K. Patent Application dated Mar. 1, 2022, received in U.K. Patent Application No. GB2109055.0, 2 pages.
Korean Patent Application dated Mar. 2, 2022, received in Korean Patent Application No. KR10-2021-7014892, 7 pages.
Korean Patent Application dated Mar. 2022, received in Korean Patent Application No. KR10-2021-7019325, 7 pages.
Korean Office Action with English translation, dated Nov. 1, 2021, received in Korean Patent Application No. 10-2021-7014892, 15 pages.
Korean Office Action with English translation dated Nov. 1, 2021, received in Korean Patent Application No. 10-2021-7019325, 24 pages.
Chinese Office Action with English translation dated Jan. 11, 2022, received in Chinese Patent Application No. 202010302794.2, 22 pages.
Chinese Office Action with English translation dated Jul. 15, 2022, received in Chinese Patent Application No. 202010302794.2, 19 pages.
Japanese Decision of Rejection with machine generated English translation dated Jul. 19, 2022, received in Japanese Patent Application No. 2021-000867, 8 pages.
Chinese Office Action with English translation dated Sep. 8, 2022, received in Chinese Patent Application No. 202110525107.8, 5 pages.
UK Examination Report dated Sep. 22, 2022, received in UK Patent Application No. GB2109055.0, 4 pages.
Australian Examination Report dated Mar. 11, 2022, received in Australian Patent Application No. 2020294284, 6 pages.
Korean Notice of Final Rejection with English translation dated Apr. 22, 2022, received in Korean Patent Application No. 10-2021-7019325, 7 pages.
Japanese Submission for Publication submitted Jun. 3, 2022, in Japanese Patent Application No. 2021-000867, with machine translation, 28 pages.
Australian Office Action dated Feb. 15, 2023, received in Australian Patent Application No. 2020294284, 4 pages.

* cited by examiner

HAND-HELD SURFACE CLEANING DEVICE

RELATED APPLICATIONS

This application claims the benefit of U.S. Provisional Patent Application Ser. No. 62/561,851, filed on Sep. 22, 2017, U.S. Provisional Patent Application Ser. No. 62/585,320, filed on Nov. 13, 2017, U.S. Provisional Patent Application Ser. No. 62/616,908, filed on Jan. 12, 2018, and U.S. Provisional Patent Application Ser. No. 62/619,309, filed on Jan. 19, 2018, each of which is fully incorporated herein by reference.

TECHNICAL FIELD

This specification generally relates to surface cleaning apparatuses, and more particularly, to a hand-held surface cleaning device and vacuum systems implementing the same.

BACKGROUND INFORMATION

Vacuum cleaners and other surfaces devices can have multiple components that each receive electrical power from one or more power sources (e.g., one or more batteries or electrical mains). For example, a vacuum cleaner may include a suction motor to generate a vacuum within a cleaning head. The generated vacuum collects debris from a surface to be cleaned and deposits the debris in a debris collector. The vacuum may also include a motor to rotate a brush roll within the cleaning head. The rotation of the brush roll agitates debris that has adhered to the surface to be cleaned such that the generated vacuum is capable of removing the debris from the surface. In addition to electrical components for cleaning, the vacuum cleaner may include one or more light sources to illuminate an area to be cleaned.

Vacuum cleaners generally occupy a relatively large amount of space in a closet or other storage location. For instance, up-right vacuums tend to be kept an in-use, upright position when stored away for future use. To this end, storage of a vacuum cleaner requires a space that can accommodate the overall height and width of the vacuum. This often relegates vacuums to storage locations in unseen places such as a closet, garage, or other out-of-the-way place. Such locations may be some distance from rooms and other locations that may require periodic cleaning, which may thus result in less cleaning of those locations because hauling a vacuum to and from storage may be impractical or otherwise inconvenient.

BRIEF DESCRIPTION OF THE DRAWINGS

These and other features advantages will be better understood by reading the following detailed description, taken together with the drawings wherein.

DETAILED DESCRIPTION

Figure 1:
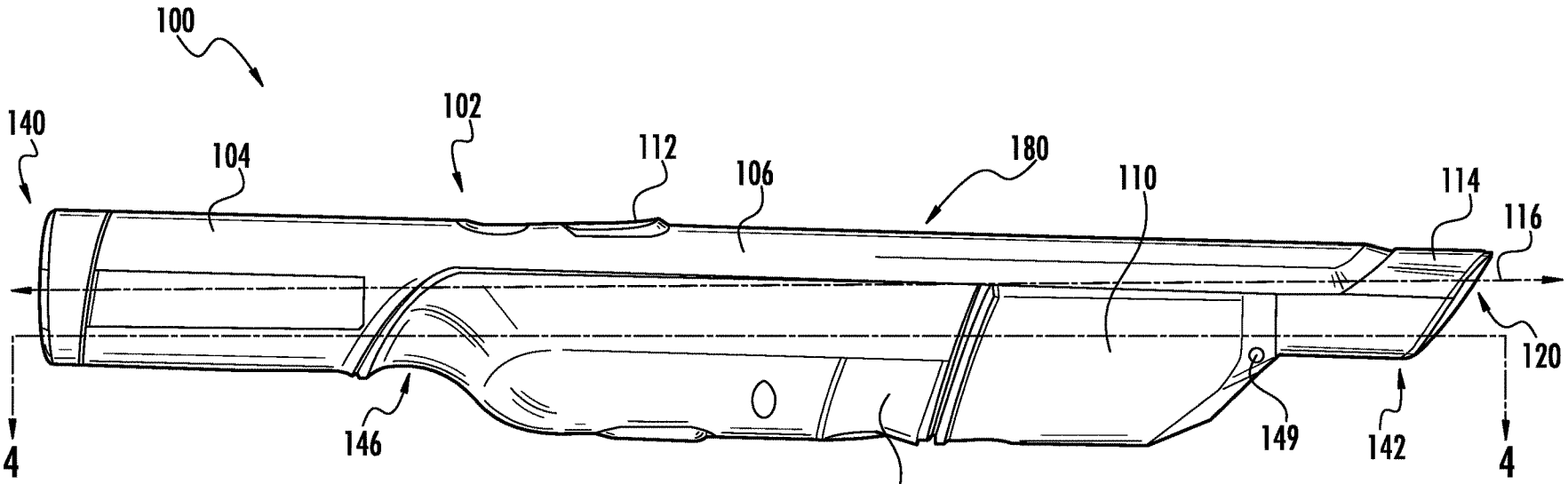
FIG. 1 shows an example embodiment of a hand-held surface cleaning device consistent with an embodiment of the present disclosure.
Figure 2:
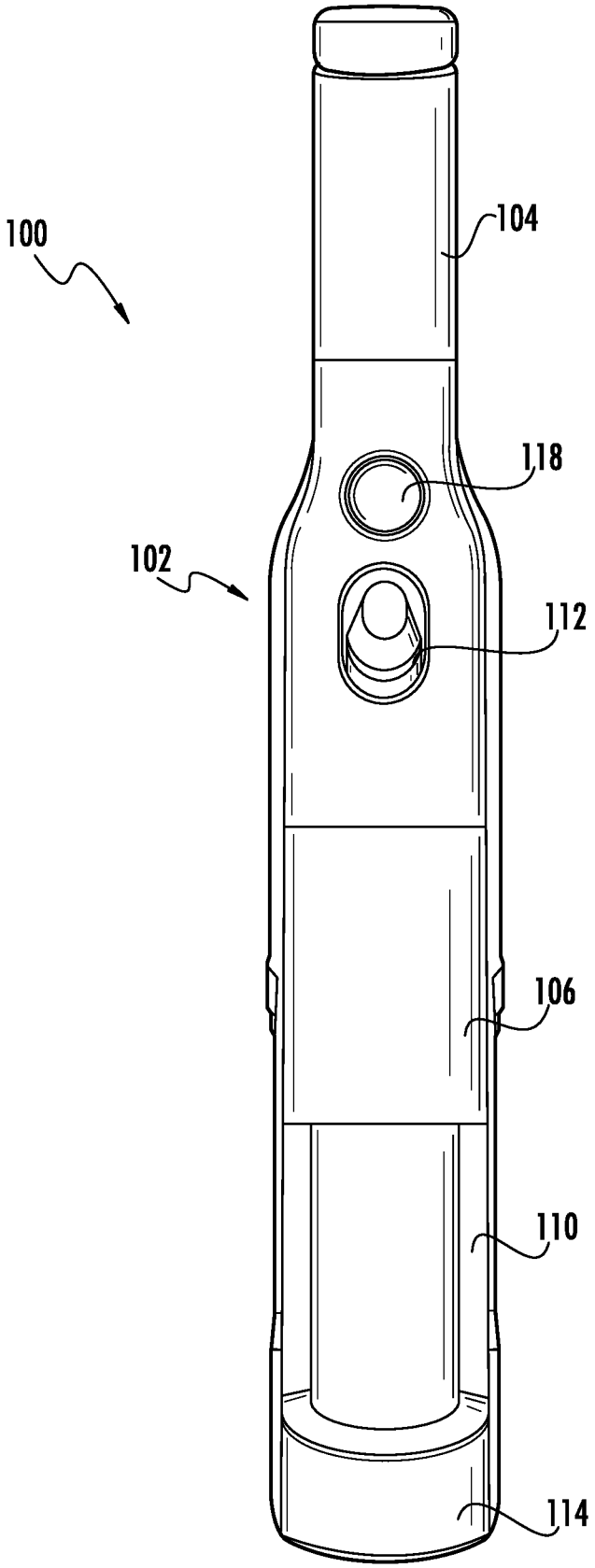
FIG. 2 shows a top view of the hand-held surface cleaning device of FIG. 1 consistent with an embodiment of the present disclosure.

In general, the present disclosure is directed to a hand-held surface cleaning device that includes a relatively compact form-factor to allow users to store the same in a nearby location (e.g., in a drawer, in an associated charging dock, on a table top) for easy access to perform relatively small cleaning tasks that would otherwise require retrieving a full-size vacuum from storage. A hand-held surface cleaning device consistent with aspects of the present disclosure includes a body (or body portion) with a motor, power source and dust cup disposed therein. The body portion also functions as a handgrip to allow the hand-held surface cleaning device to be operated by one hand, for example. Therefore, the body portion may also be referred to as a handgrip, handle portion, or simply a handle.

In an embodiment, a hand-held surface cleaning apparatus consistent with the present disclosure includes a body defining a handle portion and a dirty air passageway. The body may define a cavity for holding a motor for generating suction to draw dirt and debris into the dirty air passageway, a power source for powering the motor, and a dust cup for receiving and storing dirt. Each of the components within the body can be disposed in a coaxial manner Each of power source, motor, and dust cup may include a shape that generally corresponds with the body of the hand-held surface cleaning apparatus, e.g., a substantially cylindrical shape, rectangular shape, and so on. Thus, the body may include a relatively continuous width about its length to allow a user to comfortably grip the body in-hand during cleaning operations. The hand-held surface cleaning device also includes a cleaning head (or nozzle) that includes a longitudinal axis in parallel with the body to allow the hand-held surface cleaning device, in a general sense, to be operated similar to a wand of a conventional full-size vacuum to target various surfaces to clean without the added bulk of a trailing hose.

As generally referred to herein, dust and debris refers to dirt, dust, water, or any other particle that may be pulled by suction into a hand-held surface cleaning device.

Turning to the Figures, FIGS. 1-4 show a hand-held surface cleaning device 100 in accordance with an embodiment of the present disclosure. As shown, the hand-held surface cleaning device 100 includes a body 102 that extends from a first end 140 to a second end 142 along a longitudinal axis 116. The body 102 of the hand-held surface cleaning device 100 includes a handle portion 104 adjacent the first end 140 followed by a motor portion (or section) 106, a filter portion 108, a dust cup 110 and a nozzle 114 disposed adjacent the second end 142. The body 102 can include a substantially flat and continuous surface 180 that extends from the first end 140 to the second end 142 to form a "wand" like apparatus. In an embodiment, the handle portion 104, motor portion 106, filter portion 108 and nozzle 114 may be formed as a single, monolithic piece. In other cases portions such as the nozzle 114 and/or filter portion 108 may be removable.

As shown, the handle portion 104 of the hand-held surface cleaning device 100 is contoured to comfortably fit within the hand of a user during operation. The tapered region 146 may advantageously allow for a user's hand and fingers to more comfortably grip and operate the hand-held surface cleaning device 100. The body 102 of the hand-held surface cleaning device 100 further includes an on/off button 118 and a dust-cup release button 112. The on/off button 118 and the dust-cup release 112 may be actuated by, for example, the thumb of a user's hand when the handle portion 104 is held by the same. The dust-cup release 112 may be slidably engaged, e.g., displaced by a user's thumb, to unlock the dust cup 110, which will be described in greater detail below. The dust-cup release 112 may be spring-biased to return to a rearward position in the absence of a user-supplied force.

The motor section 106 of the body 102 may include circuitry (not shown) for selectively supplying power to a motor 126 (see FIG. 4) disposed therein. The motor 126 may be a DC motor or other suitable motor for generating suction. In some embodiments, the hand-held surface cleaning device 100 may include a vortex arrangement, so the illustrated embodiment is not intended to limit the present disclosure. The motor 126 generates suction to draw air into the dirty air inlet 120. The amount of power supplied to the motor 126 may vary to proportionally adjust the amount of suction power. Alternatively, the on/off button 118 may simply cause a constant amount of power to be supplied to the motor 126.

Figure 3:
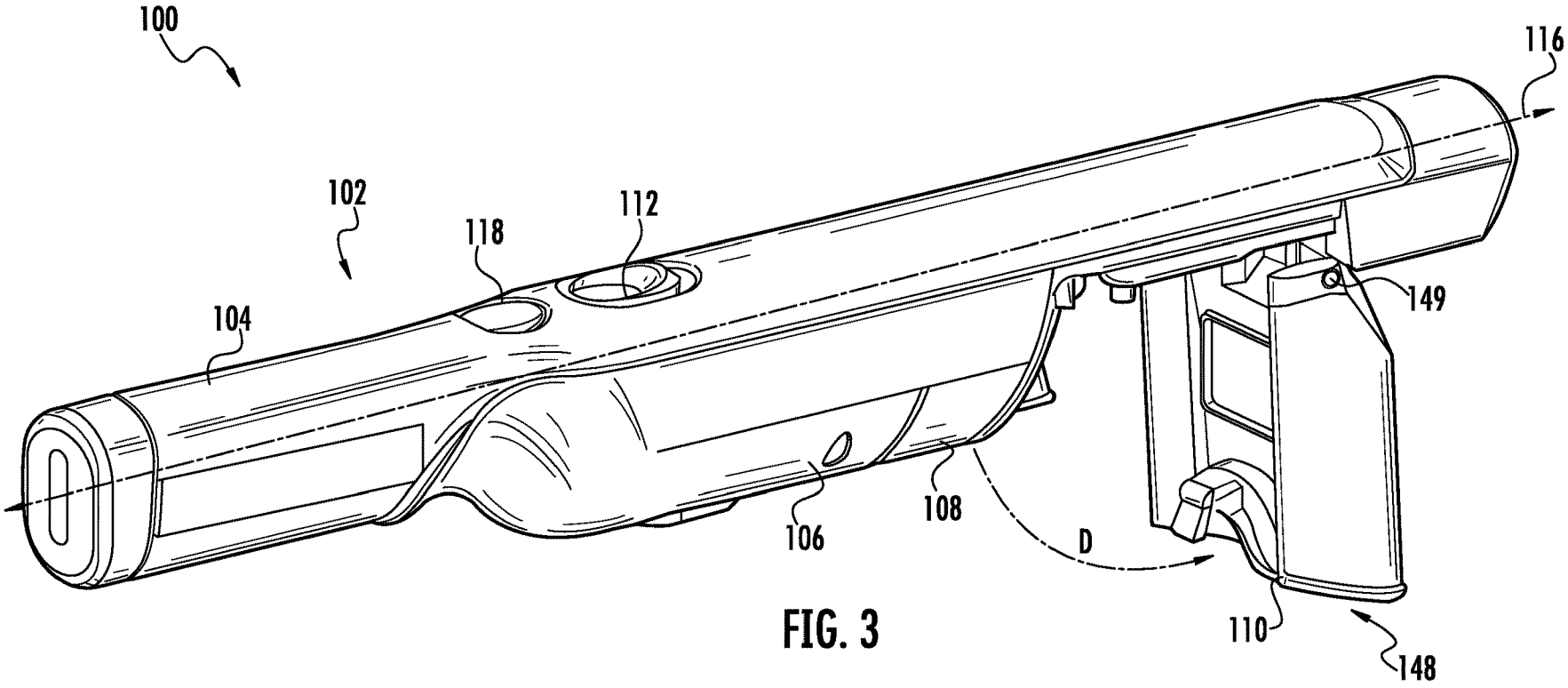
FIG. 3 shows a side perspective of the hand-held surface cleaning device of FIG. 1 consistent with an embodiment of the present disclosure.

Continuing on, the dust cup 110 may be configured to receive and store dirt and debris received via the dirty air inlet 120. As shown, the dust cup 110 is rotatably coupled to the body 102, and more particularly, to a portion of the dirty air inlet 120 by way of a hinge 149, with the hinge 149 being formed by a pin extending through the body 102 substantially transverse relative to the longitudinal axis 116. The nozzle 114 may provide the hinge 149. In some cases the nozzle 114 may be removable. The dust cup 110 may therefore rotate along a first rotational axis when released, e.g., via the dust-cup release 112. For example, as shown in FIG. 3, the dust cup 110 may rotate in a direction generally indicated as D and come to a stop at an angle of about 90 degrees relative to the longitudinal axis 116 of the body 102. This position of the dust cup 110 may be accurately referred to as an open, release or disposal orientation. In the open orientation, the opening 148 may then be used to allow dust and debris to exit the dust cup 110 into a trash bin, for example. Thus, the dust cup 110 may be transitioned between a locked/close orientation, e.g., as shown in FIG. 1, to an open/disposal orientation as shown in FIG. 3. When in the closed orientation, the dust cup 110 is in fluid communication with the filter of the filter section 108 by way of the opening 148. On the other hand, when in the open orientation the dust cup 110 decouples from fluid communication with the filter of the filter section 108 and permits the opening 148 to release/evacuate dust and debris stored within the dust cup 110.

As discussed further below, the dust cup 110 may include a cleaning or agitation element, e.g., bristles, that agitate a filter within the filter section 108. The agitation of the filter within the filter section 108 may free trapped/stuck dirt and debris and generally promote increased fluid communication of air to ensure that clogs are minimized or otherwise prevented from reducing suction power.

Figure 4:
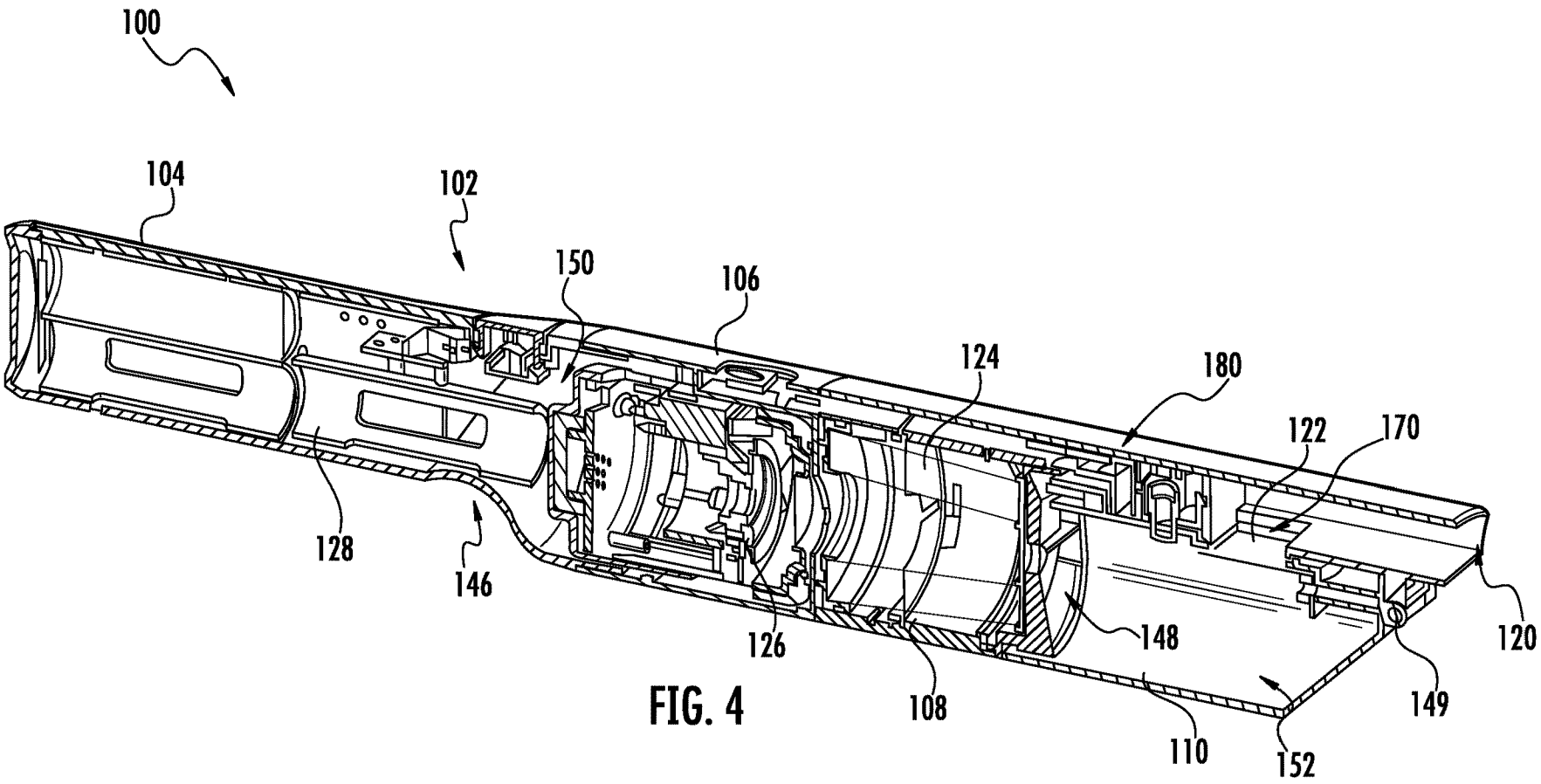
FIG. 4 shows a cross-sectional view of the hand-held surface cleaning device of FIG. 1 taken along line 4-4 consistent with an embodiment of the present disclosure.

FIG. 4 shows an example cross-sectional view of the hand-held surface cleaning device 100 taken along the line 4-4 of FIG. 1. As shown, body 102, and in particular the handle portion 104, defines a cavity 150 that can house one or more power sources such as batteries. The cavity can include a battery holder 128 or battery cradle 128 to position and align the batteries with associated electrical contacts (not shown) to electrically couple the batteries to the motor 126. As discussed above, the handle portion 104 provides a tapered region 146, with the tapered region 146 providing a transition between the handle portion 104 and the motor section 106.

Continuing on, the cavity 150 defined by the body 102 continues through the motor section 106. The motor section includes the motor 126 disposed in the cavity 150. Following the motor section, the cavity 150 continues through the filter section 108. The filter 124 may then be disposed in the cavity 150 of the filter section. As shown, the filter 124 is a cone-type filter, but other filter devices are within the scope of this disclosure. Thus, the cavity 150 may extend from the first end 140 at a base of the handle portion 104 to the second end by way of the dirty air inlet 120.

Adjacent the filter section 108, the dust cup 110 couples to the filter 124. The dust cup 110 may therefore fluidly couple with the filter section 108 by way of the opening 148. A screen 154 (see FIG. 6) may cover the opening 148 to prevent ingress of dirt and debris into the motor section 106, which is discussed in further detail below. As further shown, the dirty air inlet 120 is in fluid communication with the dust cup 110 for purposes of receiving and storing dirt and debris.

A valve body 122 formed from a flexible or resilient material may be disposed between the dust cup 110 and the dirty air inlet 120. In the absence of suction forced provided by the motor 126, the valve body 122 may remain in a valve seat position such as shown in FIG. 4. The valve body 122 may be biased towards the dirty air inlet 120 based on spring tension, e.g., based on a bend introduced into the material or other suitable arrangement. The seat position of the valve body 122 can form a seal, e.g., an air-tight seal that prevents 100% of air flow, or a partially air-tight seal that restricts at least 80% of air flow, between an opening of the dust cup 110 that aligns with an opening of the dirty air inlet 120, each of which is generally shown at 170. Thus, the seated position of the valve body 122 can prevent dust and debris from exiting the dust cup 110 by way of the aligned openings at 170 when the surface cleaning device 100 is "off", e.g., suction from the motor 126 isn't present. The valve body 122 may be configured to be displaced/bent into a cavity 152 of the dust cup 110 when suction force generated by the motor 126 to draw air into the dirty air inlet, and ultimately, the dust cup 110.

In an embodiment, when the dust cup 110 is in the release orientation, e.g., as shown in FIG. 3, the valve body 122 in the seated position continues to seal off the cavity of the dust cup 110, e.g., based on a spring force that biases the valve body 122 away from the dust cup 110 to hold the same against one or more surfaces that define the cavity of the dust cup 110, to ensure that dust and debris exits the dust cup 110 only via opening 145.

Figure 5:
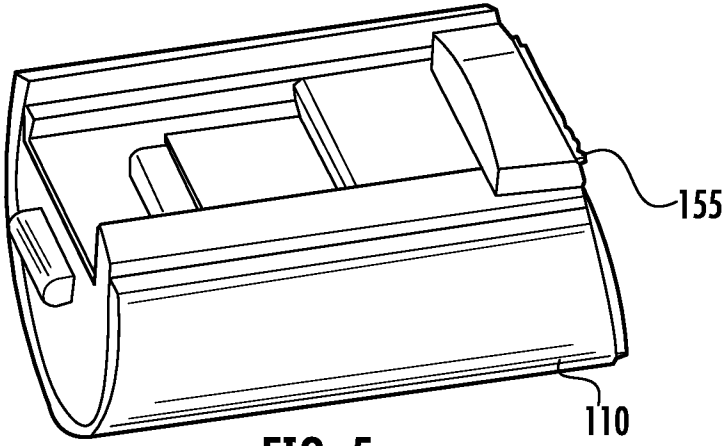
FIG. 5 shows an example dust cup suitable for use in the hand-held surface cleaning device of FIG. 1.
Figure 6:
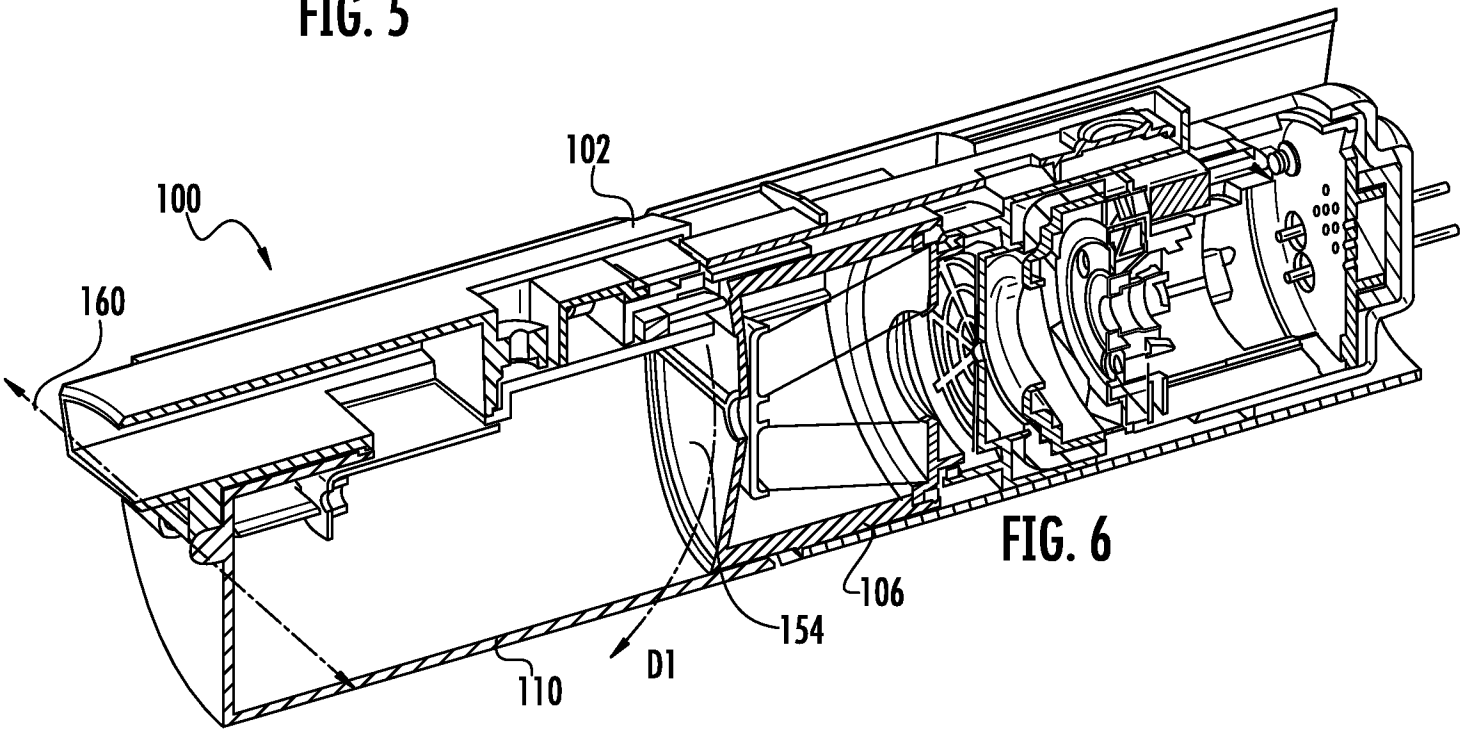
FIG. 6 shows another cross-sectional view of hand-held surface cleaning device of FIG. 1 consistent with an embodiment of the present disclosure.

Turning to FIG. 5, another example embodiment of a dust cup suitable for use in the hand-held surfacing cleaning device 100 of FIGS. 1-4. As shown, the dust cup includes an agitator member 155 in the form of a plurality of bristles. The bristles may be formed from, for example, plastic or other suitably rigid material. When in the closed position, such as shown in FIG. 6, the bristles 155 may be disposed adjacent the upper surface 180 of the body 102 of the hand-held surface cleaning device 100. As shown in the cross-section view of FIG. 6, as the dust cup 110 rotates about axis 160 to transition from a closed to open orientation the agitator member 155 makes contact with a screen 154 of the filter section 106. Note the screen 154 and the filter 124 may be referred to collectively herein as a filter arrangement. This contact, in a general sense, "scrapes" the screen 154 which may advantageously dislodge or otherwise displace debris stuck to the screen 154 to minimize or otherwise reduce loss of suction power between the motor, filter and dirty air inlet 120.

The same scraping action may be achieved when transitioning the dust cup 110 from the open to closed orientation. To this end, each cleaning operation of the dust cup 110 performed by the user may result in a two-stage cleaning action whereby the first stage includes scraping the screen 154 along a first direction D1 as the dust cup 110 is released and a second stage includes scraping the screen 154 along a second direction D2 (see FIG. 7) as the dust cup 110 is transitioned to the closed position. In some cases, a user may release and close the dust cup 110 multiple times to cause the two-stage cleaning action to clear obstructions.

Figure 7:
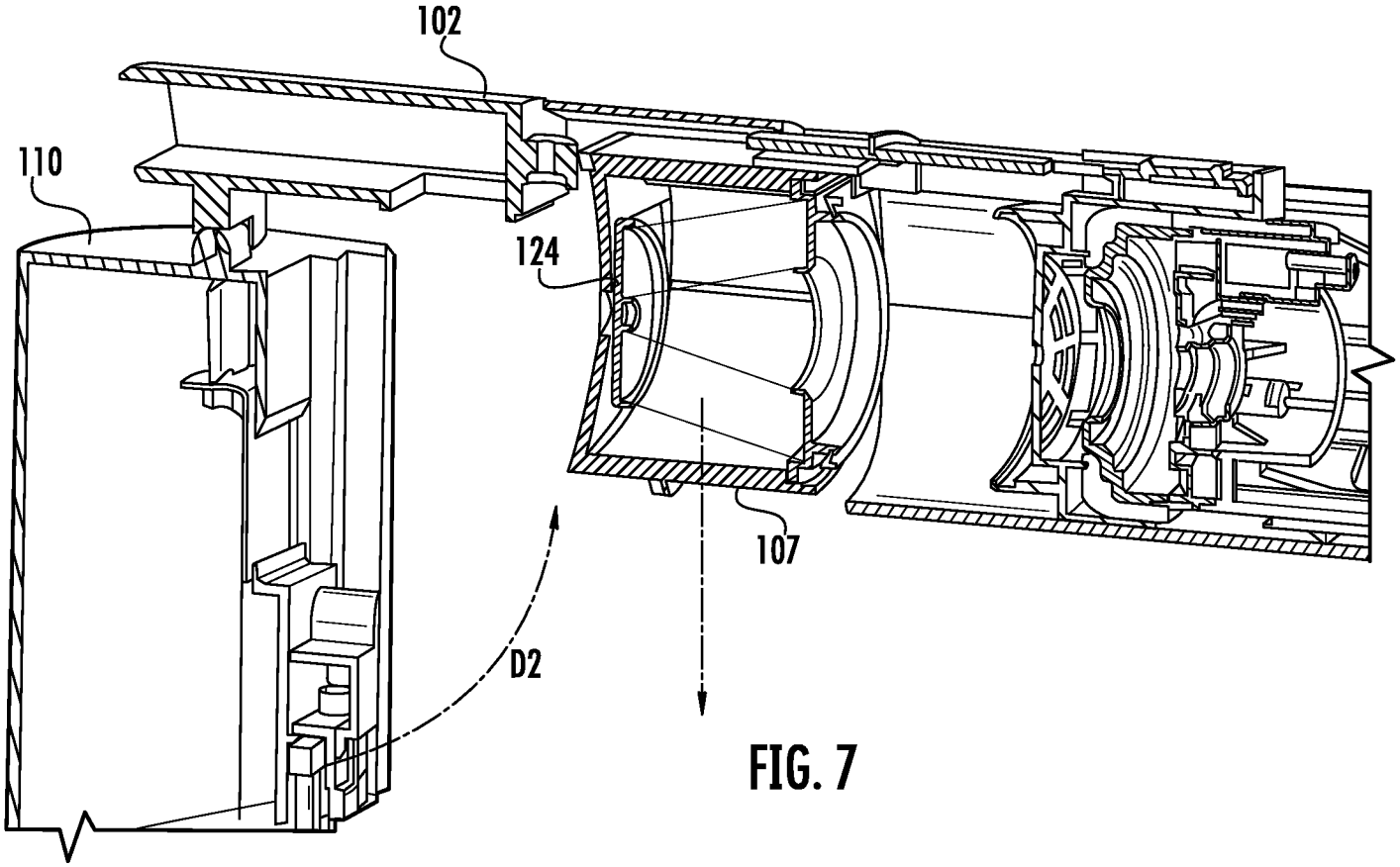
FIG. 7 shows another cross-sectional view of hand-held surface cleaning device of FIG. 1 consistent with an embodiment of the present disclosure.

As shown in FIG. 7, the filter section 106 can include a removable filter carriage 107 to allow for the filter 124 to be replaced or otherwise cleaned. As shown, this embodiment includes the dust cup 110 being in the release orientation prior to removal of the removable filter carriage 107. Alternatively, or in addition, the entire filter carriage 107 and filter 124 may be replaced as a single unit for ease of use.

Figure 8:
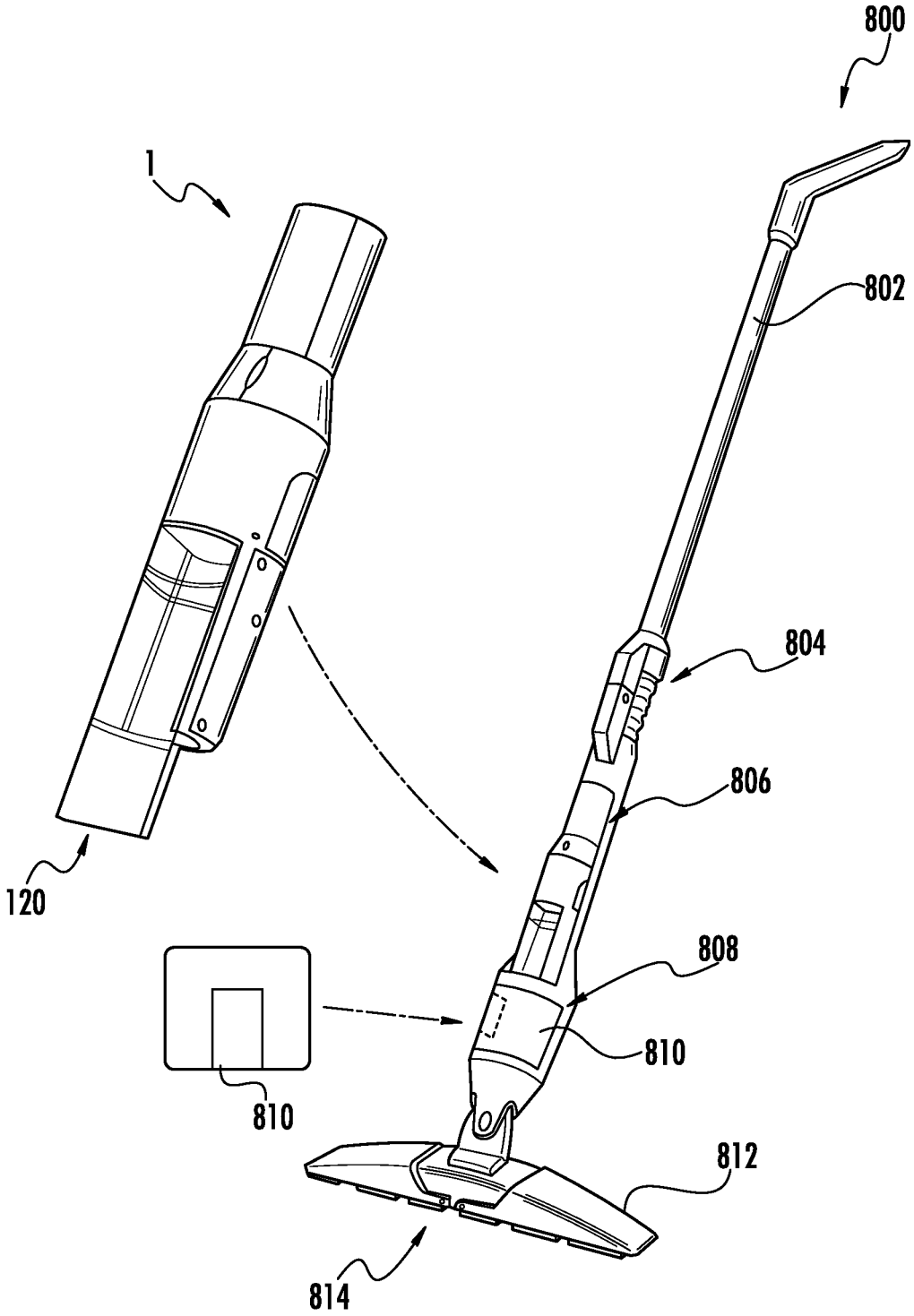
FIG. 8 shows an example vacuum cleaner frame with a receptacle to receive a hand-held surface cleaning device consistent with embodiments of the present disclosure.

FIG. 8 shows an example of a vacuum cleaner apparatus 800 being configured to removably couple to a hand-held surface cleaning device 1. The hand-held surface cleaning device 1 may be implemented as the hand-held surface cleaning device 100 of FIG. 1, and this disclosure is not intended to be limiting this regard. As shown, the vacuum cleaning apparatus 800 includes a vacuum frame 802 (o simply a frame 802), collapsible joint 804, a hand-held surface cleaner receptacle 806, a dust cup receptacle 808, a removable dust cup 810, and a cleaning head 812 with dirty air inlet 814.

The frame 802 defines the hand-held surface cleaner receptacle 806 or hand-held receptacle, with the hand-held receptacle being configured to securely hold the hand-held surface cleaning device 1. When the hand-held surface cleaning device 1 is disposed/mounted within the hand-held receptacle 806, the dirty air inlet 120 may be aligned with and in fluid communication with a dirty air channel (not shown) that fluidly couples the dirty air inlet 814 with the dust cup 810. Therefore, the suction generated by the motor of the hand-held surface cleaning device 1 may be used to draw air into the dirty air inlet 814. From there, dirt and debris may then be stored in the dust cup 810 (or first dust cup) and/or the dust cup 110 (or second dust cup) of the hand-held surface cleaning device 1.

In some cases, the presence of the dust cup 810 effectively increases (e.g., doubles or more) the overall amount of storage for dust and debris relative to using the dust cup 110 alone, although in some embodiments the dust cup 110 may be utilized exclusively. As also shown, the frame 802 includes an optional collapsible joint 804 that allows for the upper handle portion of the frame 802 to be bent parallel to the lower portion having the hand-held receptacle 806 for storage purposes (See also FIGS. 34A-34C).

Figure 9:
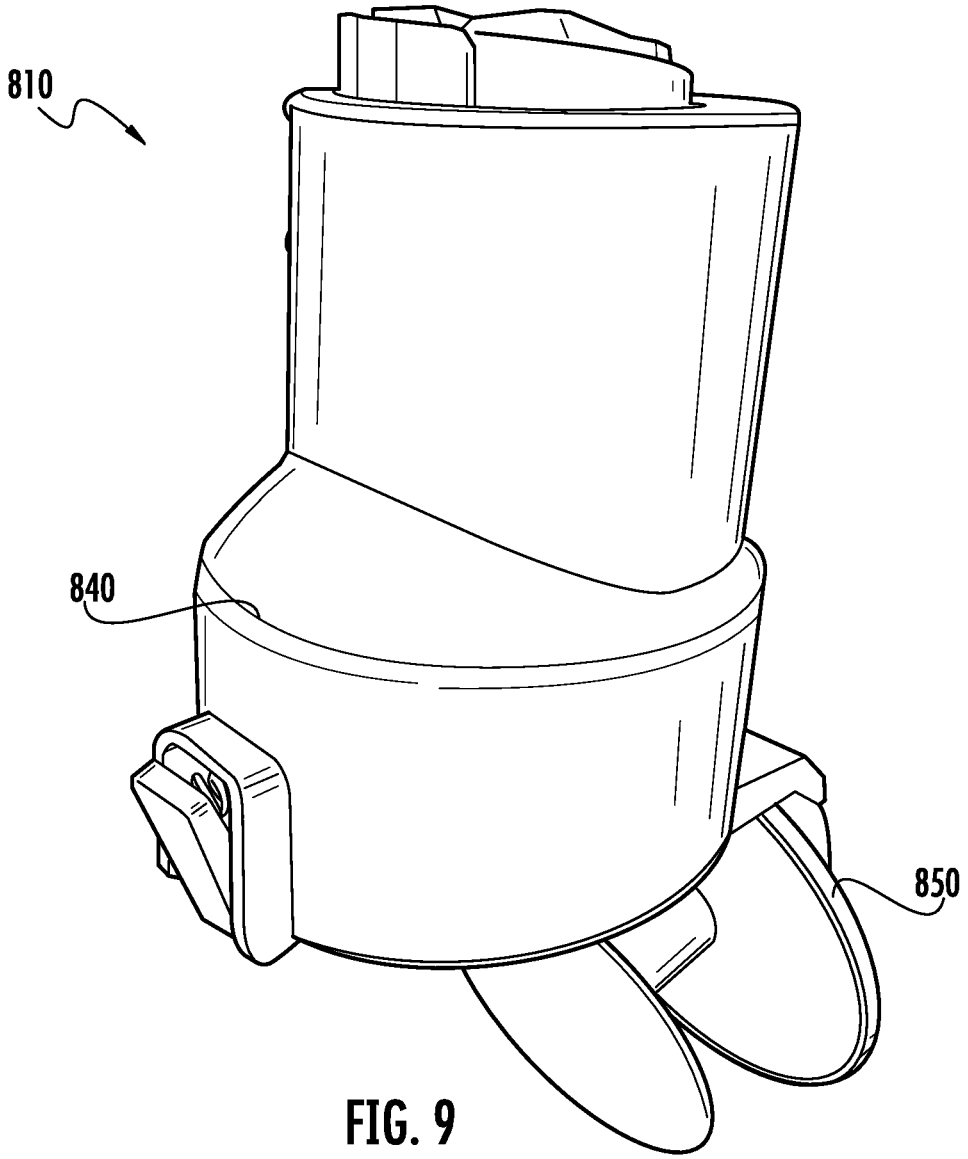
FIG. 9 shows an example dust cup for use by the example vacuum cleaner frame of FIG. 8 consistent with an embodiment of the present disclosure.

FIG. 9 shows an example of a dust cup 810 having a door 850 that may be hinged to the body 840 of the dust cup 810. In this example, a button may be pressed to release the door 850 and allow the same to swing/rotate open to allow stored dirt and debris to exit the body 840 of the dust cup 810.

Figure 10:
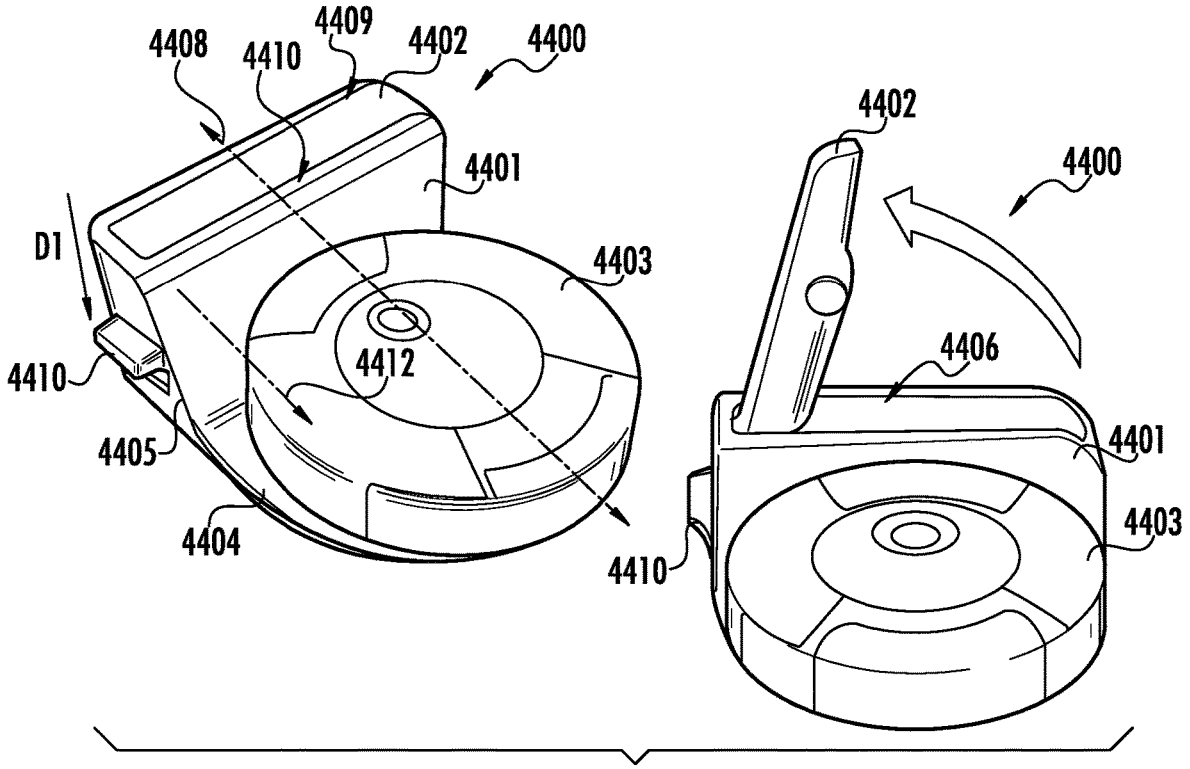
FIG. 10 shows an example of a hand-held surface cleaning device coupled to a dock, consistent with embodiments of the present disclosure.

FIG. 10 shows an example embodiment of a docking system 4400 that includes a dock 4401, a hand-held surface cleaning device 4402 and a robotic vacuum 4403. In an embodiment, the hand-held surface cleaning device 4402 is implemented as the hand-held surface cleaning device 100 of FIG. 1 or the hand-held surface cleaning device 1 of FIG. 21, for example. As shown, the dock 4401 includes a robotic vacuum coupling section defined at least in part by a base 4404, with the base 4404 being configured to removably couple to the robotic vacuum 4403. The base 4404 may further include electrical contacts/terminals for electrically coupling with the robotic vacuum 4403 for recharging purposes.

The dock 4401 further includes a hand-held surface cleaning device coupling section 4405, which may also be referred to as simply a wand coupling section. The wand coupling section 4405 may include a wand receptacle 4406 and a wand release 4410 (or wand release pedal 4410). As shown in the example embodiment of FIG. 11, the wand receptacle 4406 (or receptacle) may be a recess/opening defined by sidewalls of the wand coupling section 4405. The wand receptacle 4406 may extend substantially perpendicular relative to a longitudinal axis 4408 of the dock 4401. The wand receptacle 4406 may be configured to at least partially receive the hand-held surface cleaning device 4402. The wand receptacle 4406 may include electrical contacts to electrically couple to the hand-held surface cleaning device 4402. As shown, the wand receptacle 4406 includes a depth that allows an upper surface 4409 of the hand-held surface cleaning device 4402 to mount flush with a surface 4401 defining the wand receptacle 4406. Thus, the hand-held surface cleaning device 4402 may be relatively hidden when mounted into the wand receptacle 4406 and have contours that generally correspond with shape of the wand coupling section 4405.

Insertion of the hand-held surface cleaning device 4402 into the wand receptacle 4406 may include inserting the hand-held surface cleaning device 4402 at a first angle, e.g., approximately 80 degrees, with the nozzle of the hand-held surface cleaning device 4402 being used to bias and engage spring-loaded mechanism (not shown). Once inserted, the hand-held surface cleaning device 4402 may be locked into position via a detent (not shown) or other suitable locking mechanism.

To remove the hand-held surface cleaning device 4402, a user-supplied force (e.g., by a user's foot or hand) provided against the wand release 4410 disengages the locking mechanism and may allow the spring-loaded mechanism to transition the hand-held surface cleaning device 4402 from a storage position to an extended/release position. As shown, this transition may include the hand-held surface cleaning device 4402 rotating about a first axis of rotation 4412 which extends substantially parallel with the longitudinal axis 4408. At the release position, a user may simply grip the hand-held surface cleaning device 4402 and supply a force in a direction vertically away from the wand receptacle 4406 to decouple the same for use.

Figure 11:
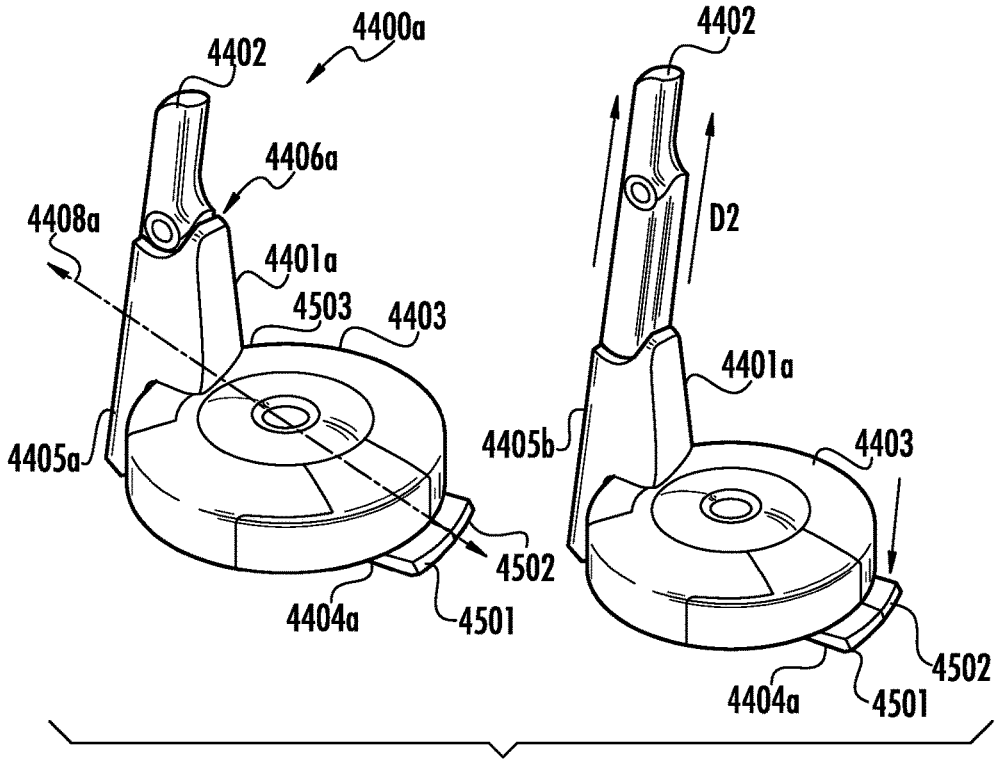
FIG. 11 shows another example of a hand-held surface cleaning device coupled to a dock, consistent with embodiments of the present disclosure.

FIG. 11 shows another example embodiment of a docking system 4400*a* consistent with the present disclosure. The embodiment of FIG. 11 may also be accurately referred to as an upright configuration, wherein the hand-held surface cleaning device 4402 extends vertically from the dock 4401*a*. In more detail, the dock 4401*a* includes a base 4404*a* and wand coupling section 4405*a*. The base 4404*a* includes release buttons 4501 and 4502. The release buttons 4501 and 4502 may allow for decoupling of the robotic vacuum 4403 and hand-held surface cleaning device 4402, respectively, based on a user-supplied force (e.g., from a user's foot). As shown, the release buttons 4501 and 4502 may at least partially define a ramp by which a robotic vacuum may travel over to couple to the dock 4401*a*.

The wand coupling section 4405*a* may include a wand receptacle 4406*a* that is configured to at least partially receive the hand-held surface cleaning device 4402. In particular, the wand receptacle 4406*a* may include an elongated cavity with a longitudinal axis that may extend substantially perpendicular with the longitudinal axis of the hand-held surface cleaning device 4402. Thus, a handle section/region of the hand-held surface cleaning device 4402 may at least partially extend from the wand receptacle 4406*a* when in the storage position.

The wand coupling section 4405*a* may include a taper adjacent the robotic vacuum coupling section to provide a recess to at least partially receive a robotic vacuum. Therefore, the taper may form at least a portion of the robotic vacuum coupling section. When the robotic vacuum 4403 is coupled to the base 4404*a*, at least a portion 4503 of the wand coupling section 4405*a* may extend over the robotic vacuum 4403. This may advantageously reduce the overall footprint of the docking system 4400*a* when the robotic vacuum is the storage position, i.e., coupled to the base 4404*a*.

A user may then grip the handle section/region of the hand-held surface cleaning device 4402 and supply a force generally along direction D2 to decouple the same from the wand receptacle 4406*a*. In some cases, the user must first engage the release button 4502 to unlock the hand-held surface cleaning device 4402 from the wand receptacle 4406*a*. In addition, the wand receptacle 4406*a* may include a spring-loaded mechanism that, in response to the user supplying a force to release button 4502, causes the hand-held surface cleaning device 4402 to travel upwards along direction D2 while remaining at least partially within the wand receptacle 4406*a*. Direction D2 may extend substantially perpendicular relative to the longitudinal axis 4408*a* of the dock 4401*a*. This may advantageously reduce how far down a user must reach down to grip the hand-held surface cleaning device 4402.

Figure 12:
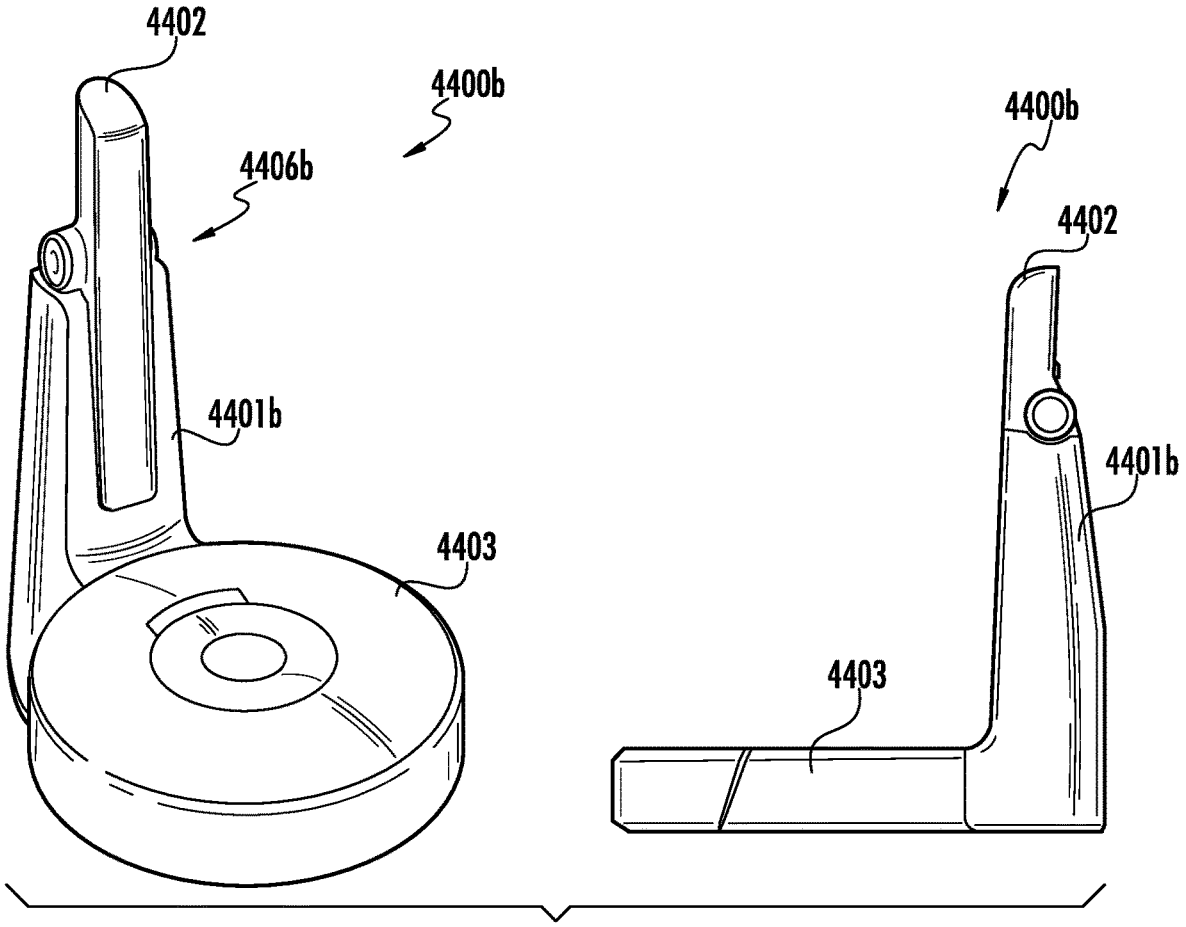
FIG. 12 shows another example of a hand-held surface cleaning device coupled to a dock, consistent with embodiments of the present disclosure.
Figure 45:
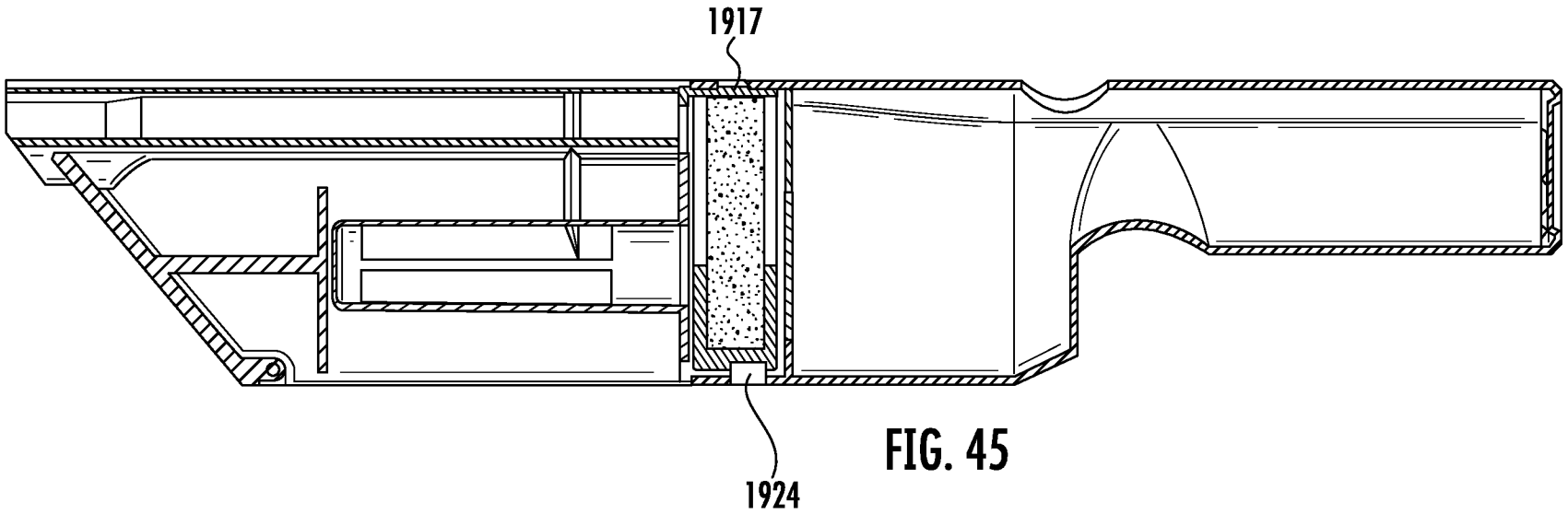
FIG. 45 shows another cross-sectional view of the example embodiment of FIG. 37 consistent with embodiments of the present disclosure.

FIG. 12 shows another example embodiment of a docking system 4400*b* in an upright configuration consistent with the present disclosure. As shown, this embodiment is substantially similar to that of the docking system 4400*a*, and for purpose of brevity the description of which will not be repeated. However, the docking system of 4400*a* includes a wand receptacle 4406*b* without a locking mechanism and instead may utilize a friction-fit or simply gravity. Thus, the hand-held surface cleaning device 4402 may be inserted/removed from the dock 4401*b* without actuating a release, e.g., release button 4502 (FIG. 45).

FIG. 13*a-d* shows another example embodiment of a docking system 4400*c* consistent with aspects of the present disclosure. As shown, the docking system 4400*c* includes a dock 4401*c*, a hand-held surface cleaning device 4402, and a robotic vacuum 4403. The dock 4401*c* includes a base 4404*b* that defines a robotic vacuum coupling section. The wand coupling section 4401*c* includes fixed portion 4703 rotatably coupled to a wand receptacle 4407*b* by way of a hinge 4702. The wand receptacle 4407*b* may therefore rotate about a second rotational axis 4412*a* between a storage position (FIG. 13/*c*/*d*) and a release position (FIG. 47*a*), which are each discussed in greater detail below.

In the embodiment of FIG. 13-*d*, the wand receptacle 4407*b* may at least partially surround the hand-held surface cleaning device 4402. In a general sense, the wand receptacle 4407*b* may form a cradle that holds the hand-held surface cleaning device 4402 in a fixed position based on a friction-fit connection, gravity, or both.

Figure 13A:
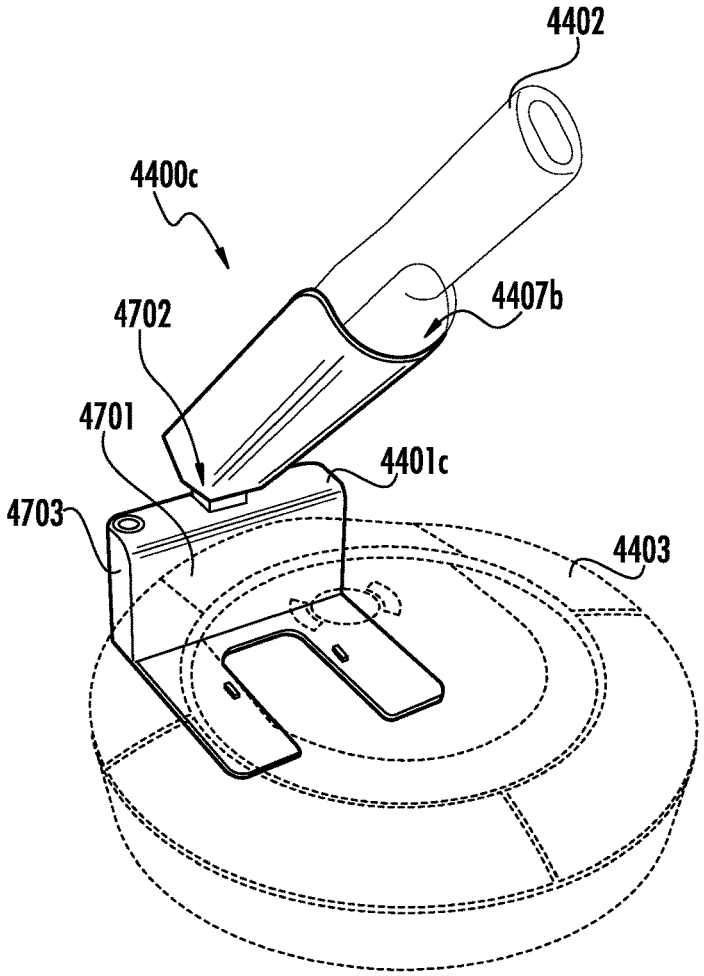
FIGS. 13A-13D show another example of a hand-held surface cleaning device coupled to a dock, consistent with embodiments of the present disclosure.
Figure 13B:
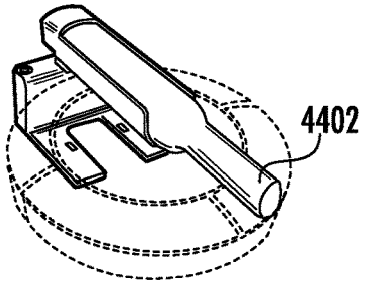
Figure 13C:
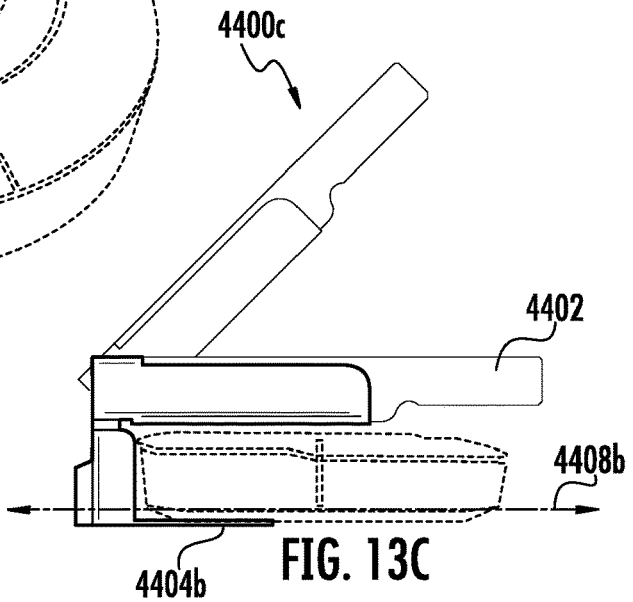
Figure 13D:
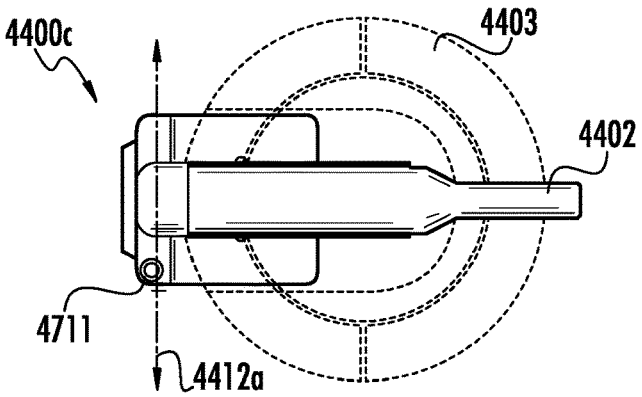

As shown in FIG. 13*a*, the wand receptacle 4407*b* is in a release position, wherein the wand receptacle 4407*b* extends at about 45±20 degrees relative to the longitudinal axis 4408*b* of the base. Thus, a user may easily reach down and grip the hand-held surface cleaning device 4402. On the other hand, the wand receptacle 4407*b* extends substantially parallel with the longitudinal axis 4408*b* of the base when in a storage position, such as shown in FIG. 13*c*.

In an embodiment, the wand receptacle 4407*b* may transition between the storage and release position by way of the hinge 4702 or other suitable coupling device that allows for rotation about the second rotational axis 4412*a*. The dock 4401*c* may include a mechanical mechanism (e.g., gears, belt drive, or other suitable mechanism) for causing rotation of the wand receptacle 4407*b* between storage and release positions. The fixed portion 4703 may include a proximity sensor 4711 such as an infrared (IR) sensor. The proximity sensor 4711 may induce a vertical IR field that when breached by a hand (or other part) of a user the wand receptacle 4407*b* may automatically rotate to the release position to allow for easy detachment of the hand-held surface cleaning device 4402. The release position may also "reveal" or otherwise provide access to controls on an upper surface of the robotic vacuum 4403 (see FIGS. 14*a-c*).

Figure 14A:
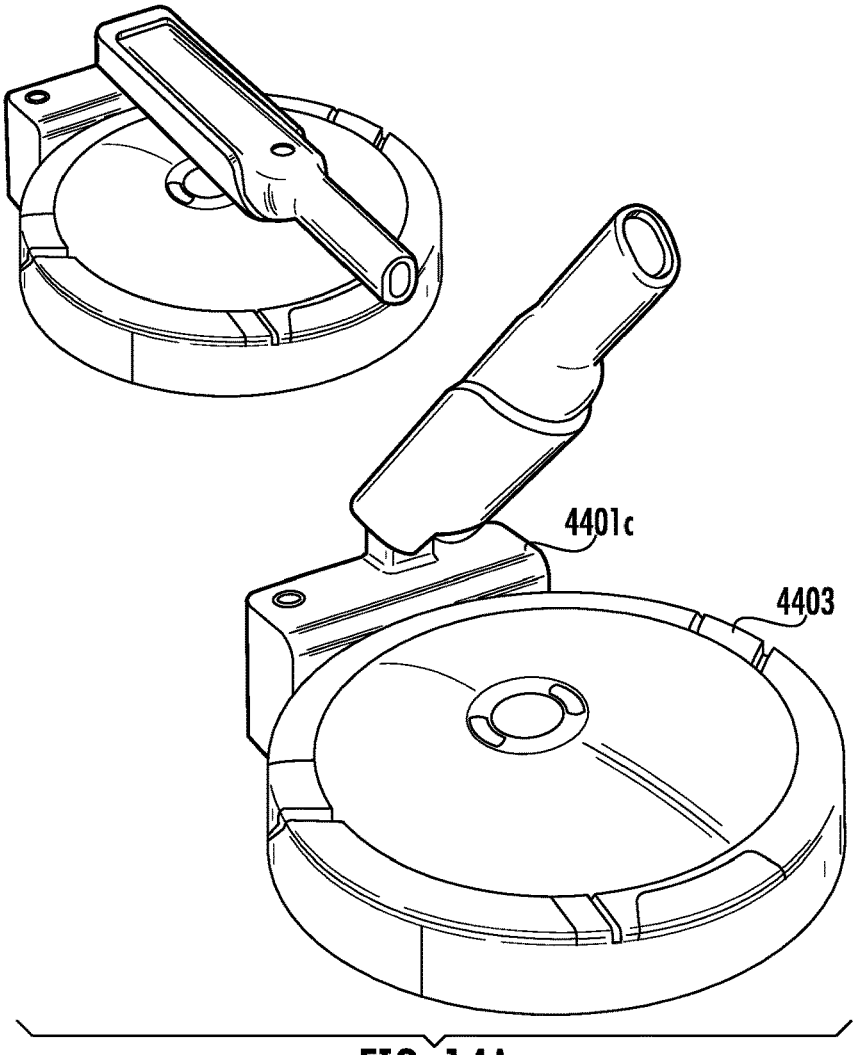
FIGS. 14A-14C show another example of a hand-held surface cleaning device coupled to a dock, consistent with embodiments of the present disclosure.
Figure 14B:
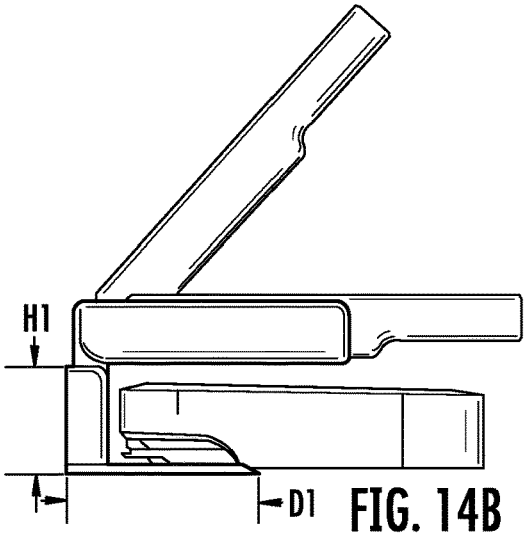
Figure 14C:
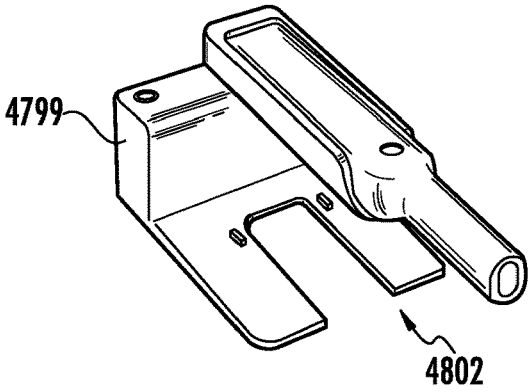

FIGS. 14*a-c* shows the embodiment of FIGS. 13*a*-13*d* in additional detail. As shown, the dock 4401*c* may include elongatesd legs 4802 that extend from the fixed section 4799 to a distance D1 that is at least 1.5× the height H2 of the fixed section 4799. The elongated legs 4802 may therefore advantageously support the wand receptacle 4407*b* (and the hand-held surface cleaning device 4402) in the absence of the robotic vacuum 4403.

Figure 15A:
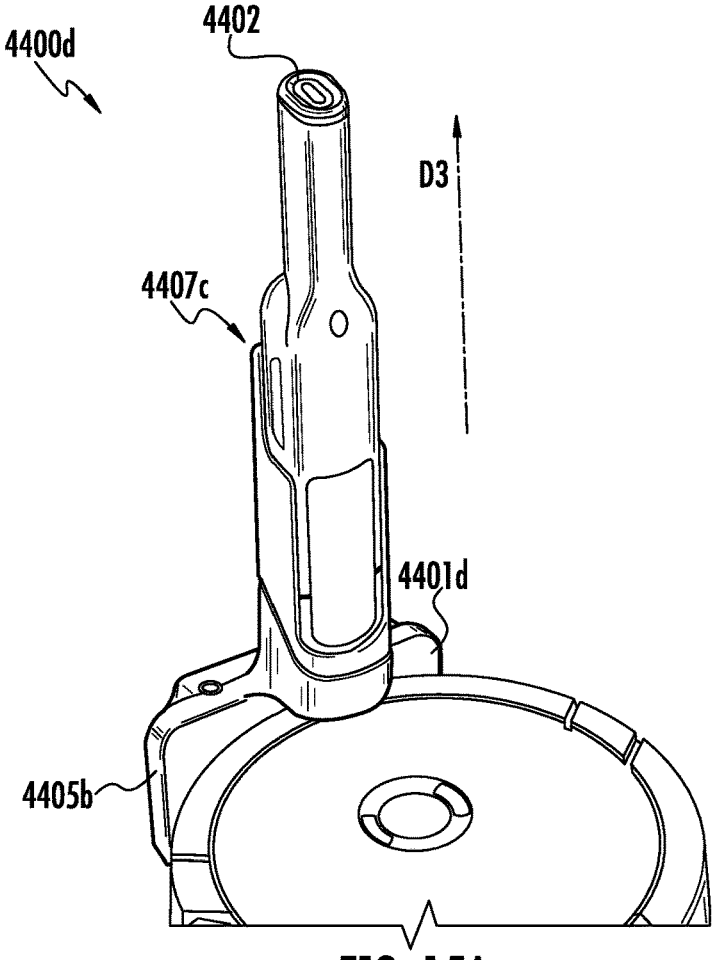
FIGS. 15A-15C show another example of a hand-held surface cleaning device coupled to a dock, consistent with embodiments of the present disclosure.
Figure 15B:
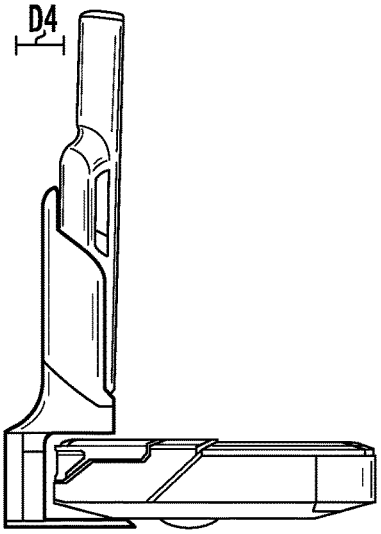
Figure 15C:
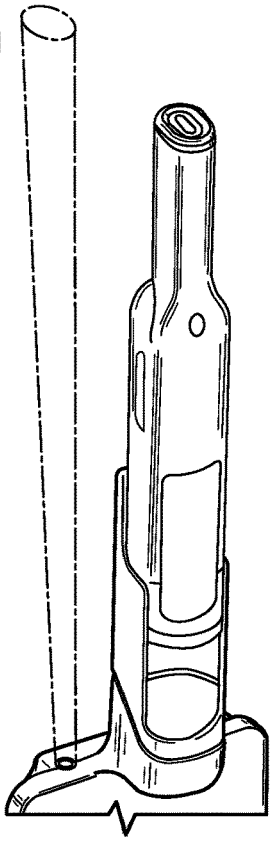

FIG. 15 shows another embodiment of a docking system 4400*d* consistent with aspects of the present disclosure. The docking system 4400*d* is similar to that of the docking system 4400*a* (FIG. 11), the disclosure of which will not be repeated for brevity. As shown, the wand coupling section 4405*b* includes an IR sensor (or other suitable proximity sensor) and a wand receptacle 4407*c* with a tooth/detent (not shown), an elevator/extender mechanism. The IR sensor may emit a IR beam adjacent the dock 4401*d*. In the event the IR beam is breached (e.g., by a user's hand), a signal may be sent to the elevator/extender mechanism to cause the same to extend upwards along vertical direction D3. The tooth/detent may engage a guide/track disposed along the length of the hand-held surface cleaning device 4402 to allow the same to travel vertically along a relatively straight path. In an embodiment, this may cause the hand-held surface cleaning device 4402 to rise six (6) to eight (8) inches, although other configurations are within the scope of this disclosure. The IR sensor may further include a visual indicator, e.g., an LED, to draw a user's attention to the location of the sensor.

As further shown in FIG. 15, the wand coupling section 4405*b* may be tapered (as shown in the side profile) to offset the wand receptacle 4407*c* from adjacent wall by distance D4. This may advantageously allow for a user to more easily reach a hand around the hand-held surface cleaning device 4402 to grip the same even if the dock 4401*d* is disposed flush against a wall.

Figure 16A:
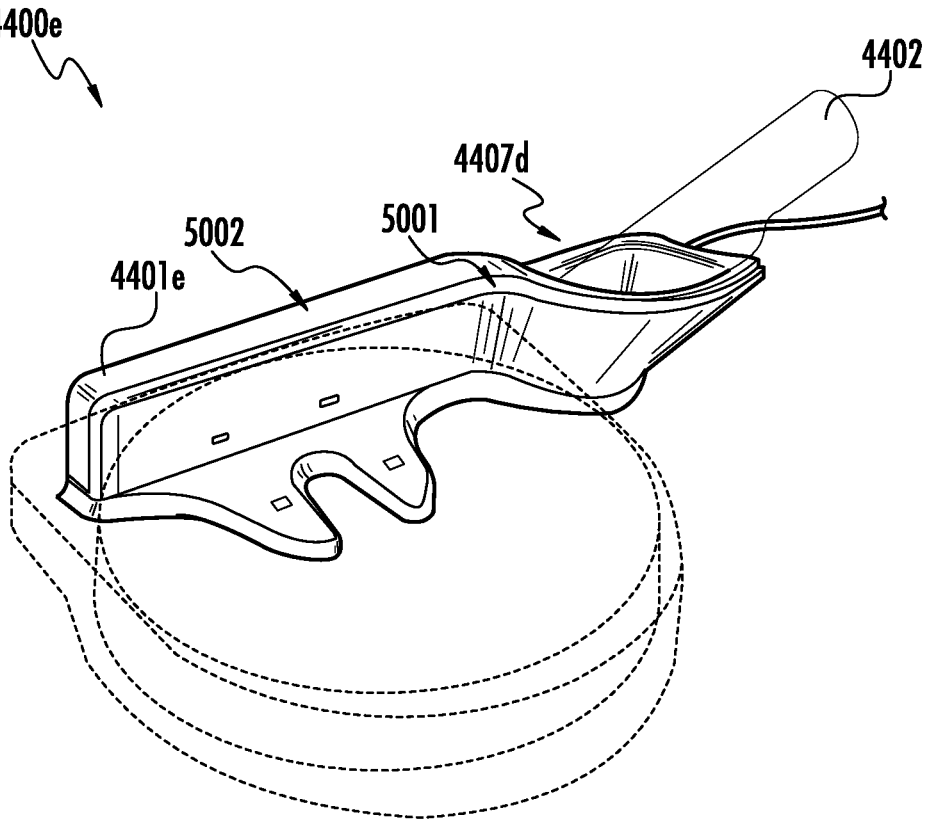
FIGS. 16A-16C show another example of a hand-held surface cleaning device coupled to a dock, consistent with embodiments of the present disclosure.
Figure 16B:
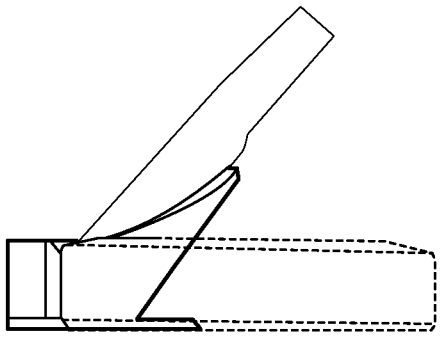
Figure 16C:
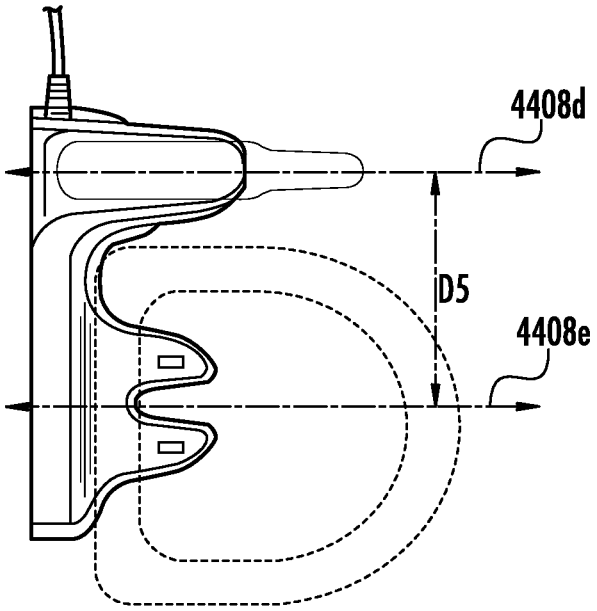

FIGS. 16*a*-16*c* collectively show another embodiment of a docking system 4400*e* consistent with aspects of the present disclosure. As shown, the dock 4401*e* includes a wand receptacle 4407*d* adjacent a first end 5001 of the dock 4401*e*. As shown, the wand receptacle 4407*d* is integrally formed with the dock 4401*e* as a single, monolithic piece. However, the wand receptacle 4407*d* and the dock 4401*e* may be formed as separate pieces depending on a desired configuration. The wand receptacle 4407*d* may include a curvilinear profile/shape to increase aesthetic appeal and to form a shape which generally corresponds with the shape of the hand-held surface cleaning device 4402.

As shown, the wand receptacle 4407*d* has a fixed orientation wherein the hand-held surface cleaning device 4402 disposed therein is held at about a 45 degree angle relative to an upper surface 5002 defining the dock 4401*e*. Other angles are within the scope of this disclosure. The embodiment of FIGS. 16*a*-*c* may accurately be referred to as a side-by-side configuration whereby the wand receptacle 4407*d* is adjacent (e.g., disposed laterally) to the region that a robotic vacuum couples to the dock 4401*e*. Thus, when inserted into the wand receptacle 4407*d*, the hand-held surface cleaning device 4402 includes a longitudinal center line 4408*d* disposed horizontally offset by distance of D5 from a center line 4408*e* of the robotic vacuum drawn tangent to the dock 4401*e*, with the distance D5 being at least equal to the radius R1 of the robotic vacuum.

Figure 17A:
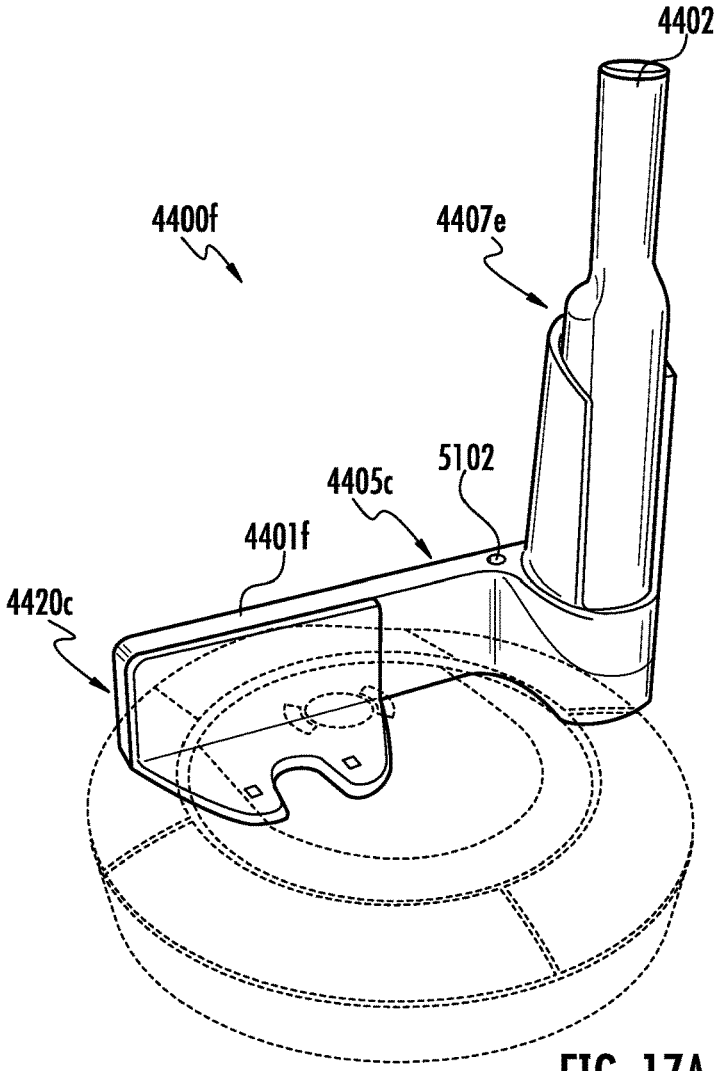
FIGS. 17A-17C show another example of a hand-held surface cleaning device coupled to a dock, consistent with embodiments of the present disclosure.
Figure 17B:
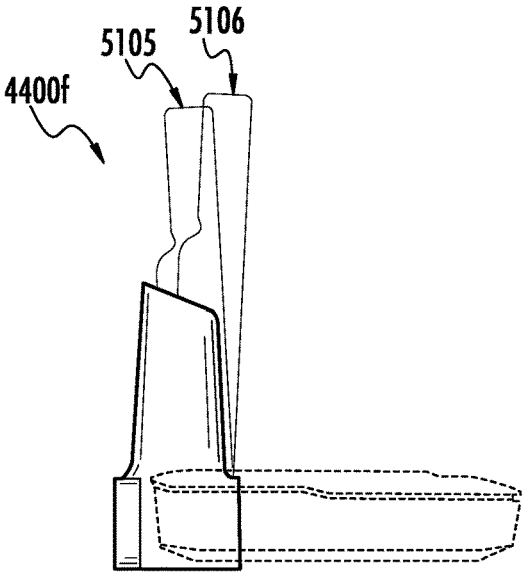
Figure 17C:
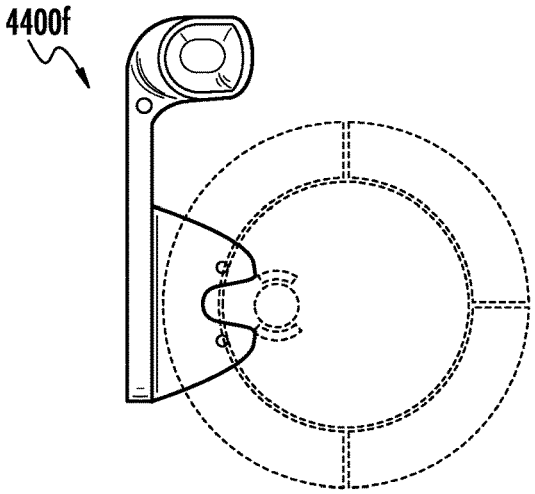
Figure 18A:
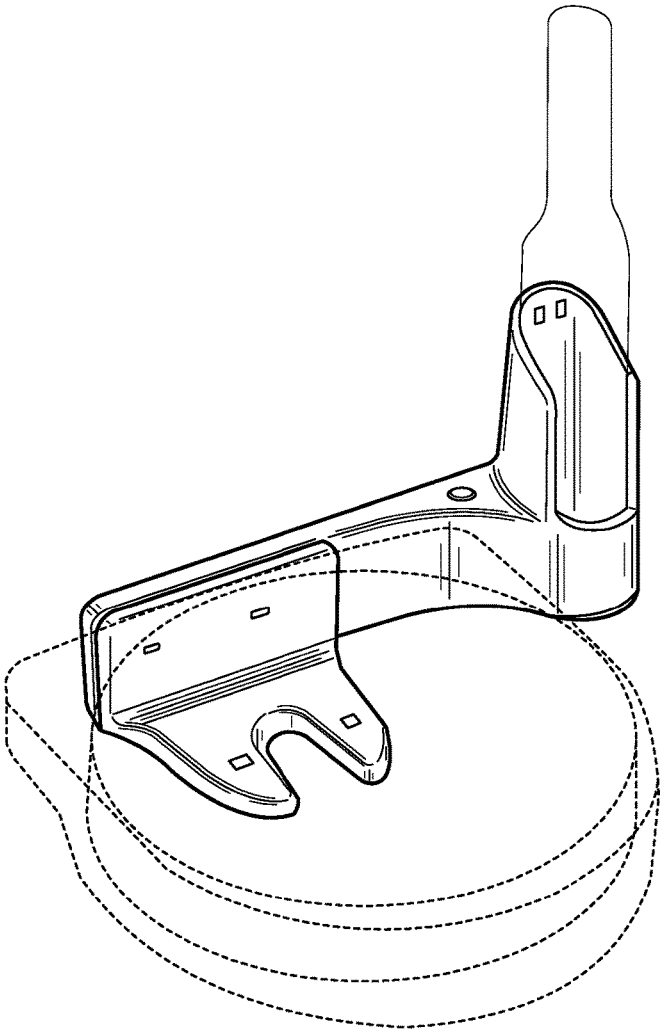
FIGS. 18A-18C show another example of a hand-held surface cleaning device coupled to a dock, consistent with embodiments of the present disclosure.
Figure 18B:
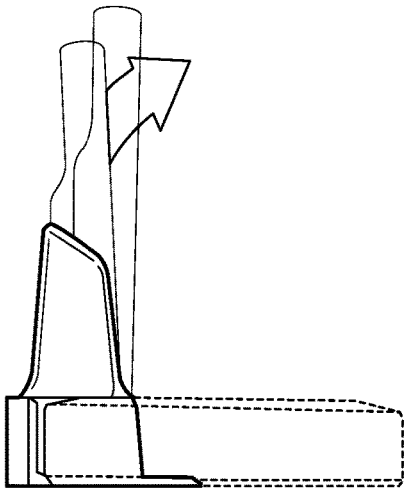
Figure 18C:
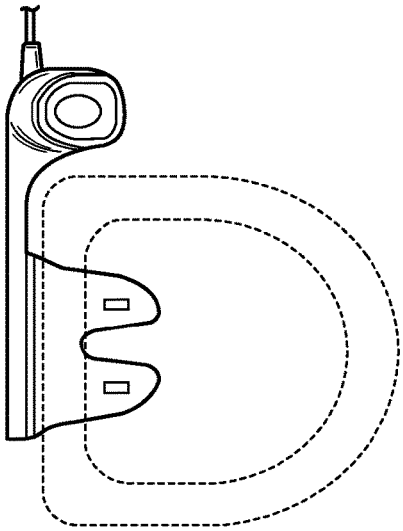
Figure 19A:
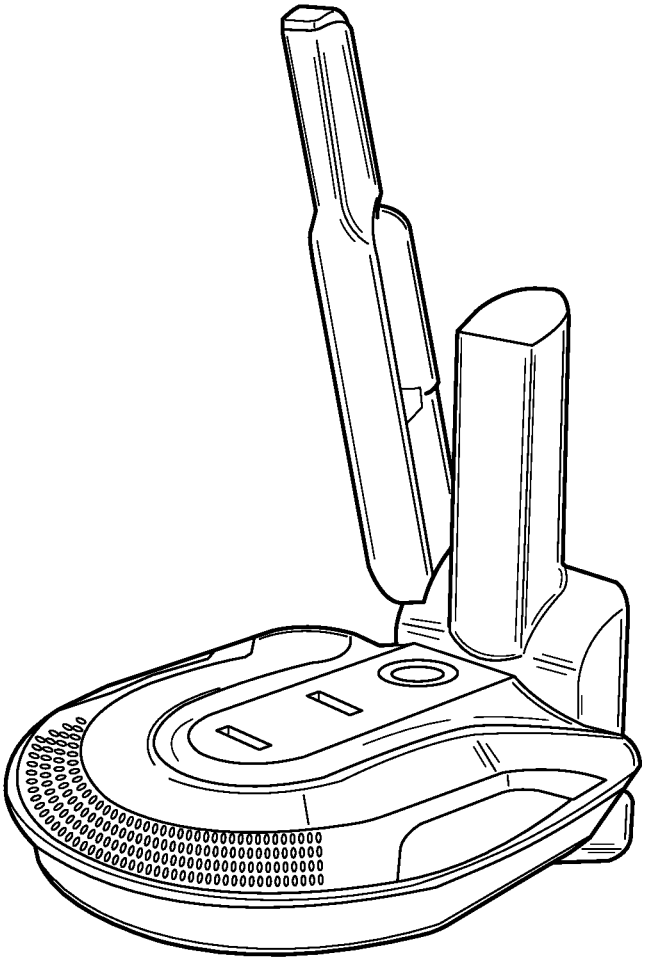
FIGS. 19A-19B show another example of a hand-held surface cleaning device coupled to a dock, consistent with embodiments of the present disclosure.
Figure 19B:
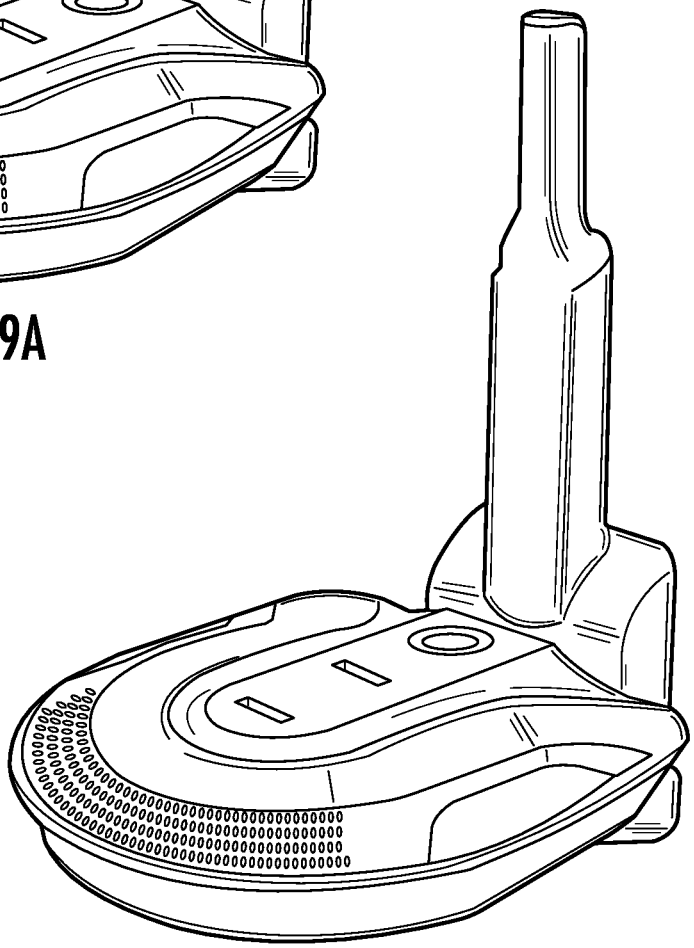
Figure 20A:
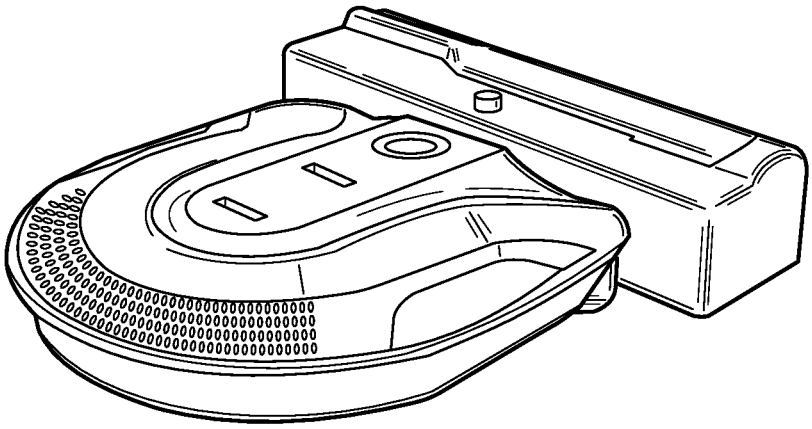
FIGS. 20A-20B show another example of a hand-held surface cleaning device coupled to a dock, consistent with embodiments of the present disclosure.
Figure 20B:
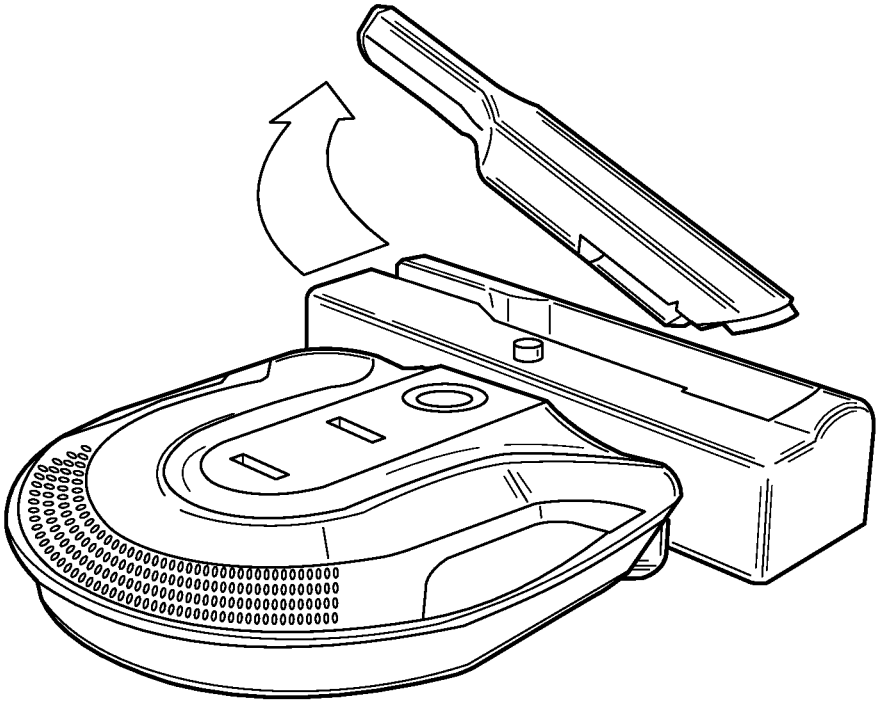

FIG. 17 shows another embodiment of a docking system 4400*f* consistent with aspects of the present disclosure. As shown, the embodiment of FIG. 51 is similar to that of the docking system 4400*e* of FIG. 50 and for this reason the description of which will not be repeated for brevity. As shown, the dock 4401*f* includes a wand coupling section 4405*c* that includes a wand receptacle 4407*e* in a side-by-side configuration with the robotic coupling section 4420*c*. The wand coupling section 4405*c* further includes an IR sensor 5102 (or other suitable proximity sensor). In response to a user breaching the IR beam emitted by the IR sensor 5102, a signal may be sent to the wand receptacle 4407*e*. A lift and tilt mechanism (not shown) may then receive the signal and transition the hand-held surface cleaning device 4402 from a storage position 5105 to a release position 5106. As shown, transition to the release position 5106 causes the hand-held vacuum device 4402 to first travel along a vertical path relative to an upper surface of the robotic vacuum (e.g., away from the robotic vacuum) followed by "tilting" of the hand-held vacuum device 4402 towards the robotic vacuum, e.g., at about a 70±15 degree angle relative to the robotic vacuum. On the other hand, transition to the storage position 5105 causes the reverse of the transition to the release position 5106, e.g., tilt back to a vertical orientation followed by downward travel towards the robotic vacuum device.

In the event a user is not detected, e.g., the user walks away from the dock 4401*f*, the lift and tilt mechanism may then automatically transition the hand-held surface cleaning device back to the storage position 5105. This may advantageously allow a user to insert the hand-held surface cleaning device 4402 into the wand receptacle 4407*e* and simply walk away while the wand receptacle 4407*e* transitions back to the storage position 5105.

The following additional embodiments and examples are equally applicable to the preceding disclosure. For example, the hand-held surface cleaning device 1 of FIG. 21 may be utilized in the various embodiments disclosed above including, for instance, the base (see FIGS. 10-20*b*) that may be utilized to both to couple to robotic cleaning devices and hand-held cleaning device.

Figure 21:
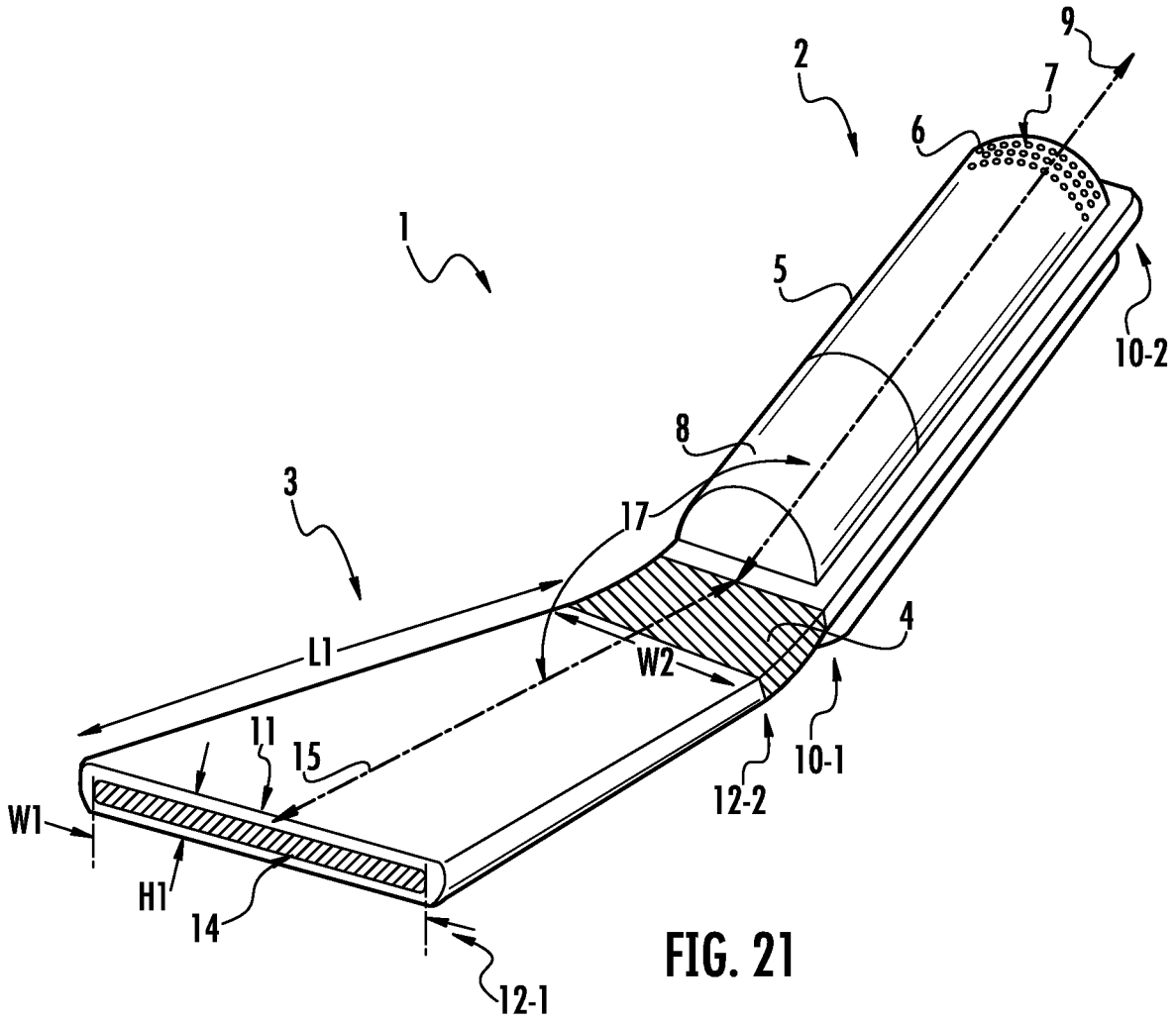
FIG. 21 shows a perspective view of a hand-held surface cleaning device in accordance with an embodiment of the present disclosure.

FIG. 21 illustrates a perspective view of hand-held surface cleaning device 1 in accordance with an embodiment of the present disclosure. As shown, the hand-held surface cleaning device 1 includes a body 2 coupled to a cleaning head 3. An optional flexible region 4, which may also be referred to as a flexible conduit, may couple the body 2 to the cleaning head 3, and allow for rotation of the cleaning head 3 relative to the body 2 during cleaning operation. A dirty air passageway 14 may extend from a dirty air inlet 11 provided by the cleaning head 3 through the cleaning head 3 and the body 2 to a dust cup 23 (see FIGS. 22A and 22B) disposed adjacent a distal end of the body relative to the cleaning head 3. Thus, the body 2 and the cleaning head 3 may be in fluid communication to receive dirt and debris via the dirty air passageway.

The body 2 extends from a first end 10-1 to a second end 10-2 along a first longitudinal axis 9. The body 2 may have a substantially cylindrical shape, such as shown, although other shapes (e.g., rectangular, square, irregular, and so on) and configurations are within the scope of this disclosure. The body 2 may be formed from a plastic or other suitably rigid material. The body 2 may comprise multiple pieces, or may be formed from a single piece. As shown, the body 2 includes removable pieces to separate the dust cup portion 6 from the power and motor portion 8.

The body 2 may be defined by a surface 5, which may also be referred to as a handgrip surface 5. The body 2 and may contoured to fit comfortably within a user's hand during use. Thus, the handgrip surface 5 may extend at least partially around the power and motor portion 8 and the dust cup portion 6.

The body 2 may include a power and motor portion 8 disposed proximal the first end 10-1 followed by a dust cup portion 6. As discussed in greater detail below, components within the power and motor portion 8 (e.g., one or more motors and one or more power sources such as batteries) may be disposed coaxially with the dust cup portion 6 of the body 2. As the power and motor portion 8 are disposed in front (e.g., up-stream) of the dust cup portion 6, components of the power and motor portion 8 may collectively define a cavity that extends therethrough to allow dirty air traveling along the dirty air passageway 14 to reach the dust cup portion 6 for storage purposes.

The body 2 may include a plurality of vents 7 disposed proximal to the second end 10-2 to allow for filtered/clean air to exit the body 2. The plurality of vents 7 may be disposed proximal the second end 10-2 to ensure that a user's hand does not inadvertently cover the plurality of vents 7 during operation. Other locations for the plurality of vents 7 is within the scope of this disclosure and the example illustrated in FIG. 21 should not be construed as limiting.

Continuing with FIG. 21, the cleaning head 3 may extend from a first end 12-1 to a second end 12-2 along a second longitudinal axis 15. The cleaning head 3 may be formed from the same material as the body 2, or may comprise a different material. In some cases, the cleaning head 3 is formed from a bendable material, e.g., a material that may bend/unbend based on a user-supplied force. In other cases, the cleaning head 3 is formed from a relatively rigid material that resists bending. In still other cases, the cleaning head 3 is formed from multiple materials. For instance, the first end 12-1 adjacent the dirty air inlet 11 may be formed from a relatively rigid material and the second end 12-2 may be formed from a relatively rigid material.

In some cases, the first longitudinal axis 9 of the body 2 may be substantially parallel relative to the second longitudinal axis 15, e.g., for storage purposes, docking purposes, or when a user desires the cleaning head 3 to extend straight from the body 2. In other cases, such as shown, the second longitudinal axis 15 of the cleaning head 3 may extend at an angle 17 relative to the first longitudinal axis 9, with angle 17 being between 1 degrees and 180 degrees, and preferably, 30 to 90 degrees.

As further shown, a dirty air inlet 11 is disposed at the first end 12-1. The dirty air inlet 11 may define an opening having a width W1 and a height HE The ratio of W1 to H1 may measure about 2:1, 3:1, 4:1, 10:1, 15:1 including all ranges therebetween, for example. The ratio of the overall length L1 relative to the width W1 may measure about 1:1, 1.25:1, 1.5:1, 2:1, including all ranges therebetween. Other ratios are within the scope of this disclosure and the provided examples are not intended to be limiting. The width W1 of the dirty air inlet 11 may be greater than the width W2 of the cleaning head 3 proximal to the second end 12-2. Thus, the cleaning head 3 may taper inwards from the first end 12-1 to the second end 12-2. However, the cleaning head 3 may not necessarily taper, as shown, and may include a substantially continuous width along longitudinal axis 15.

The hand-held surface cleaning apparatus may further optionally include a flexible region 4 (or flexible conduit) disposed between the body 2 and the cleaning head 3. In particular, a first end of the flexible region 4 may couple to the second end 12-2 of the cleaning head 3. A second end of the flexible region 4 opposite of the first end may couple to the first end 10-1 of the body 2. The flexible region 4 may include a cavity that defines at least a portion of the dirty air passageway 14.

The flexible region 4 may be formed from a plastic or other bendable material that allows for bending based on a user-supplied force. The flexible region 4 may be configured to return to a particular resting state in the absence of a user-supplied force. For instance, the flexible region 4 may return to an unbent state that causes the first and second longitudinal axis 9 and 15 of the body 2 and cleaning head 3, respectively, to extend substantially in parallel. In other cases, the flexible region 4 may be configured to remain in a bent position, e.g., via a clips or other mechanical retaining features, until a user supplies a force to transition the cleaning head to a different position relative to the body 2.

In any event, the flexible region 4 allows the cleaning head 3 to rotate relative to the body 2. In some cases, the flexible region 4 may allow for an angle 17 that measures between 0 degrees and 180 degrees, as discussed above. Preferably, the flexible region 4 allows for up to 90 degrees of rotation.

In some cases, rotation of cleaning head 3 relative to the body 2 may cause the hand-held surface cleaning apparatus to switch ON. For instance, when a users desires to clean a particular surface, the user may automatically switch on the hand-held surface cleaning apparatus 1 simply by supplying a force that causes the cleaning head 3 to engage a surface and cause bending of the flexible region 4. In response to the bending of flexible region 4, the hand-held surface cleaning apparatus 1 may supply power to a motor to introduce suction along the dirty air passageway 14. Likewise, the absence of the user-supplied force may cause the hand-held surface cleaning apparatus 1 to switch OFF.

Alternatively, or in addition to the automatic-on features discussed above, the body 2 may include a button or other suitable control (not shown) to allow for manual switching of the hand-held surface apparatus 1 ON/OFF.

Note that the flexible region 4 is optional. For instance, the body 2 may simply couple directly to the cleaning head 3. Alternatively, the flexible region 4 may be replaced with a rigid portion (or rigid conduit) that does not bend based on a user-supplied force.

In any such cases, the body 2 and/or the cleaning head 3 may be removably coupled to the flexible region 4. A user may therefore remove the body 2 and/or cleaning head 3 from the flexible region 4 to, for example, unclog the dirty air passageway 14 or to attach a different type of cleaning head 3 such as a cleaning head configured with bristles.

Figure 22A:
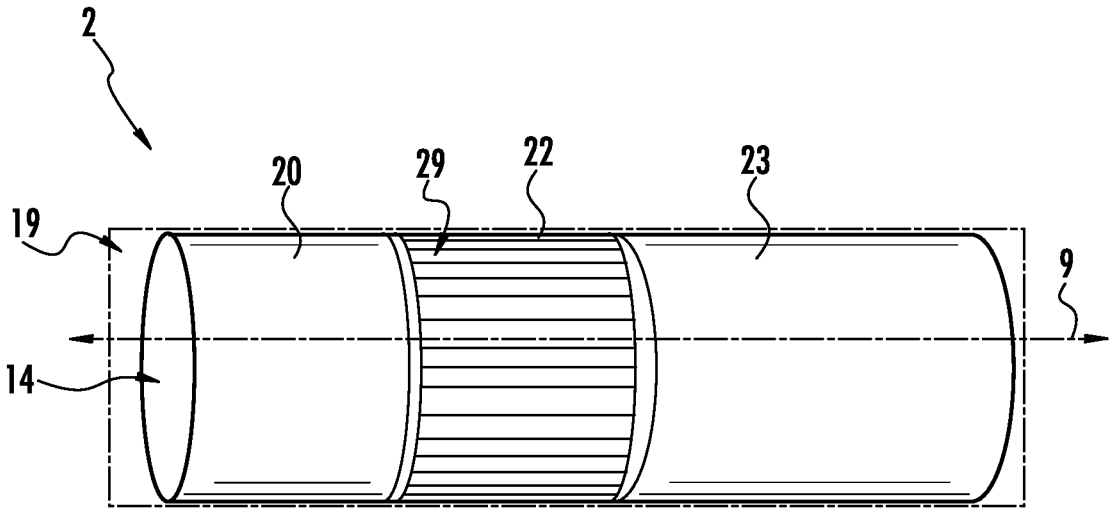
FIG. 22A shows a perspective view of a body portion of the hand-held surface cleaning device of FIG. 21 in isolation, in accordance with an embodiment of the present disclosure.

Turning to FIG. 22A, the body 2 is shown isolated from the cleaning head 3 and flexible region 4, in accordance with an embodiment of the present disclosure. The body 2 is shown in a highly-simplified form and other components may be disposed within the body 2. As shown, the body defines a cavity 19. The body 2 further includes a motor 20, a power source 22 and a dust cup 23 disposed within the cavity 19. Each of the motor 20, the power source 22 and the dust cup 23 may include a longitudinal axis that is substantially parallel with the longitudinal axis 9. Thus, the motor 20, power source 22 and dust cup 23 may be disposed coaxially within the cavity 19. As discussed below, this coaxial arrangement allows the motor 20, the power source 22, and the dust-cup 23 to have their respective cavities align to collectively form a single dirty-air passageway, e.g., dirty-air passageway 14. Note, the coaxial arrangement may form a plurality of dirty-air passageways depending on a desired configuration, and this disclosure should not be construed as limited to a single passageway.

The motor 20 may comprise, for example, a brushless DC motor, although other types of motors are within the scope of this disclosure. The motor 20 may electrically couple to the power source 22 and/or AC mains via a charging circuit, as discussed further below. The motor 20 may include a cavity 52 (see FIG. 23C) to allow the dirty air passageway 14 to extend therethrough. The motor 20 may include an impeller/fan 50 that introduces air flow/suction towards the dust cup 23.

Figure 23A:
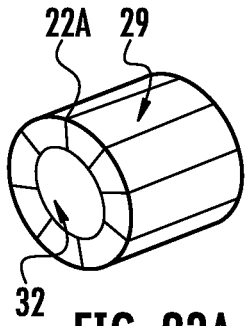
FIG. 23A shows an example power source suitable for use in the hand-held surface cleaning device of FIG. 21 in accordance with an embodiment of the present disclosure.
Figure 23B:
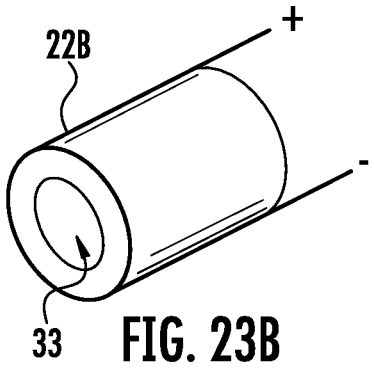
FIG. 23B shows another example power source suitable for use in the hand-hand surface cleaning device of FIG. 21 in accordance with an embodiment of the present disclosure.
Figure 23C:
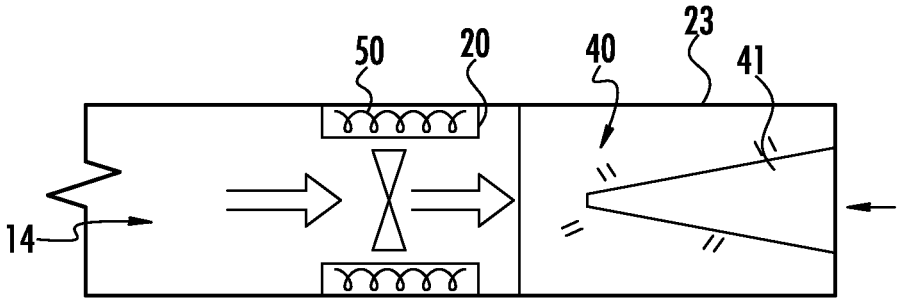
FIG. 23C shows a cross-sectional view of the hand-held surface cleaning device of FIG. 21 in accordance with an embodiment of the present disclosure.

FIGS. 23C and 23B show the motor 20 in further detail in accordance with an embodiment of the present disclosure. As shown, the motor 20 may include a built in fan 50 that is disposed in the cavity 52. The motor 20 my further optionally include openings/vents 51 along sidewall 53 to regulate air flow.

Returning to FIG. 22A, the power source 22 may comprise a plurality of battery cells 29. In an embodiment, each of the battery cells is a lithium-ion battery cell, although other types of battery cells are within the scope of this disclosure. As shown in the power source 22A of FIG. 23A, each of the plurality of battery cells 29 may form an annular arrangement. The annular arrangement may include a cavity 32 extending therethrough. In the annular arrangement, each of the battery cells may have a respective longitudinal axis that is substantially in parallel with the longitudinal axis 9 of the body 2 when the power source 22A is disposed in the same. FIG. 23B shows another example power source 22B configured as a ring-shaped capacitor. The ring-shaped capacitor may also include cavity 33 extending therethrough. In any such cases, the power source 22 may at least partially define the dirty air passageway 14 based on an associated cavity. The cavity of the power source 22, e.g., cavity 32 or 33, may therefore align with the cavity 52 of the motor when the power source 22 and the cavity 52 are disposed within the cavity 19 of the body 2.

Returning to FIG. 22A, the power source 22 may be charged via an associated charging circuit (not shown). The charging circuit may include, for example, an inductive coil to receive a charge for purposes of charging the power source 22. Alternatively, or in addition, the charging circuit may include terminals or other suitable interconnects (e.g., a USB-C port) to couple to a base/docking station for charging purposes, for example. The charging circuit may also allow for power from mains to be used directly by the hand-held surface cleaning device 1 while also charging the power source 22.

Figure 22B:
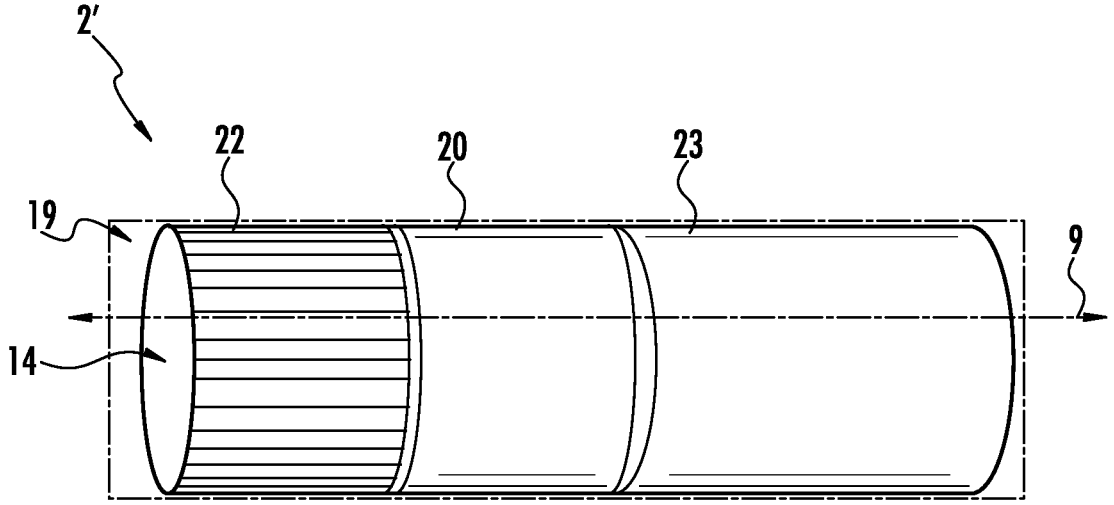
FIG. 22B shows another perspective view of a body portion of the hand-held surface cleaning device of FIG. 21 in isolation, in accordance with an embodiment of the present disclosure.

FIG. 22B shows a body 2' in a substantially similar configuration to that of the body 2 of FIG. 22A, and for this reason the foregoing description is equally applicable to the body 2' and will not be repeated for brevity. However, the body 2' includes the power source 22 disposed prior to the motor 20. Thus, the body 2' includes the power source 22 disposed proximal to the first end 10-1 of the body 2 followed by the motor 20 and then the dust cup 23.

The body 2 and 2' of FIGS. 22A and 22B, respectively, may include multiple power sources 22 and/or multiple motors 20 disposed and aligned within the cavity 19 to form dirty air passageway 14. Therefore, while the above examples illustrate a single motor and power source, this disclosure is not limited in this regard. Likewise, although each motor, power source and dust cup are shown have a substantially cylindrical shape, this disclosure is not limited in this regard. Other shapes and configurations are within the scope of this disclosure.

Figure 23D:
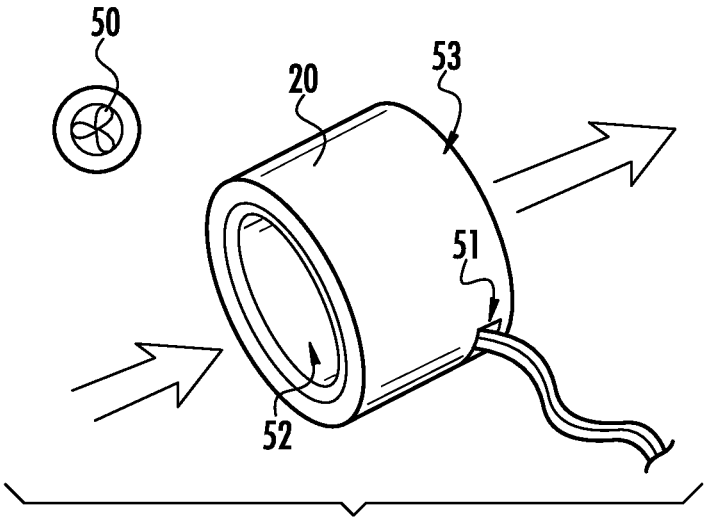
FIG. 23D shows an example motor suitable for use in the hand-held surface cleaning device of FIG. 21 in accordance with an embodiment of the present disclosure.

Turning to FIGS. 23C-23D, the dust cup 23 may be configured to receive and store dust and debris received from the dirty air passageway 14. The dust cup may define a cavity 40 to store the dust and debris. The dust cup may further include a statically-charged accumulator 41 to help attract and trap dust and debris. In some cases, the statically-charged accumulator 41 is formed from a material that naturally tends to hold a static charge. Alternatively, or in addition, the statically-charged accumulator 41 may be energized via, for example, the power source 22.

Figure 24A:
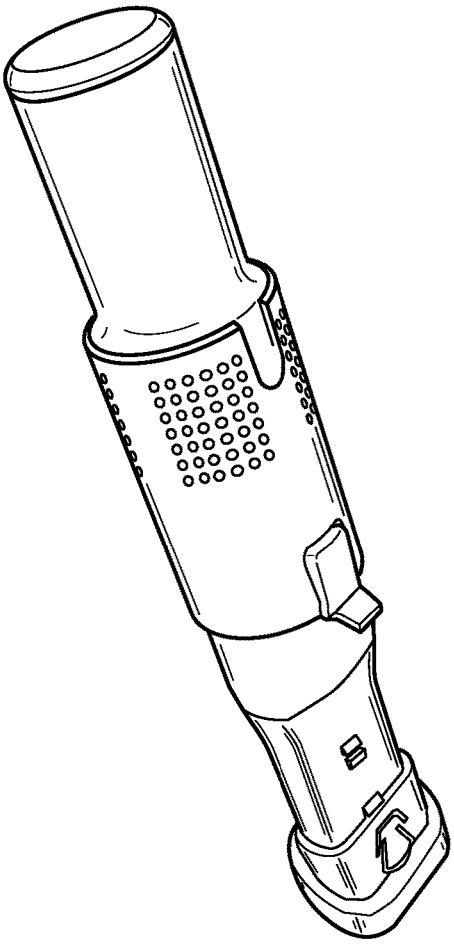
FIGS. 24A-24C show additional example embodiments consistent with the present disclosure.
Figure 24B:
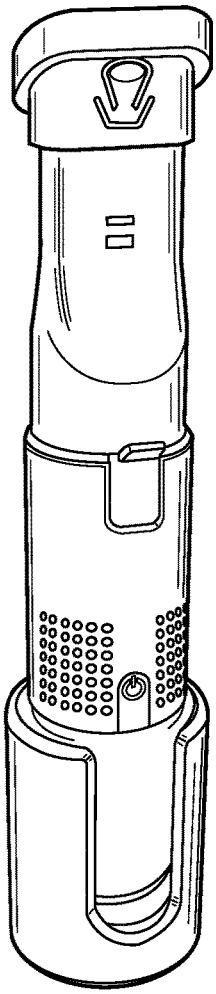
Figure 24C:
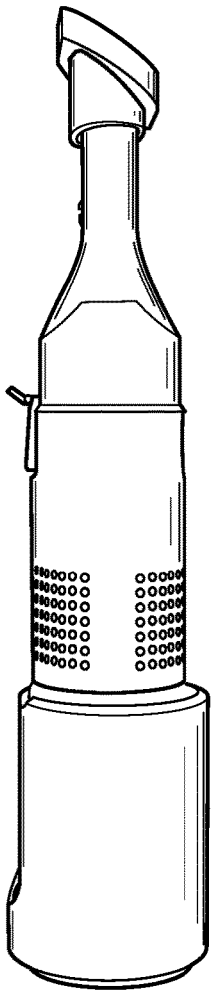

FIGS. 24A-24C show additional example embodiments consistent with the present disclosure. As shown in FIG. 24B, the hand-held surface cleaning device may be docked into a base for recharging purposes.

Figure 25:
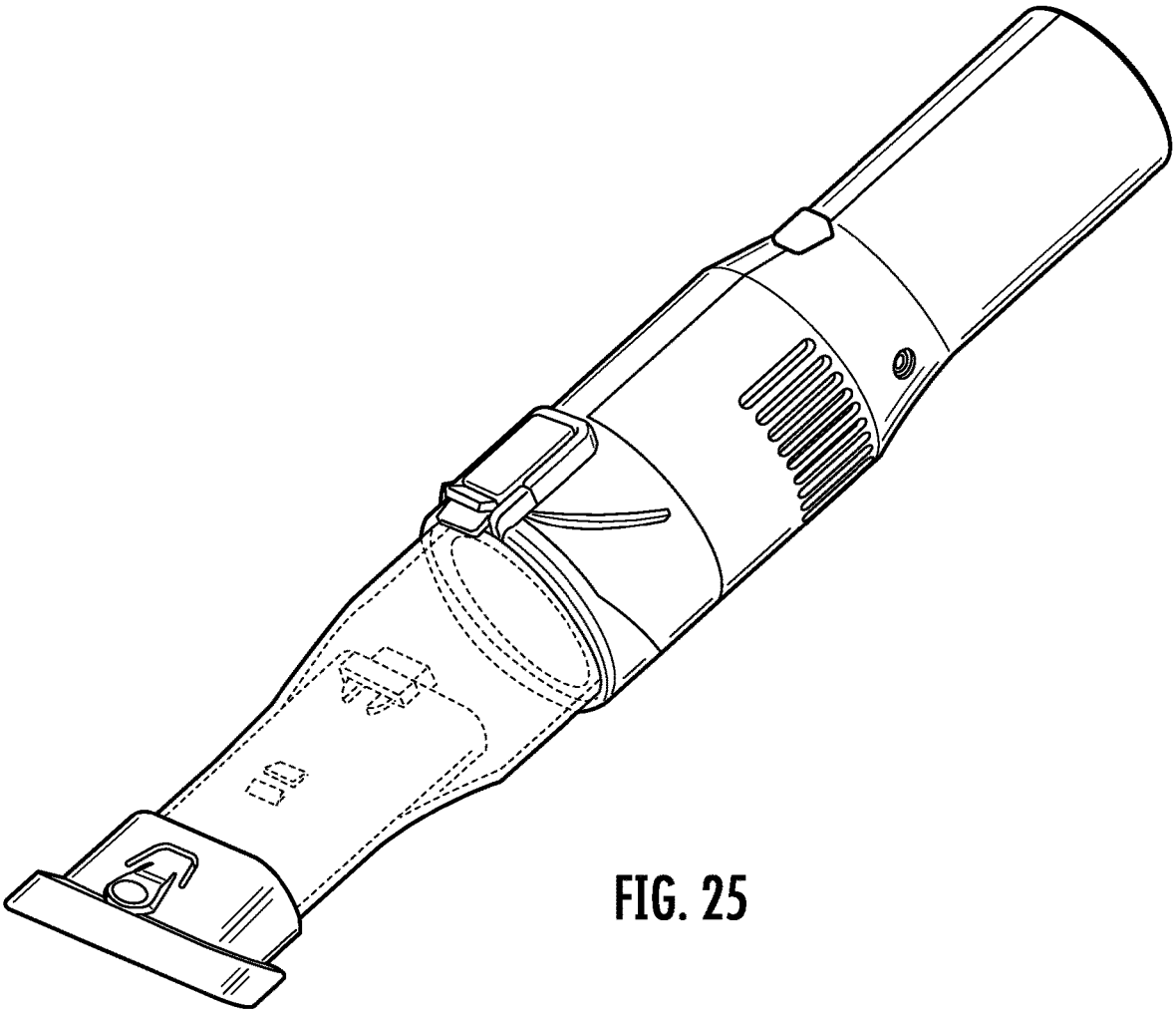
FIG. 25 shows an example hand-held surface cleaning device consistent with the present disclosure.
Figure 26A:
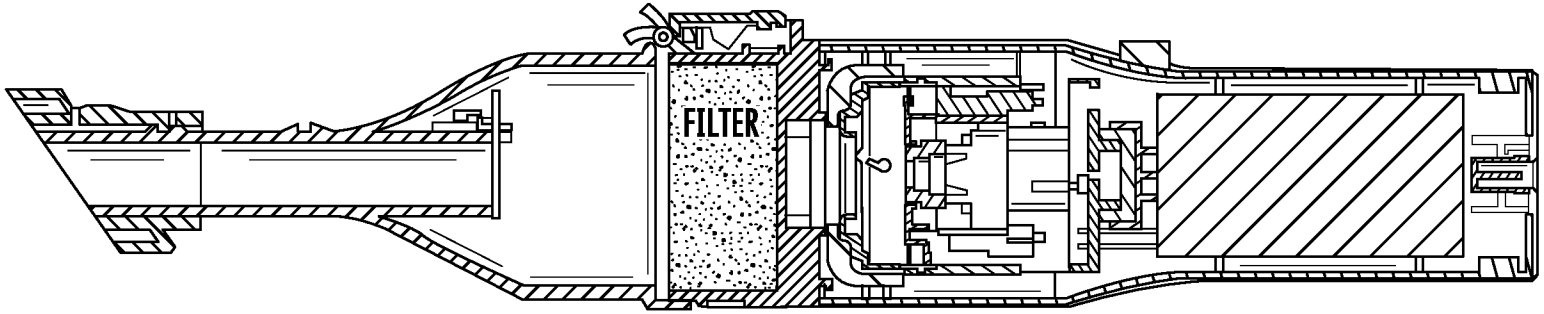
FIG. 26A shows a cross-sectional view of the hand-held surface cleaning device of FIG. 25 in accordance with an embodiment of the present disclosure.
Figure 26C:
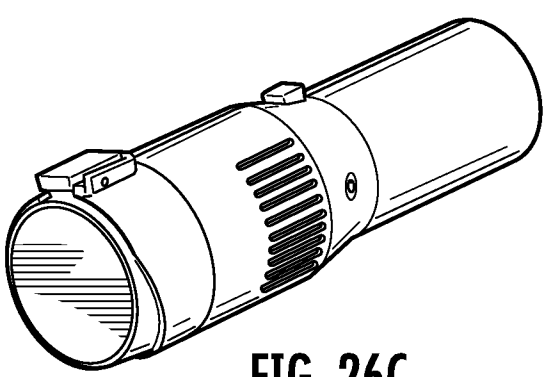
FIG. 26C shows an example handle of the hand-held surface cleaning device of FIG. 25 in isolation, in accordance with an embodiment of the present disclosure.
Figure 26B:
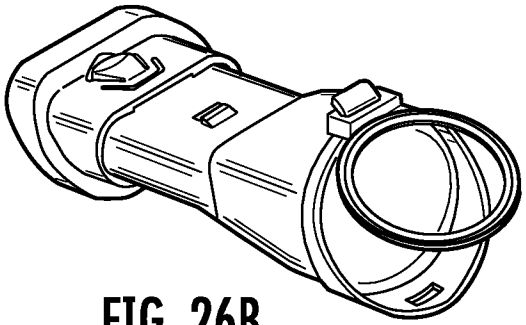
FIG. 26B shows an example cleaning head of the hand-held surface cleaning device of FIG. 25 in isolation, in accordance with an embodiment of the present disclosure.

FIG. 25 shows an example hand-held surface cleaning device consistent with the present disclosure. FIG. 26A shows a cross-sectional view of the hand-held surface cleaning device of FIG. 25 in accordance with an embodiment of the present disclosure. FIG. 26B shows an example cleaning head of the hand-held surface cleaning device of FIG. 25 in isolation, in accordance with an embodiment of the present disclosure. FIG. 26C shows an example handle of the hand-held surface cleaning device of FIG. 25 in isolation, in accordance with an embodiment of the present disclosure.

Figure 27:
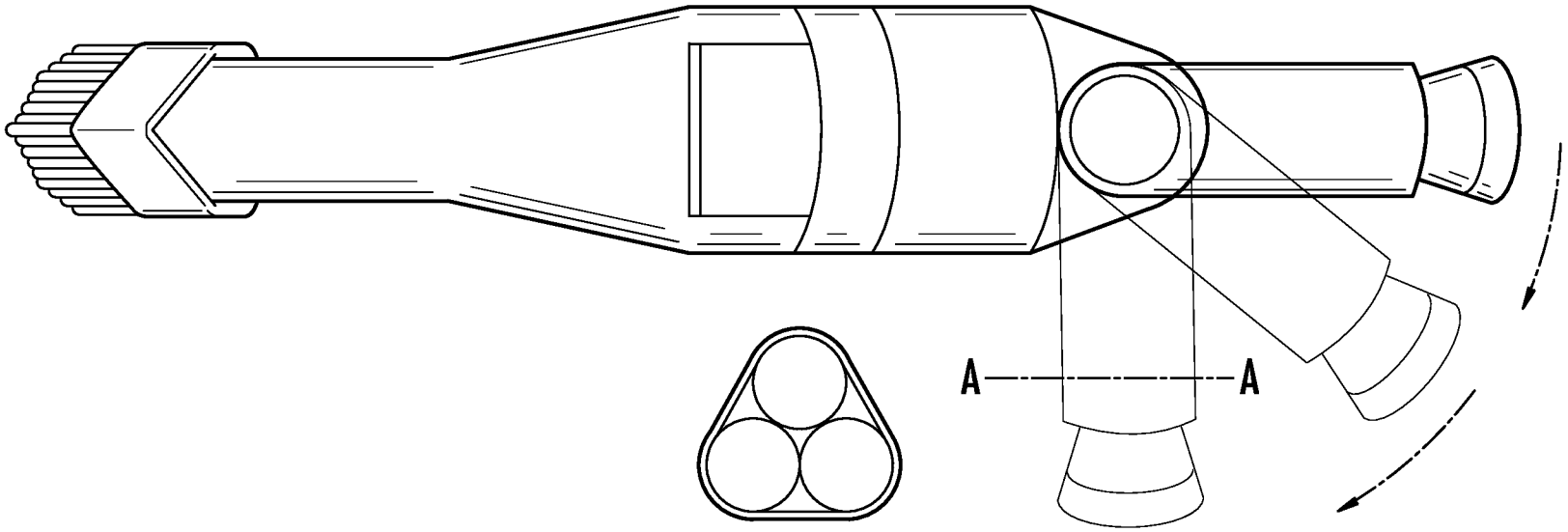
FIG. 27 shows another example hand-held surface cleaning device consistent with the present disclosure.

FIG. 27 shows another example hand-held surface cleaning device consistent with the present disclosure. As shown in FIG. 27, a handle portion may rotate relative to a body to transition/articulate to one or more positions. Batteries may be disposed in the handle portion, such as shown in the cross-section taken along A-A. This arrangement may allow the handle portion to have a relatively small form-factor throughout its length.

Figure 28A:
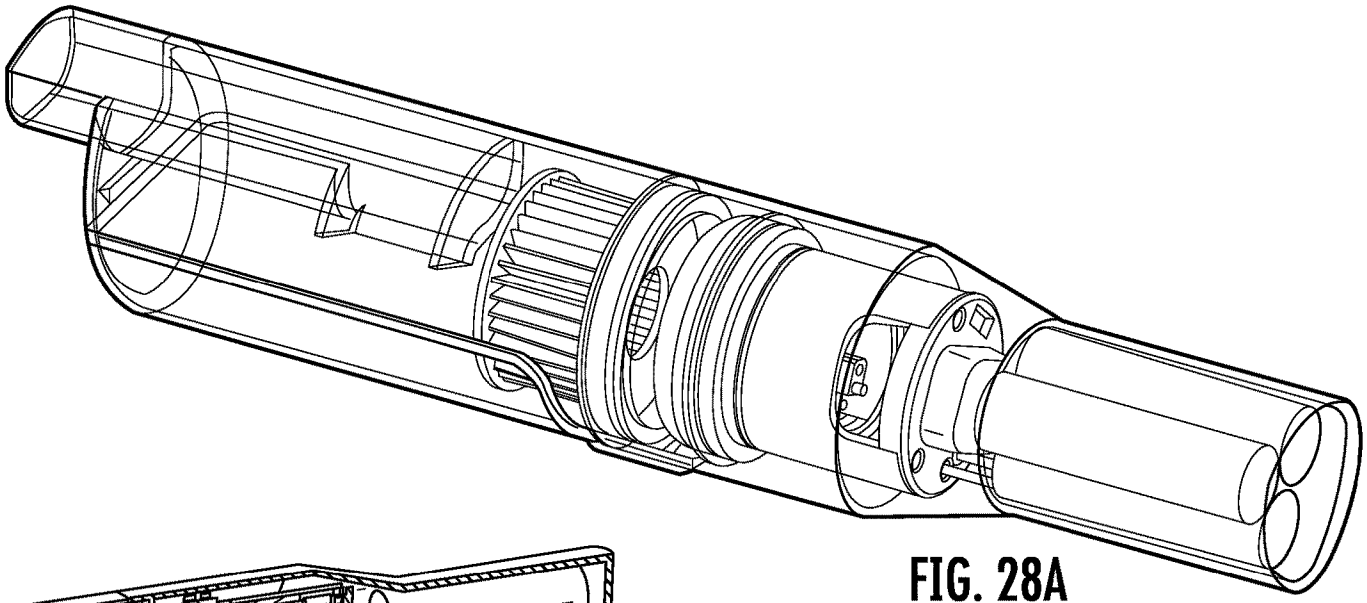
FIGS. 28A-28C show additional example embodiments of a surface cleaning device consistent with embodiments of the present disclosure.
Figure 28B:
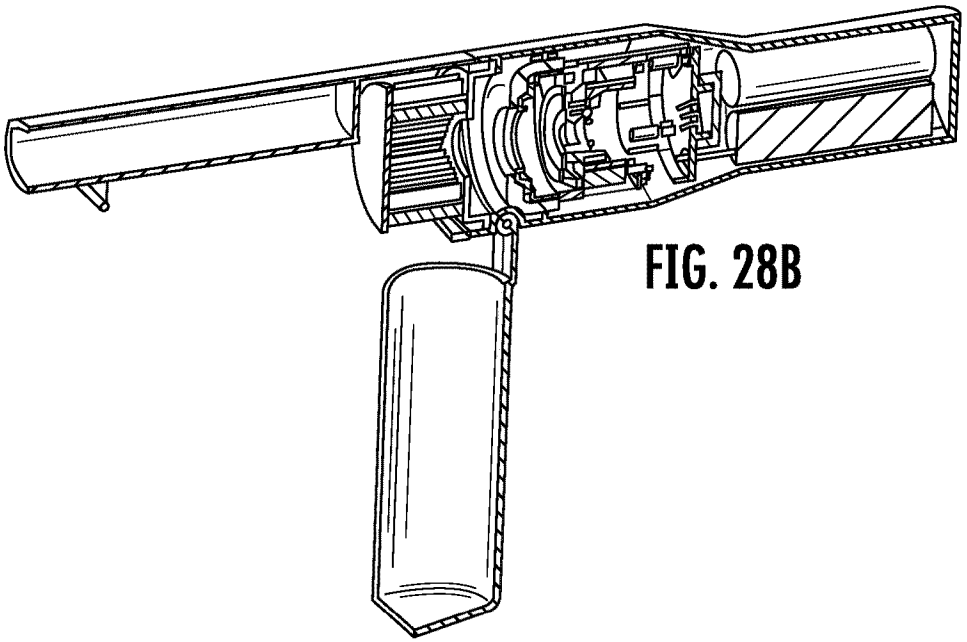
Figure 28C:
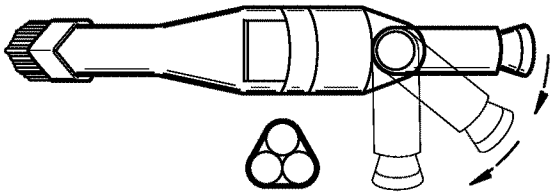
Figures 29A, 29B, 29C, 29D:
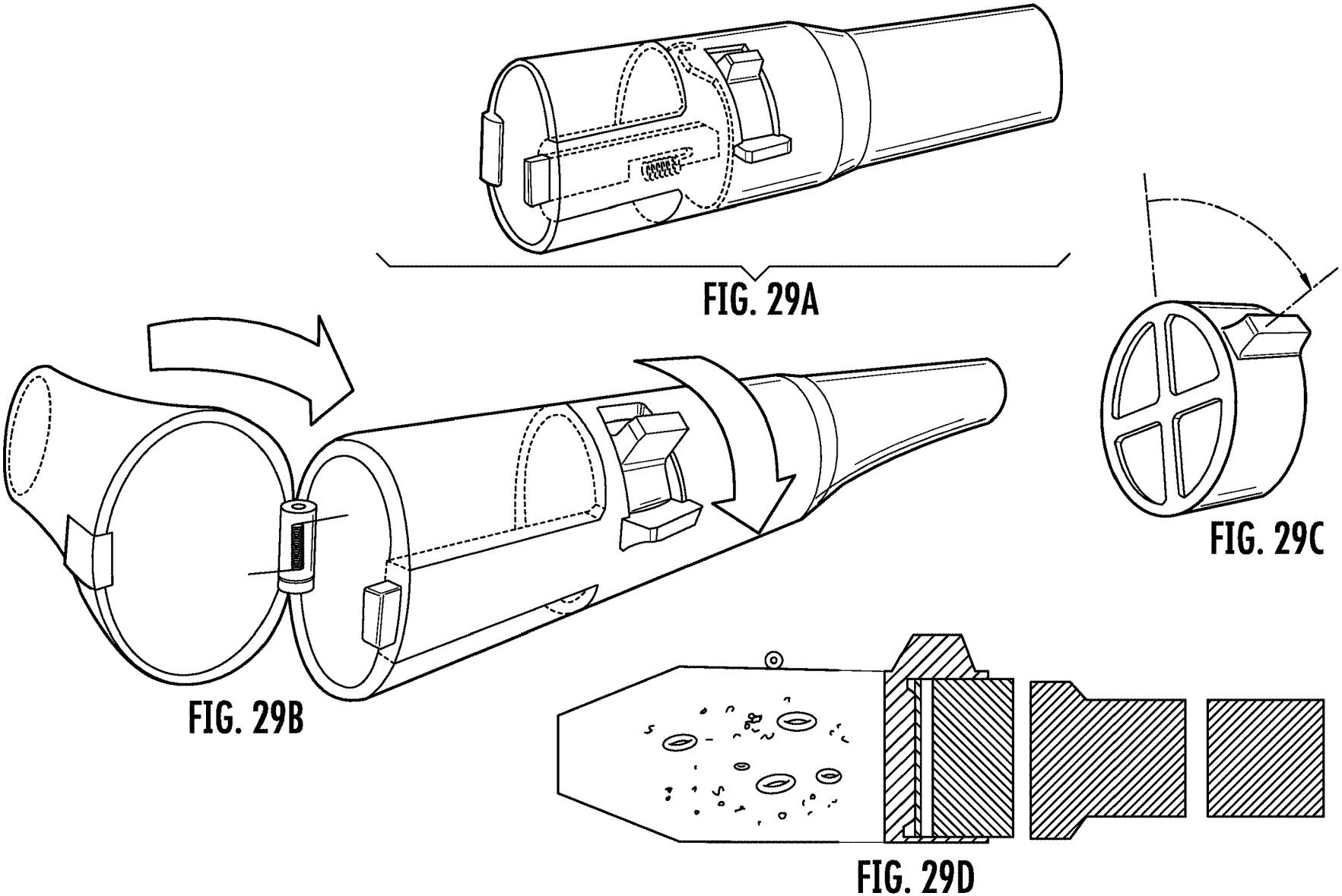
FIGS. 29A-29H show additional example embodiments of a surface cleaning device consistent with embodiments of the present disclosure.
Figures 29E, 29F, 29G, 29H:
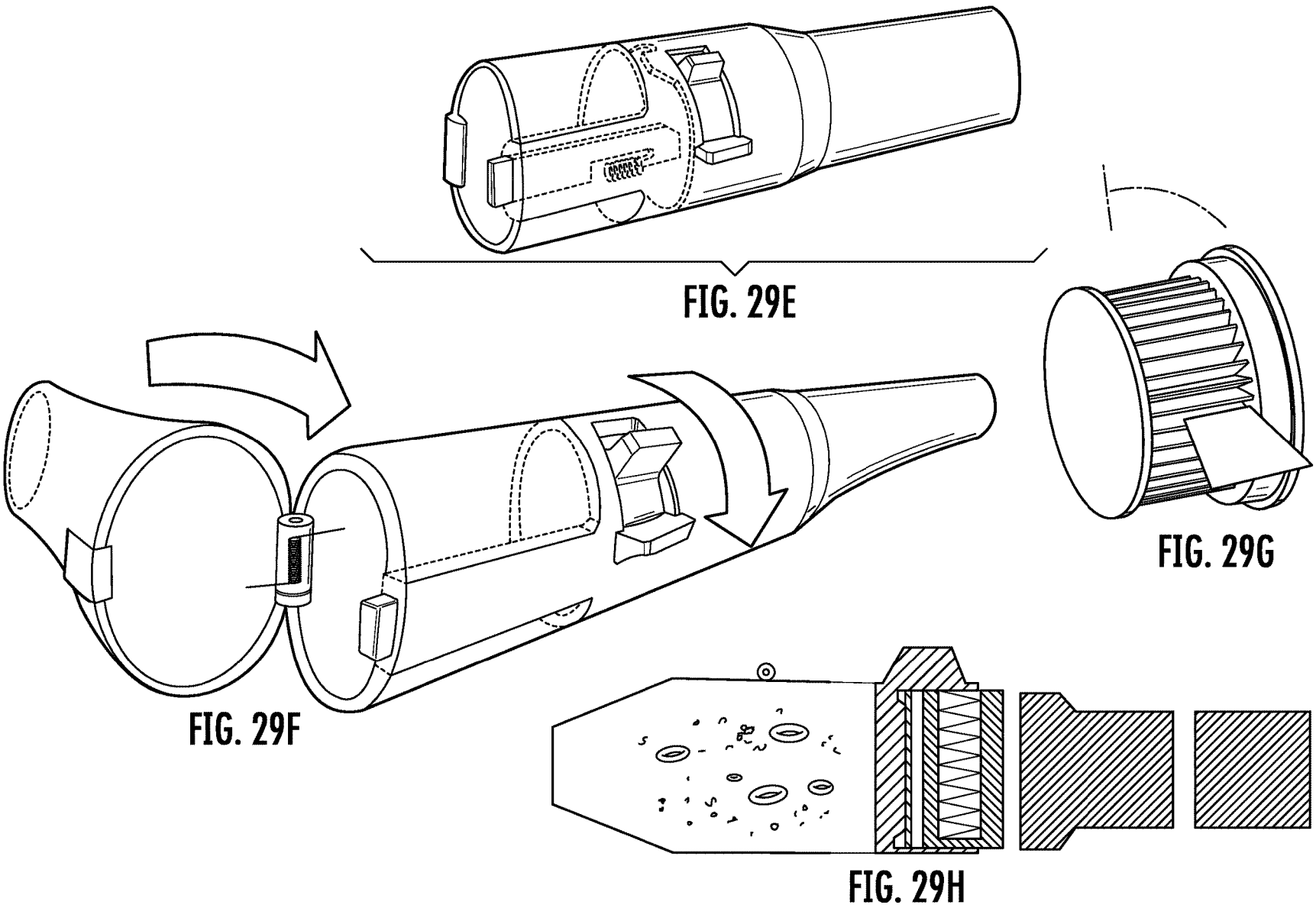

FIGS. 28A-28C show additional example embodiments of a surface cleaning device consistent with embodiments of the present disclosure.

FIGS. 29A-29H show additional example embodiments of a surface cleaning device consistent with embodiments of the present disclosure. As shown, a hand-held surface cleaning device consistent with the present disclosure may include an arrangement for wiping/dislodging dust during dust cup emptying procedures.

Figure 30A:
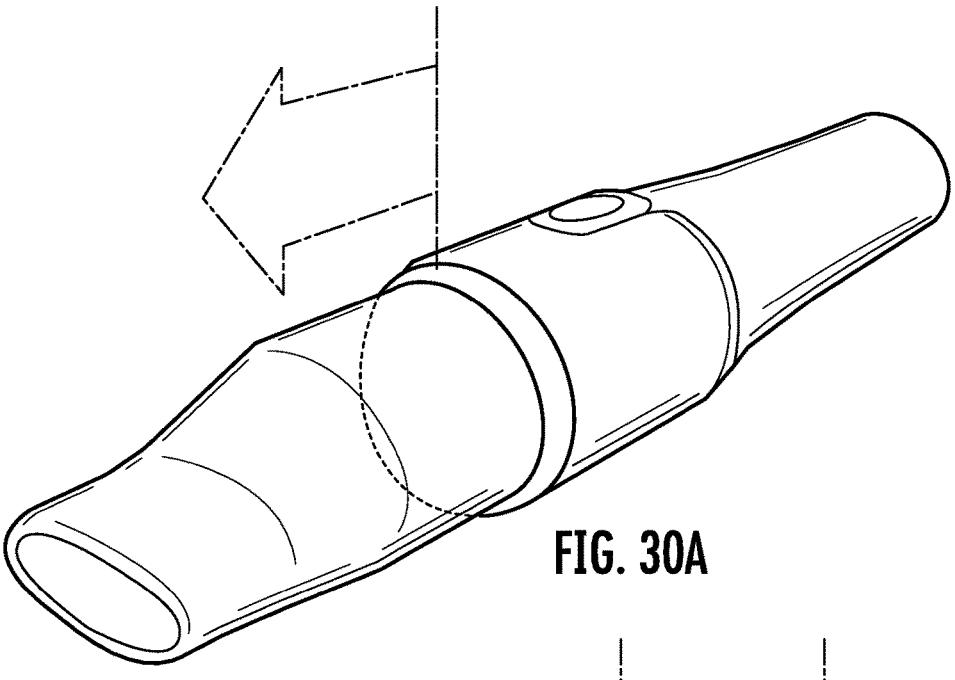
FIGS. 30A-30C show additional example embodiments of a surface cleaning device consistent with embodiments of the present disclosure.
Figure 30B:
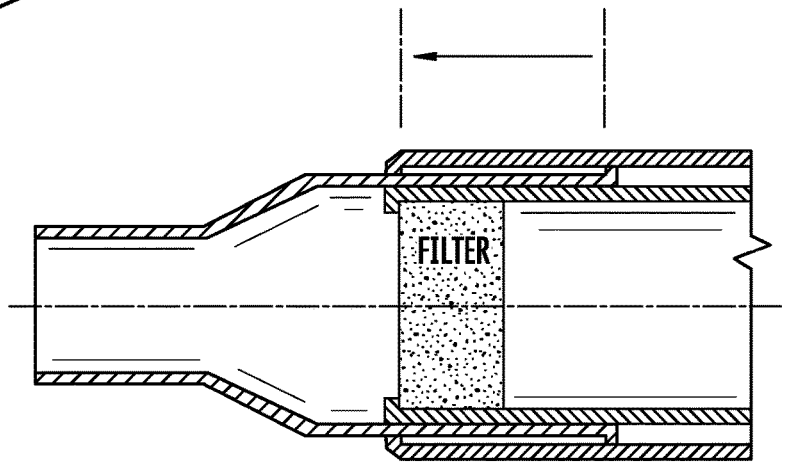
Figure 30C:
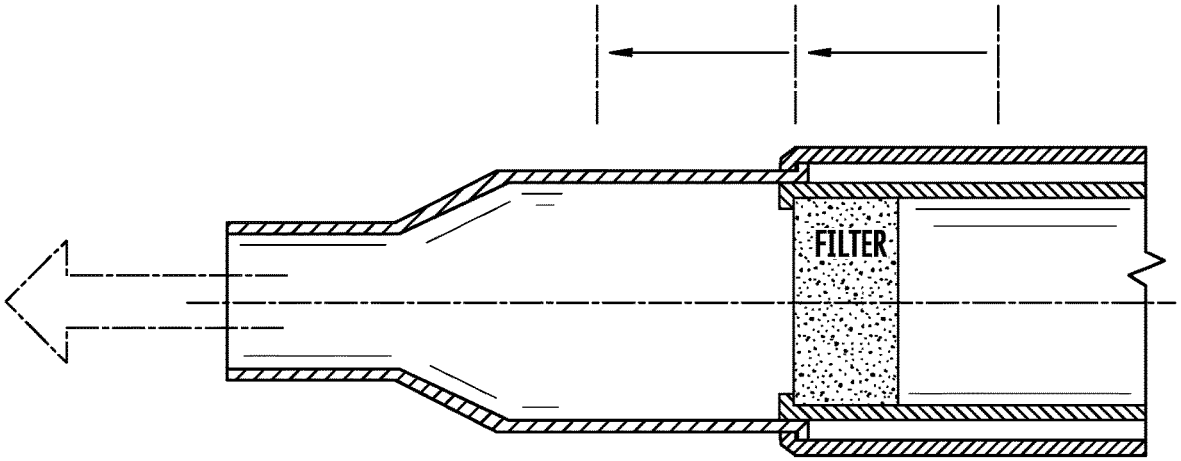

FIGS. 30A-30C show additional example embodiments of a surface cleaning device consistent with embodiments of the present disclosure. As shown, the dust cup may be extended to increase storage capacity.

Referring to FIGS. 31A to 31D an example surface cleaning device 1300 is shown consistent with embodiments of the present disclosure. As shown, the surface cleaning device 1300 includes a body 1301 and a dust cup 1302 coupled to a first end 1319 the body 1301. Note the aspects and embodiments shown and described above with reference to FIGS. 1-20B and FIGS. 21-30C are equally applicable to the surface cleaning device 1300 and will not be repeated for brevity.

Figure 31A:
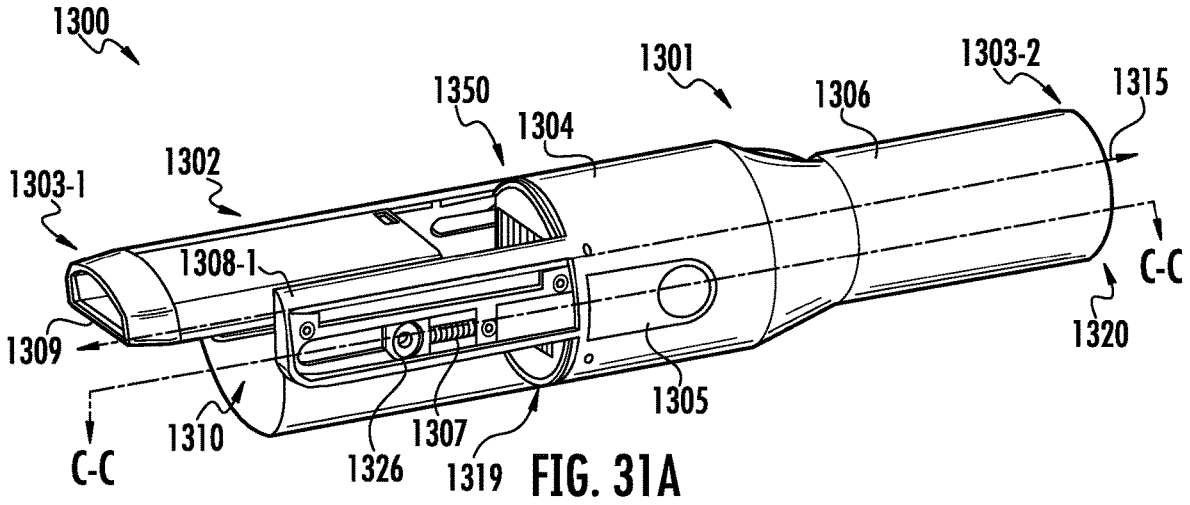
FIG. 31A shows an additional example of a surface cleaning device in a closed/docked position, in accordance with embodiments of the present disclosure.

As generally referred to herein, the terms "closed position" and "docked position" may be used interchangeably and refer to a position of the dust cup 1302 relative to the body 1301 whereby the dust cup 1302 is coupled to and in fluid communication with the body 1301, and more particularly, with a motor 1322 disposed within a cavity of the body 1301 that generates suction to draw dirt and debris into the dust cup 1302. In some cases, the closed position may result in the dust cup 1302 having a longitudinal axis that extends substantially in parallel with a longitudinal axis of the body 1301, such as shown in FIG. 31A.

Conversely, the term "open position" or "emptying position" may be used interchangeably and refer to a position of the dust cup 1302 relative to the body 1301 whereby the dust cup 1302 is angled substantially perpendicular relative to the body 1301 to allow for emptying of the dust cup. The dust cup 1302 may be rotably/pivotably coupled to the body 1301 to allow the dust cup 1302 to transition to the open position. This transition may be initiated by, for example, button(s) 1305 disposed on the body 1301, which will be discussed in greater detail below. Thus, when in the open position, the dust cup may be fluidly decoupled from the motor 1322 while remaining pivotably/rotatably coupled to the housing.

As discussed in greater detail below, the dust cup 1302 may be spring-loaded to cause the same to "spring"/launch into the open position. The body 1301 may provide a stop, e.g., a sidewall 1340 (FIG. 31B) or other surface feature, to engage the dust cup 1302 while the same is rotating due to the release of spring tension. Engagement with the stop may then cause the dust cup 1302 to abruptly stop rotational movement, with the impact advantageously dislodging dirt and debris stored within the dust cup 1302. Gravity may then be used to allow the dislodged dirt and debris to empty from an opening of the dust cup located at an opposite end from that of an inlet for receiving dirty air. The spring bias may then hold the dust cup 1302 in the open position until a user desires transitioning the dust cup 1302 back to the closed position. Thus, a user may simply angle the hand-held surface cleaning device 1300 over the mouth of a trash can and transition the dust cup 1302, e.g., via actuation of the button(s) 1305, to the open position to empty the dust cup 1302.

In addition, and in accordance with an embodiment, a filter arrangement 1314 may be at least partially disposed within the body 1301. The filter arrangement 1314 may also be spring-loaded and "spring" forward (see FIGS. 31B and 31D) to extend at least partially from the body 1301 and stop at a predetermined distance D1. In this embodiment, the filter arrangement 1314 may travel away from the body 1301 to distance D1 (after the dust cup 1302 rotates away from the filter arrangement 1314) before encountering a stop, e.g., a lap, catch or other protrusion, provided within or external to the body 1301, e.g., protrusion 1398 (see FIG. 31B). The spring bias may then hold the filter arrangement 1314 in the extended position until the dust cup 1302 displaces the filter arrangement 1314 when the same brought back into the closed position, e.g., based on a user-supplied force.

Thus, the surface cleaning device 1300 may be accurately described as having a multi-phase (or multi-stage) opening sequence based on a single user-supplied motion, wherein in response to the single user-supplied motion (e.g., a button press), the dust cup first snaps/springs/launches forward (longitudinally) and then rotates to a vertical/upright position, followed by the filter arrangement snapping/springing out either simultaneously as the dust cup transitions or shortly thereafter (e.g., based on the springs of the filter arrangement 1314 having a different spring constant/configuration than that of the springs associated with the dust cup 1302). Note, the dust cup 1302 may be weight to cause the up-right position (see FIG. 31B). Alternatively, or in addition, the dust cup 1302 may be brought into the up-right position based on a track provided by the body 1301 that causes the rotation to occur. Note, the dust cup 1302 may be configured with an agitating device, e.g., bristles, similar to that of dust cup 110 of FIG. 5, and the embodiments disclosed above are equally applicable to the hand-held surface cleaning device of FIGS. 31A-31D.

Continuing with the FIGS. 31A-31D a motor 1322 is disposed within the body 1301 and generates suction to draw dirty air into the inlet 1309 (or nozzle) via a dirty air passageway 1330 (see FIG. 31C) during use. The dust cup 1302, and more particularly, the dirty air passageway 1330 may be in fluid communication with the motor 1322 when the dust cup 1302 is in the closed position, such as shown in FIG. 13A. A filter 1311 disposed between the body 1301 and the dust cup 1302 may prevent/reduce dust and debris from entering the body 1301 and ultimately clogging the motor 1322. Dust and debris may then be stored in dust storage area 1331 (FIG. 31C) within the cavity of the dust cup 1302 during operation of the surface cleaning device 1300.

Figure 31B:
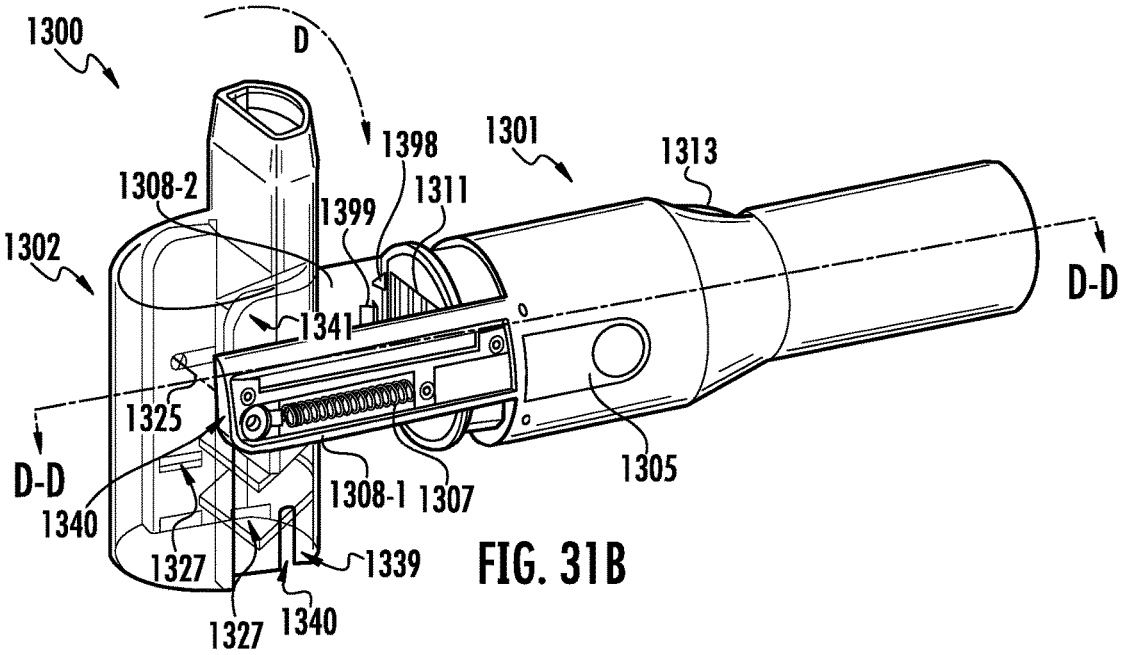
FIG. 31B shows an additional example of a surface cleaning device in an open position, in accordance with embodiments of the present disclosure.

In an embodiment, the dust cup 1302 may be decoupled from the suction of the motor 1322 when in the open position based on rotation of the dust cup 1302 relative to the body 1301. For example, as shown in FIG. 31B, an end of the dust cup 1302 may be decoupled from the body 1301 and rotated to angle the dust cup 1302 substantially transverse relative to the body 1301. As shown in FIG. 31D, the open position of the dust cup 1302 may result in the dust cup 1302 having a longitudinal axis 1316 that is substantially transverse relative to the longitudinal axis 1315 of the body. Note, the angle at which the dust cup 1302 extends relative to the body 1301 may vary, e.g., from 15 degrees to 180 degrees, and preferably 15 degrees to 90 degrees, depending on a desired configuration.

In an embodiment, the body 1301 may be formed from a plastic, metal, and/or any other suitably rigid material. The body 1301 may be formed from a single piece of material, or from multiple pieces.

The body 1301 may be defined by walls that extend along longitudinal axis 1315 from a first end 1319, which may be referred to as a dust coupling end 1319, to a second end 1320. The walls may be defined by a surface 1306, with the surface 1306 providing a handle portion, or handle, that may be comfortably gripped within the hand of a user during operation of the surface cleaning device 1300.

The body 1301 further includes button(s) 1305 for causing the dust cup 1302 to transition from a closed position, e.g., as shown in FIG. 31A, to an open position, e.g., as shown in FIG. 31B. Note, the button(s) 1305 are not necessarily limited to a mechanical button whereby a user depresses the same to cause the surface cleaning device 1300 to transition from the closed to open position. For example, the button 1305 may also be any other suitable user input device such as a slider button, a capacitive touch button, and a rotatable ring that extends around the diameter of the body 1301.

Figure 31C:
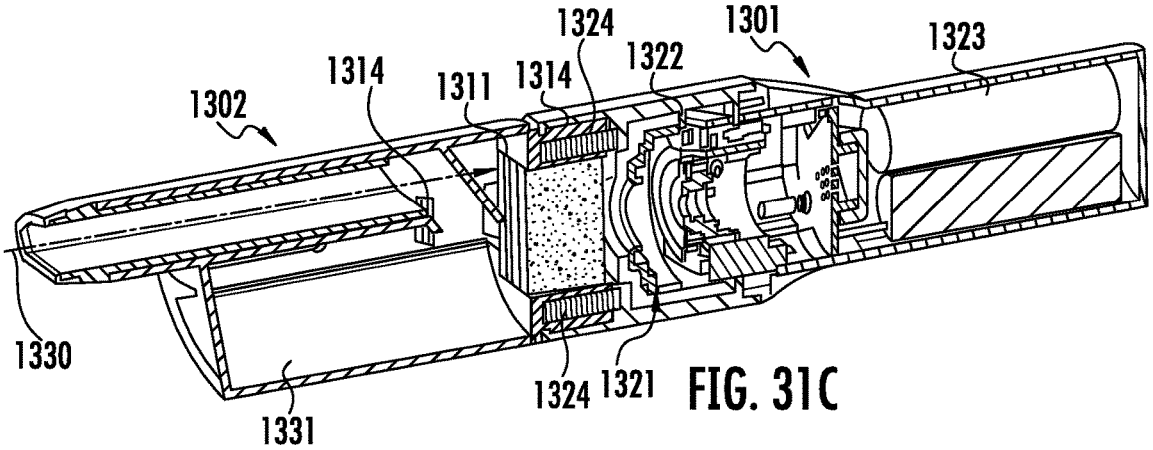
FIG. 31C shows a cross-sectional view of the surface cleaning device of FIG. 31A taken along line C-C.
Figure 31D:
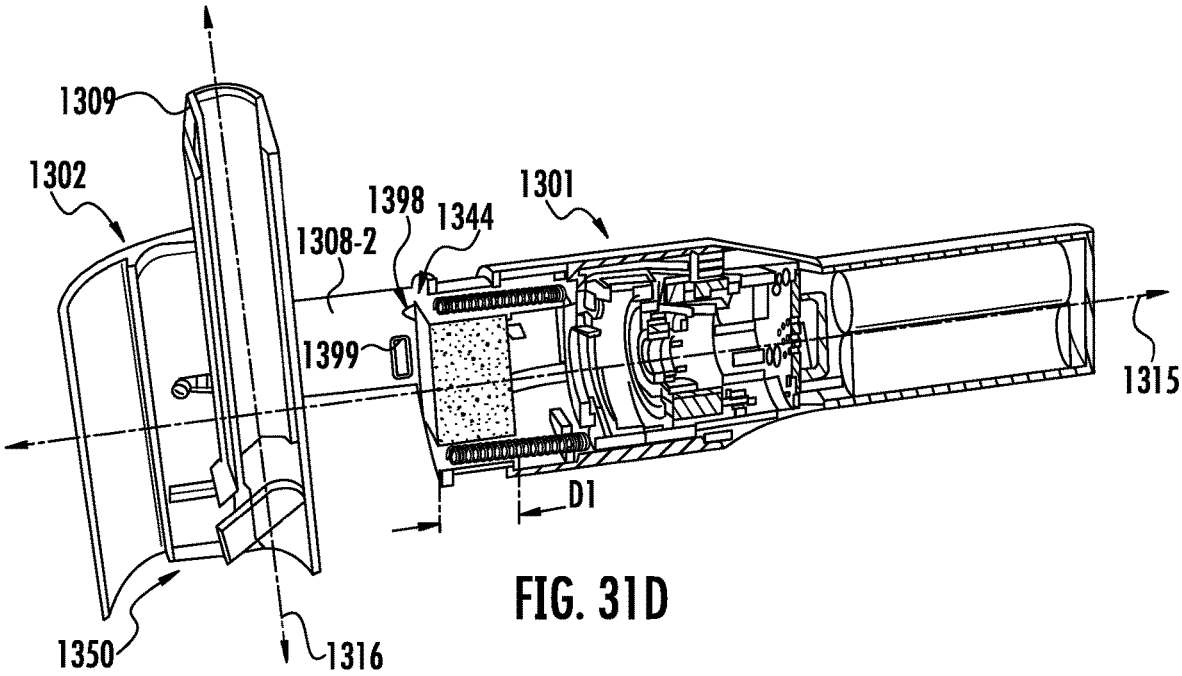
FIG. 31D shows a cross-sectional view of the surface cleaning device of FIG. 31B taken along the line D-D.

The body 1301 may define a cavity 1321 (FIG. 31C). The cavity may include the filter arrangement 1314, the motor 1322 and a power source 1323 disposed therein. The motor 1322 may comprise, for example, a brushless DC motor although other types of motors are within the scope of this disclosure. The motor 1322 may electrically couple to the power source 1323 and generate suction for drawing dirt and debris into the dust cup 1302.

The dust cup 1302 may comprise plastic, metal, or any other suitably rigid material. The dust cup 1302 may be defined by one or more walls that extend from a first end 1309 (or nozzle) to a second end 1350 (suction coupling end or suction coupling section) along a longitudinal axis 1316 (FIG. 31D). The dust cup 1302 may further define a cavity with a dirty air passageway 1330 extending at least partially therethrough, with the dirty air passageway extending substantially in parallel with the longitudinal axis 1316. The dust cup 1302 further includes a dust storage area 1331 within the cavity to receive and store dirt and debris. The walls surrounding the dust storage area 1331 may be light transmissive, e.g., allowing 80% or more of incident visible wavelengths, to allow a user to visibly examine the current amount of dirt and debris stored in the dust storage area through the walls. Note the suction coupling end 1350 also provides an opening for emptying dirt and debris when the dust cup 1302 is oriented upright/vertically in the open position.

The filter arrangement 1314 comprises a cylindrical housing that generally corresponds with the shape of the body 1301. Other shapes and configurations for the filter arrangement 1314 are also within the scope of this disclosure. The filter arrangement 1314 may include one or more filters, such as the pleated filter 1311 shown in FIG. 31C. The one or more filters may comprise, for example, a polyester material, PTFE, fiberglass, or any other suitable filter material. The one or more filters may include a cartridge body for easy removal and replacement of filters.

The filter arrangement 1314 may further include springs 1324 to bias the filter arrangement 1314 away from the body 1301 and towards the dust cup 1302. When the dust cup 1302 is in the closed position, such as shown in FIGS. 31A and 31C, the springs 1324 may be compressed based on the dust cup 1302 displacing the filter arrangement 1314 towards the cavity 1321 of the body 1301. Note that the springs 1324 may include more of fewer springs, e.g., a single spring, depending on a desired configuration.

Continuing on, arms 1308-1 and 1308-2 (or arm portions) may extend from the body 1301 along the longitudinal axis 1315. The arms 1308-1, 1308-2 may be integrally formed with the body 1301 as a single, monolithic piece, or may be formed from multiple pieces. In an embodiment, the arms 1308-1 and 1308-2 may be formed from the same material as the body 1301, e.g., formed from a plastic or other suitably rigid material. In some cases, the arms 1308-1 and 1308-2 may be formed from a different material from that of the body 1301. For example, the arms 1308-1 and 1308-2 may be formed at least in part with a metal or metal alloy to reinforce the arms.

The arms 1308-1 and 1308-2 may each be pivotally coupled to the dust cup 1302 to allow rotational movement along a direction/path generally indicated as D (FIG. 31B). Thus, the dust cup 1302 may pivot/rotate relative to arms 1308-1 and 1308-2 based on rotational axis 1325, with rotational axis 1325 being substantially perpendicular with the longitudinal axis 1315.

The arms 1308-1 and 1308-2 may further define a cavity. The cavity defined by the arms 1308-1 and 1308-2 may include spring(s) 1307. Each of the spring(s) 1307 may bias the dust cup 1302 away from the body 1301, e.g., by supplying force against a dust cup carrier 1326 or other mechanism coupled to the dust cup 1302. The dust cup carrier 1326 may be formed integrally, i.e., as a single, monolithic piece, with the dust cup 1302 or may be formed from multiple pieces. The dust cup carrier 1326 be configured to travel longitudinally along a track/guide provided by arms 1308-1 and 1308-2. Thus, the dust cup carrier 1326 may be used to transition/displace the dust cup 1302 from the closed position to the open position.

To securely hold the dust cup carrier 1326 in the closed position, and by extension to hold the dust cup 1302 in the closed position, a detent 1399 (FIG. 31B) or other suitable locking mechanism may extend from a surface of the arms 1308-1 and 1308-2. The detent 1399 may be spring-biased and configured to engage a corresponding surface feature of the dust cup 1302 such as catch/recess 1327. Thus, when the dust cup 1302 is aligned with and pressed against the filter arrangement 1314, e.g., based on a user-supplied force, the detent 1399 may engage with the catch 1327 of the dust cup 1302 to securely hold the dust cup 1302 in position relative to the body 1301.

To release the dust cup 1302 and transition the same to the open position, a user may depress button(s) 1305. Depressing button(s) 1305 may include using a thumb and index finger in a pinching motion against buttons disposed on opposite sides of the body 1301. In response, the button(s) 1305 may mechanically actuate the detent 1399 to disengage the same from the catch of the dust cup 1302. Alternatively, the button 1305 may provide an electrical signal that may be utilized to cause, for instance, a motor or other mechanical actuator to disengage the detent 1399.

In any event, the button 1305 may therefore allow a user to cause the dust cup 1302 to transition to an open position to empty out the dust cup and clear the filter of dust and debris. The dust cup 1302 may include a recessed surface 1339 (see FIG. 31B) or recessed region 1339 that defines a sidewall 1341, with the sidewall 1341 extending substantially perpendicular relative to the surface 1339. The sidewall 1341 may be configured to engage a stop surface 1340 of the arms 1308-1 and 1308-2 to prevent rotational movement of the dust cup 1302 beyond a predefined limit, e.g., 90 degrees. The impact of the dust cup 1302 encountering the stop surface 1340 may advantageously dislodge dirt and debris within the dust cup 1302.

Likewise, as shown in FIG. 31D, the filter arrangement 1314 may include a protrusion/catch/surface 1344 to engage a corresponding stop/protrusion 1398 of the body 1301. Note, the dust cup 1302 may include a recessed region/guide 1340 to engage the protrusion 1398. Thus, when the dust cup 1302 is transitioned back into the closed position, the protrusion 1398 may be used to align and guide the dust cup 1302 into alignment with the body 1301.

In an embodiment, the surface cleaning device 1300 may be held in a single hand and transitioned from a closed to an open position with the same hand.

Figure 32A:
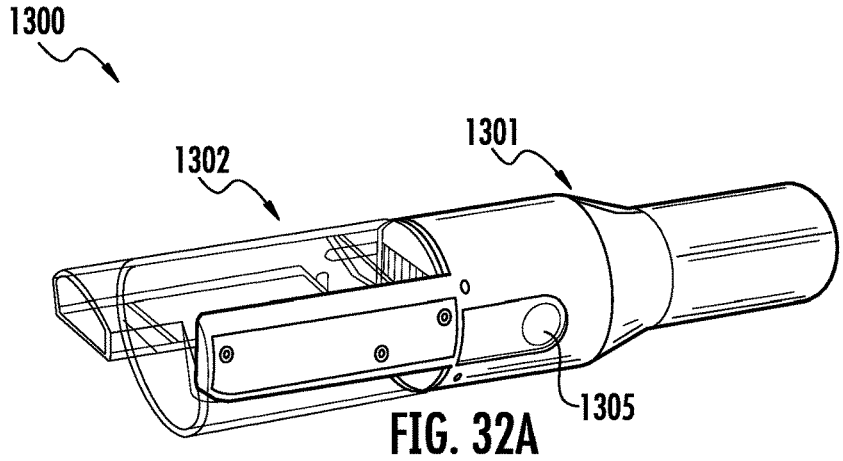
FIGS. 32A-32D shows additional example embodiments of a surface cleaning device consistent with embodiments of the present disclosure.
Figure 32B:
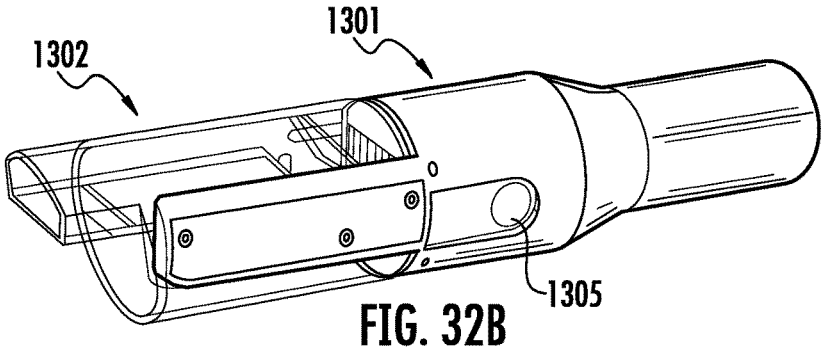
Figure 32C:
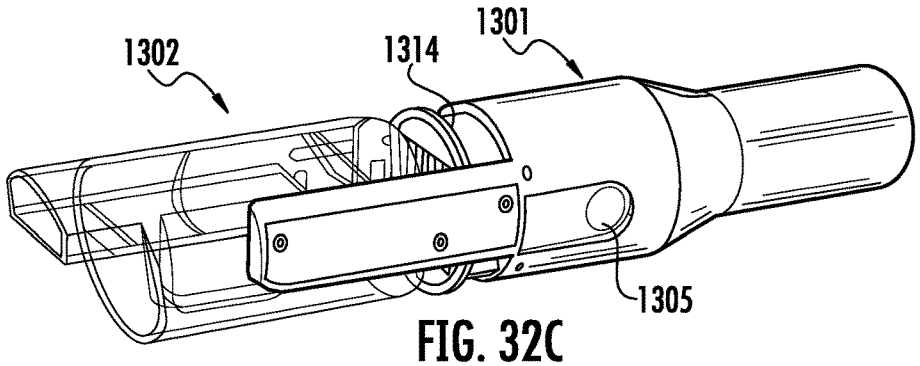
Figure 32D:
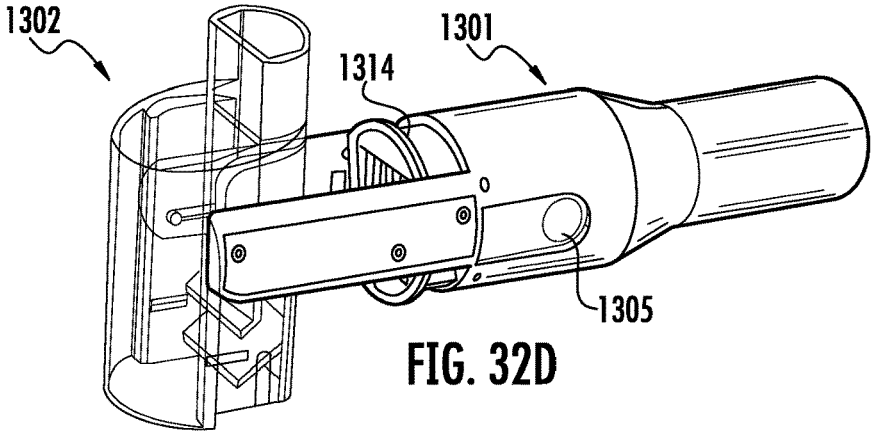

FIGS. 324A-32D collectively show the hand-held surface cleaning device 1300 transitioning from a closed position to an open position. In particular FIG. 32A shows the hand-held surface cleaning device 1300 in a closed position whereby the dust cup 1302 is in fluid communication with the motor disposed in the body 1301, in accordance with an embodiment of the present disclosure.

FIG. 32B shows the hand-held surface cleaning device 1300 after one or both of button(s) 1305 on either side of the body 1301 have been depressed by a user, in accordance with an embodiment of the present disclosure. In response to the button(s) 1305 being pressed, the detent 1399 (FIG. 31B) may be disengaged from the dust cup 1302. Likewise, and as shown in FIG. 32C, the dust cup 1302 and filter arrangement 1314 may travel longitudinally away from the body 1301. In some cases, there may be a momentary pause between the rotational movement of the dust cup 1302 and the movement of the filter arrangement 1314, depending on the desired configuration.

As shown in FIG. 32D, the dust cup 1302 may then rotate/pivot relative to the body 1301 and stop at a position which holds the dust cup 1302 at an orientation which is substantially transverse relative to the body 1301. The dust cup 1302 may pivot based on a track/guide provided by the arms 1308-1 and 1308-2. Alternatively, or in addition, weighting may be added to the dust cup 1302 to cause the same to naturally tend towards a vertical/upright orientation.

The dust cup 1302 may be held in this position based at least in part on the spring(s) 1307 disposed in the first and second arms 1308-1 and 1308-2 (see FIG. 31B). Likewise, the filter arrangement 1314 may be held in the extended position based on spring bias from the spring(s) 1324. Accordingly, a user may then shake the hand-held surface cleaning device 1300 to cause dust and debris to empty from the dust cup 1302. To bring the dust cup 1302 into a closed position for further use, a user may simply rotate the dust cup 1302 into alignment with the body 1301 and then slide the dust cup 1302 towards the body 1301 to displace the filter arrangement 1314 and "lock" into the closed position based on detent 1399 engaging with a sidewall feature, e.g., recess 1327, of the dust cup 1302.

Figure 33:
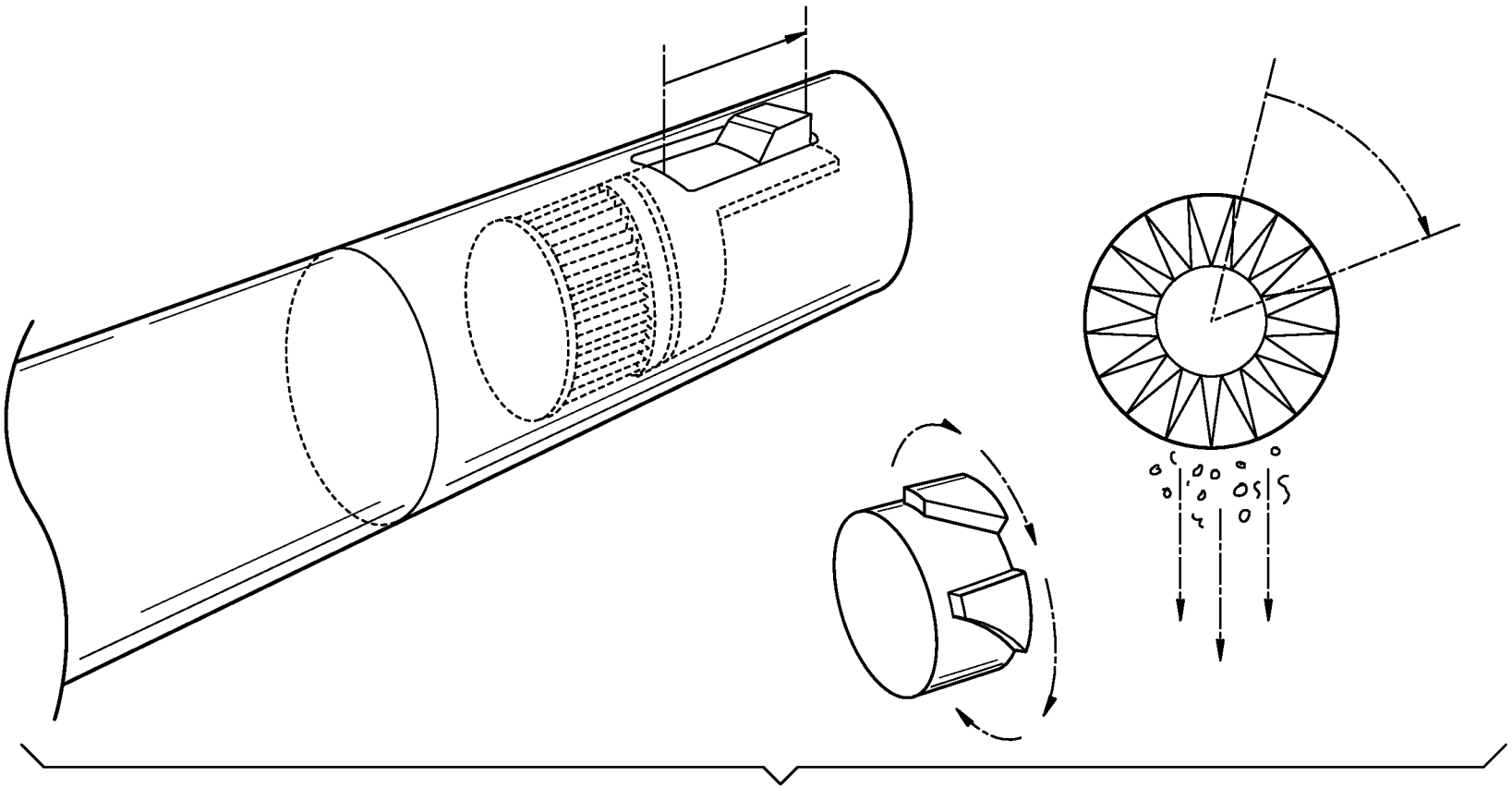
FIG. 33 shows an additional example embodiment of a surface cleaning device consistent with an embodiment of the present disclosure.

FIG. 33 shows an additional example embodiment of a surface cleaning device consistent with an embodiment of the present disclosure.

Figure 34A:
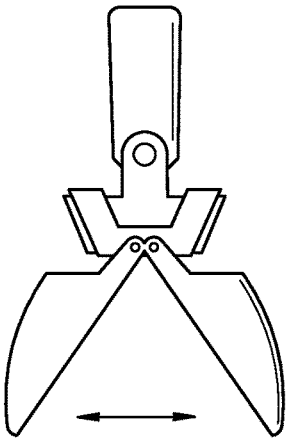
FIGS. 34A-34C show additional example embodiments of a surface cleaning device consistent with embodiments of the present disclosure.
Figure 34B:
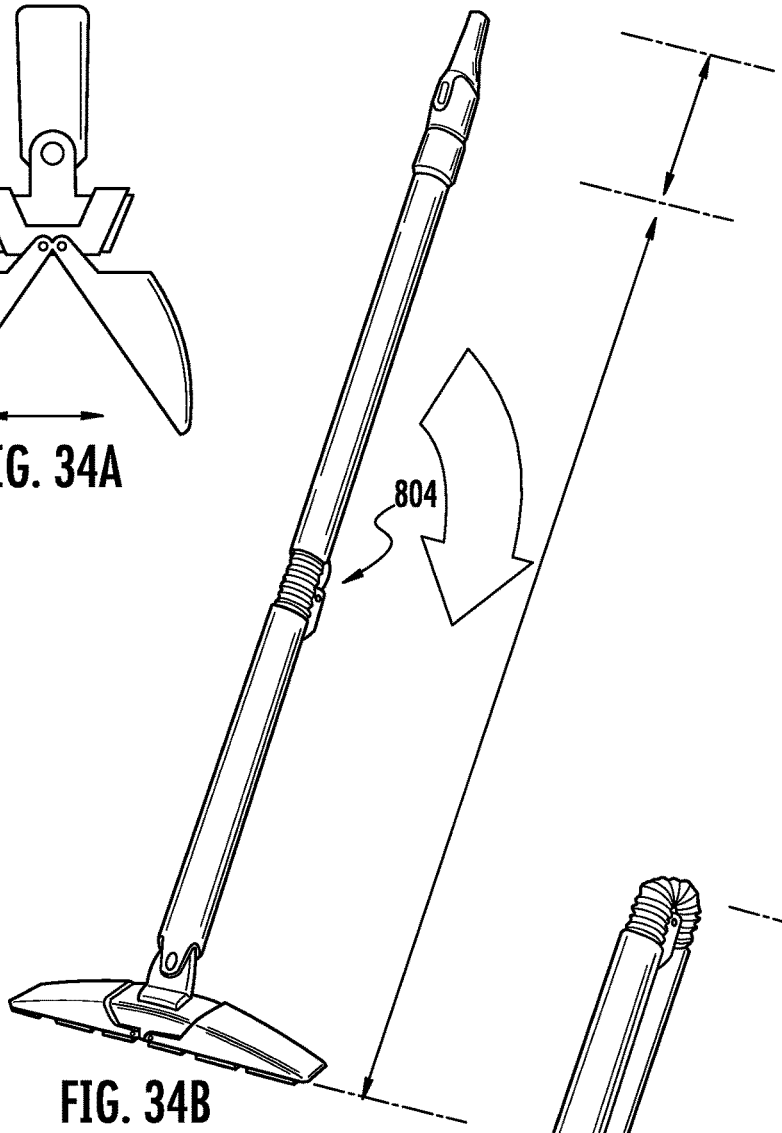
Figure 34C:
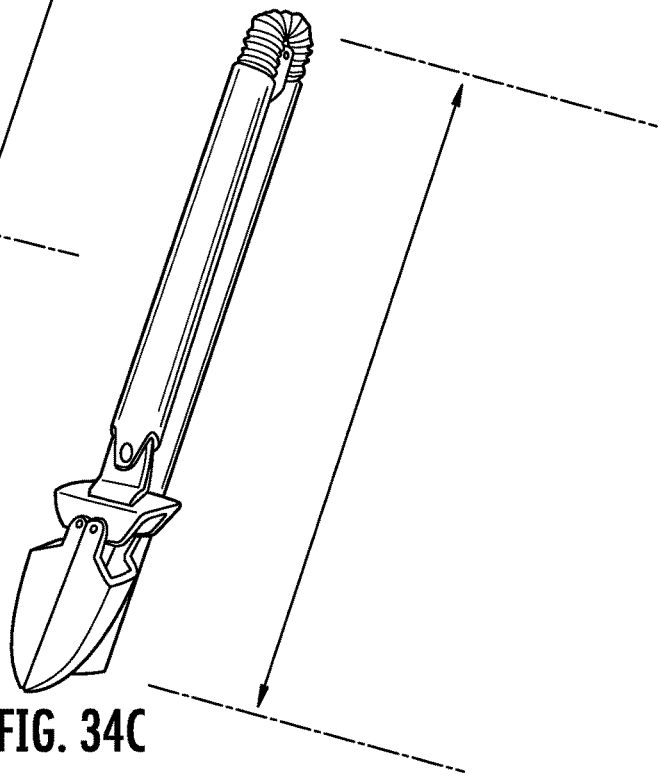

FIGS. 34A-34C shows additional example embodiments of a surface cleaning device consistent with embodiments of the present disclosure. Note the example aspects shown in FIGS. 34A-34C are equally applicable to the embodiment shown in FIG. 8.

Figure 35A:
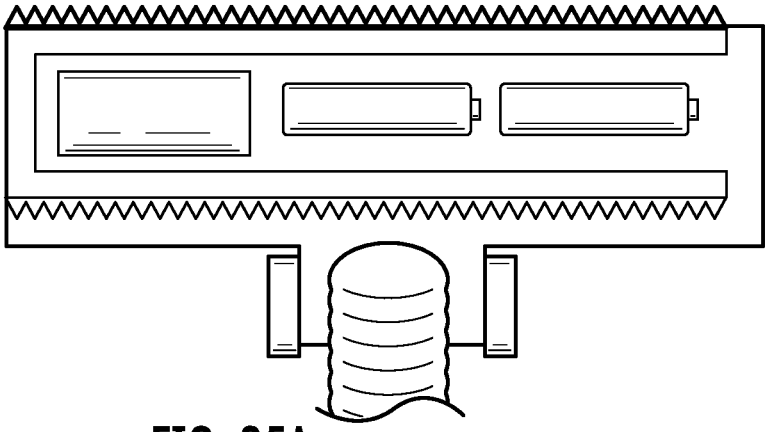
FIGS. 35A-35B shows additional example embodiments of a surface cleaning device consistent with embodiments of the present disclosure.
Figure 35B:
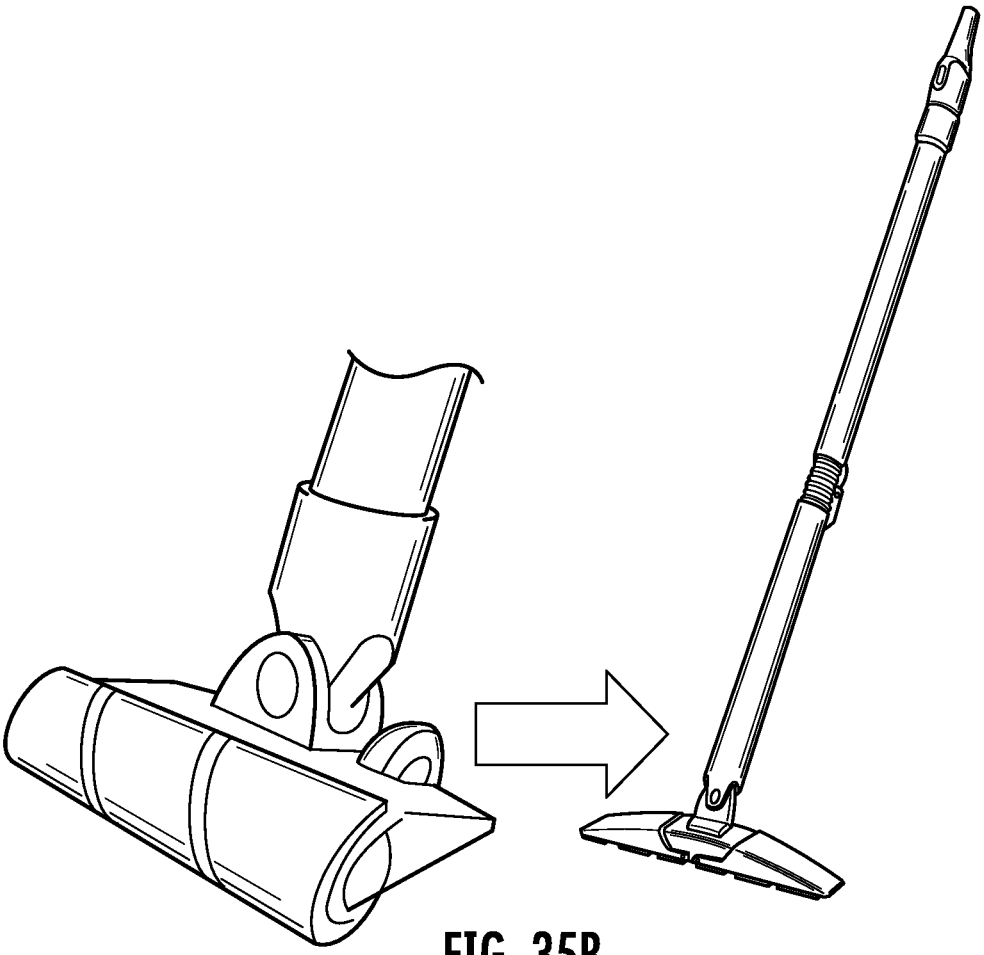

FIGS. 35A-35B shows additional example embodiments of a surface cleaning device consistent with embodiments of the present disclosure. As shown, the hand-held surface cleaning device 3500 may fit into an end 3502 of a wand/frame 3504 with a soft roller/brush roll 3506. A motor 3508 and batteries 3510, 3512 may be encased by the brush roll 3506. This minimizes the footprint of the floor nozzle/cleaning head 3514 and adds weight directly over the brush roll 3506. In one embodiment, the brush roll 3506 of the nozzle/cleaning head 3514 and the hand-held surface cleaning device 3500 are not electrically connected. When a user turns on suction to the hand-held surface cleaning device 3500, a sensor in the nozzle/cleaning head 3514 detects air flow and turns on the brush roll 3506. When no suction is present the brush roll 3506 turns off.

Figure 36A:
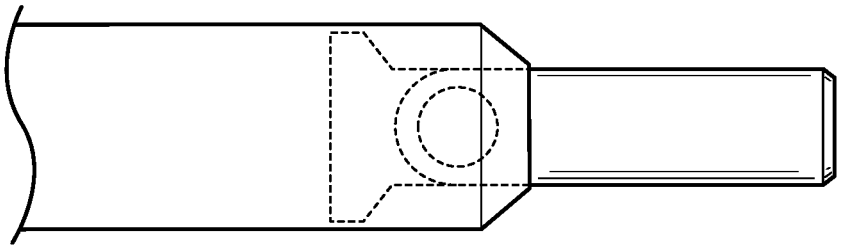
FIGS. 36A-36C shows an additional example embodiment of a surface cleaning device consistent with an embodiment of the present disclosure.
Figure 36B:
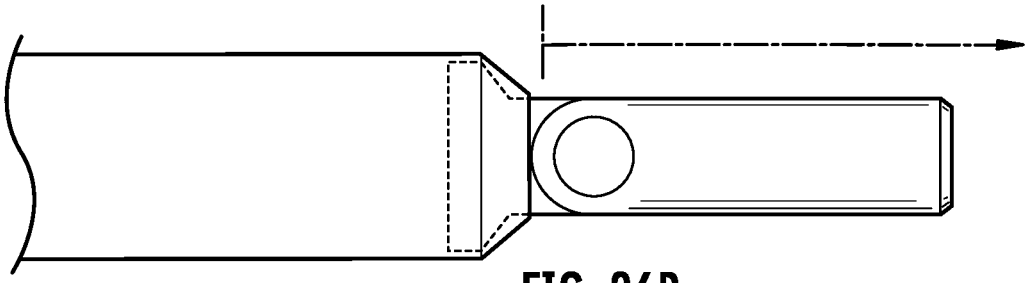
Figure 36C:
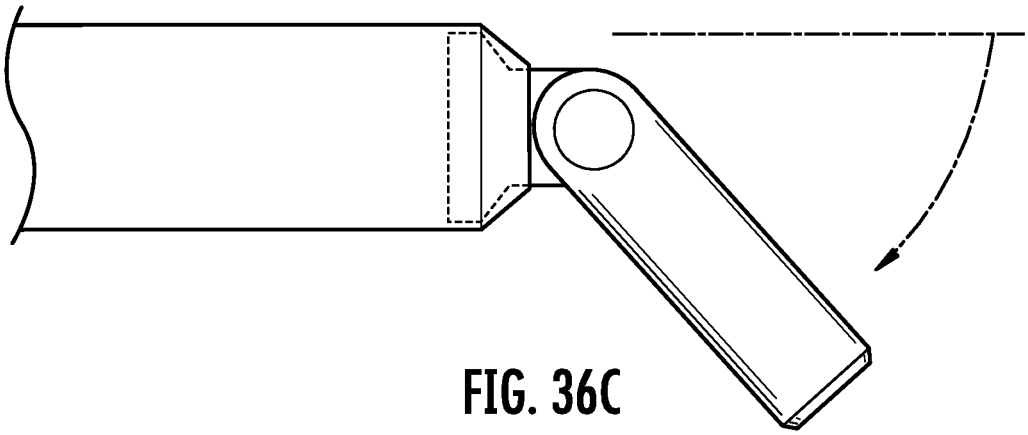
Figure 37:
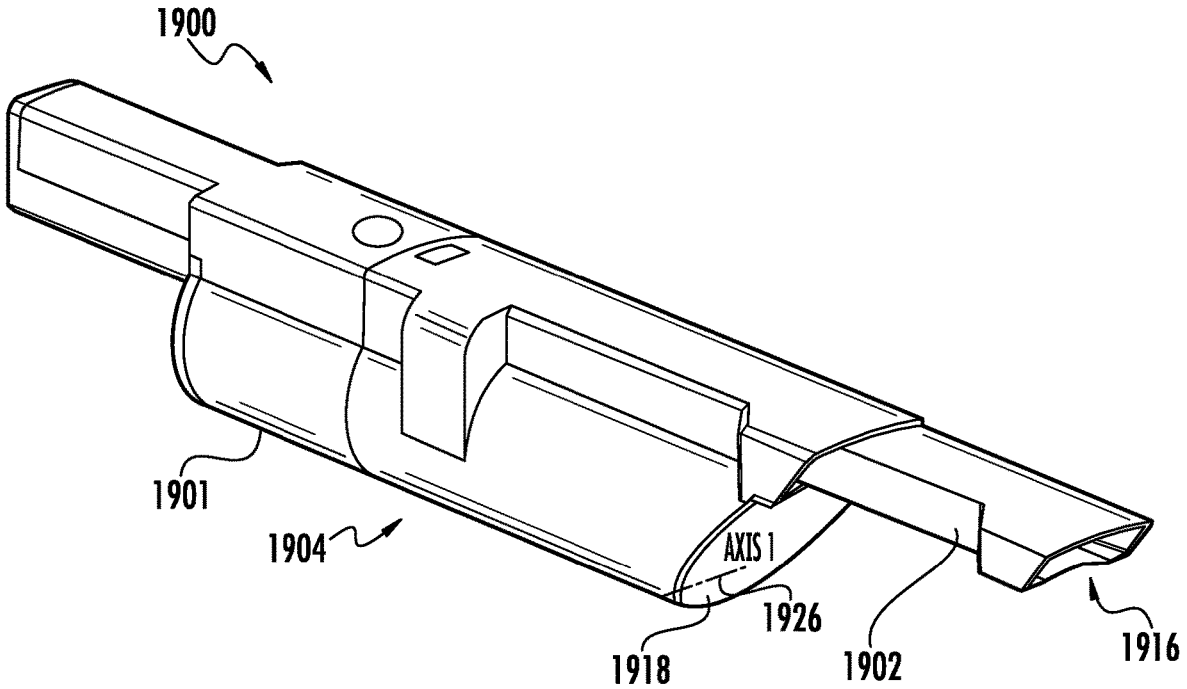
FIG. 37 shows an additional example embodiment of a surface cleaning device consistent with an embodiment of the present disclosure.
Figure 38:
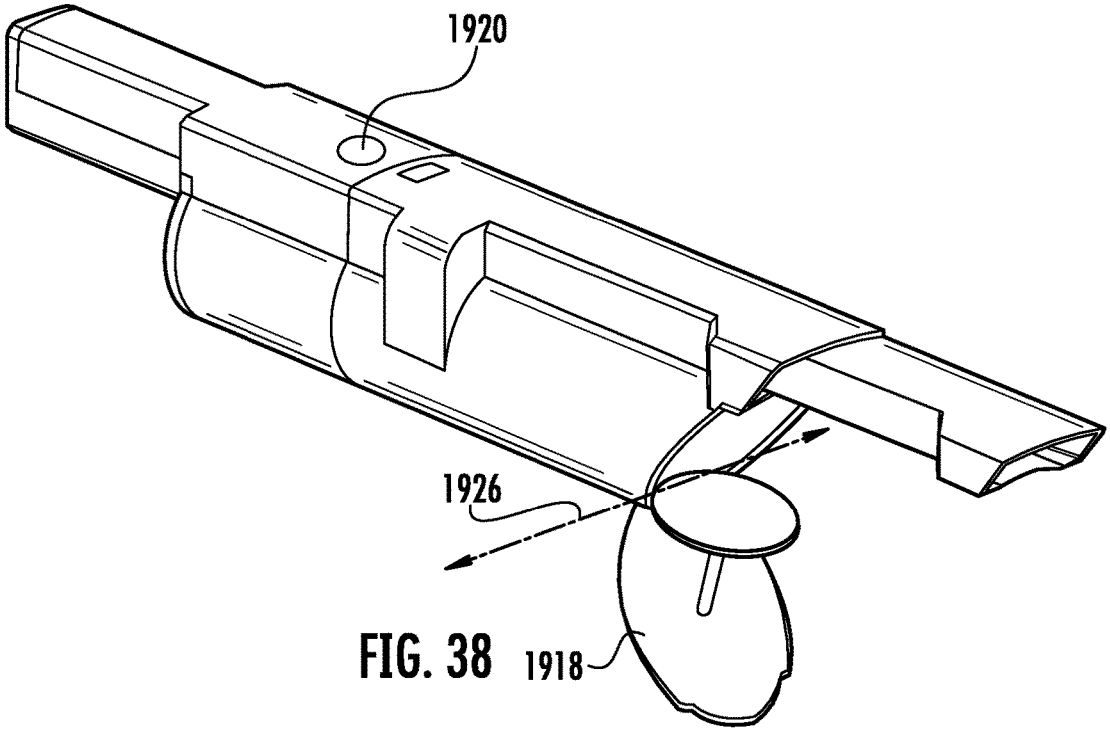
FIG. 38 shows a perspective view of the example embodiment of FIG. 37 consistent with embodiments of the present disclosure.
Figure 39:
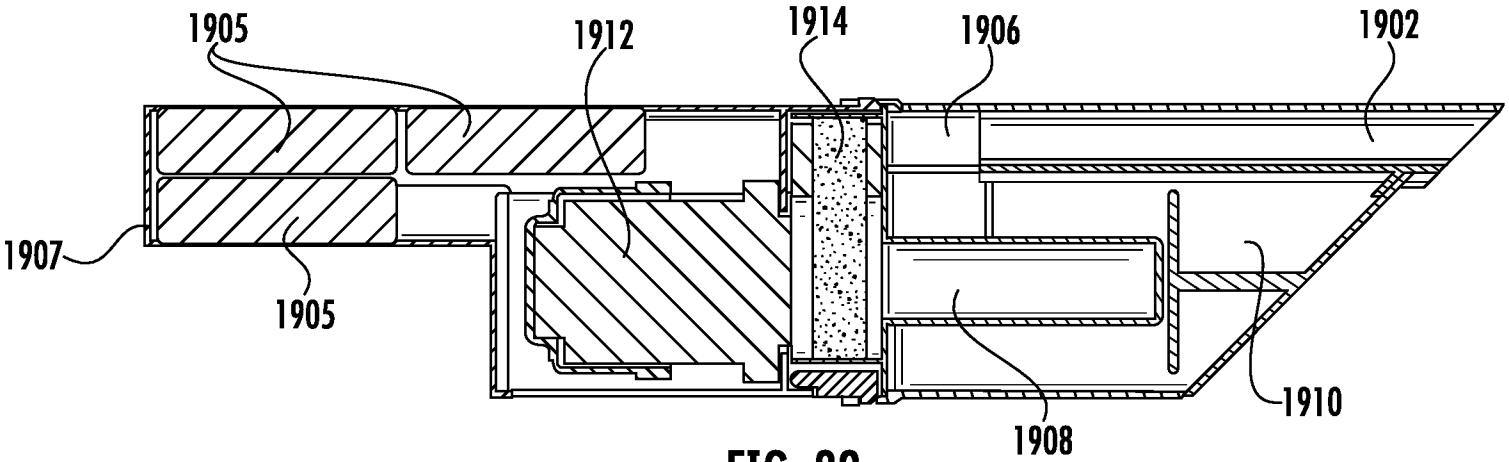
FIG. 39 shows a cross-sectional view of the example embodiment of FIG. 37 consistent with embodiments of the present disclosure.
Figure 40:
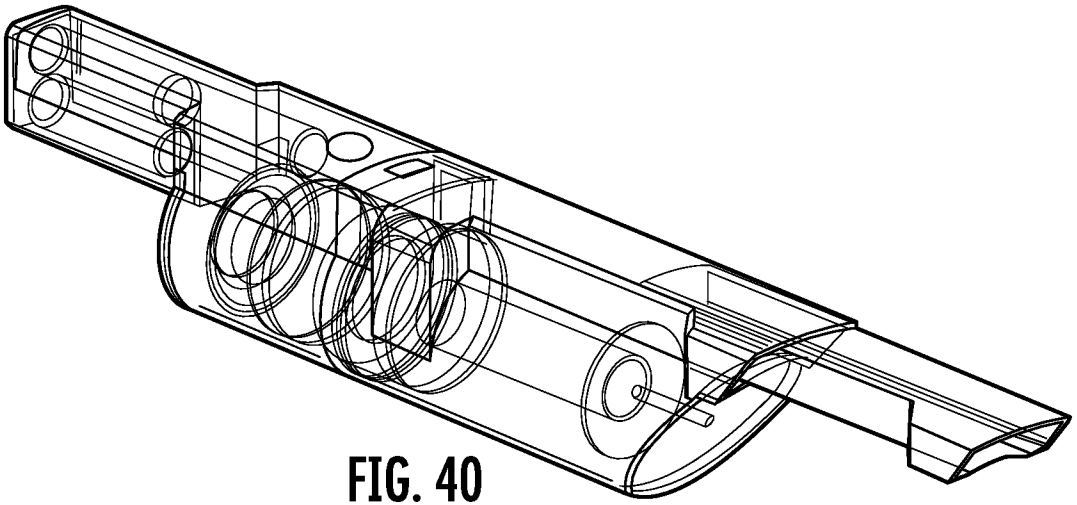
FIG. 40 shows another perspective view of the example embodiment of FIG. 37 consistent with embodiments of the present disclosure.
Figure 41:
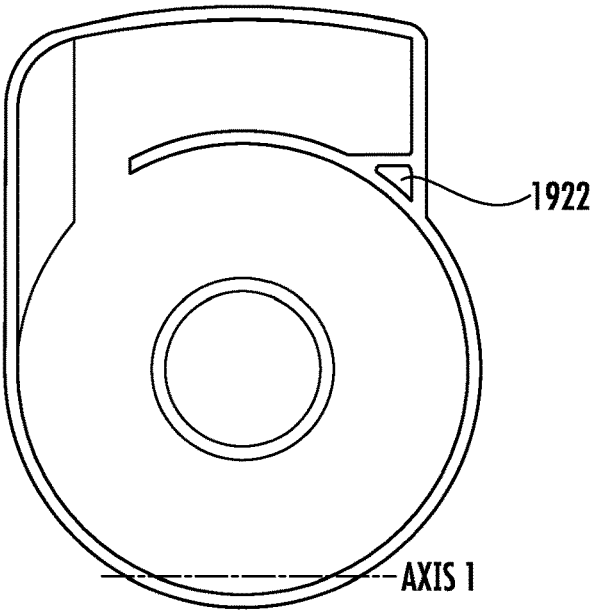
FIG. 41 shows another cross-sectional view of the example embodiment of FIG. 37 consistent with embodiments of the present disclosure.
Figure 42:
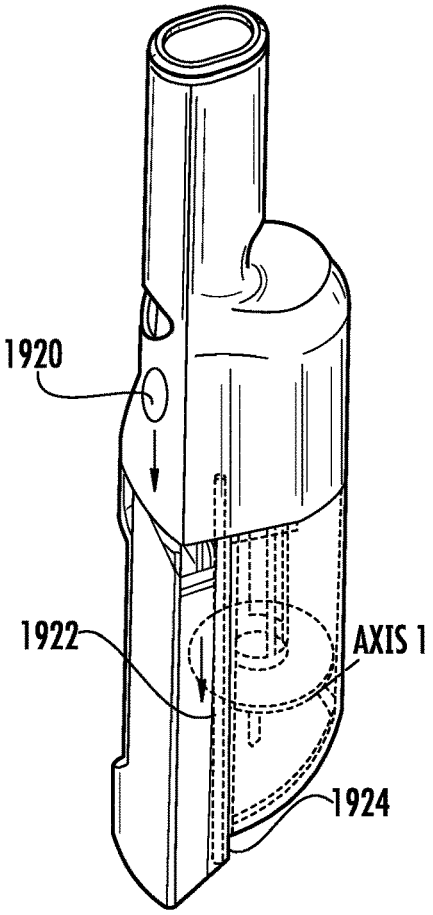
FIG. 42 shows another perspective view of the example embodiment of FIG. 37 consistent with embodiments of the present disclosure.
Figure 43:
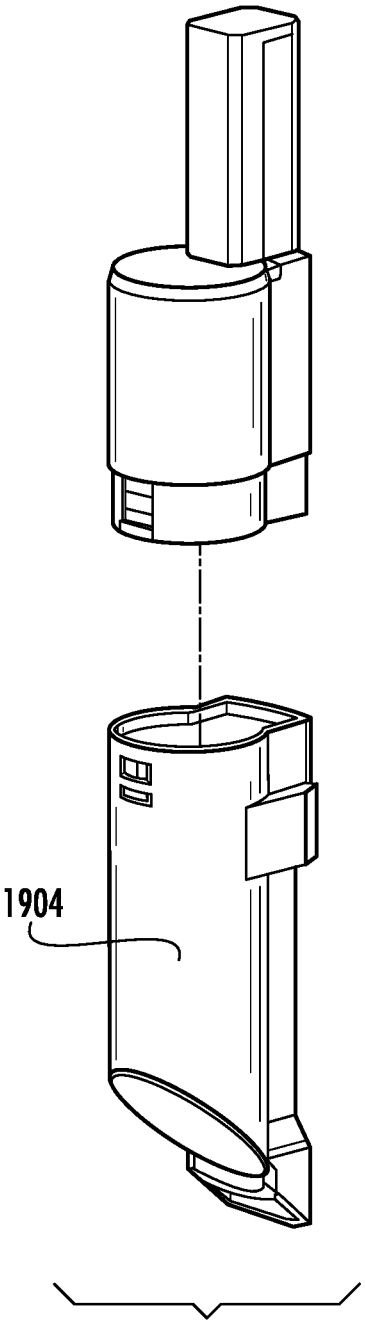
FIG. 43 shows an exploded view of the example embodiment of FIG. 37 consistent with embodiments of the present disclosure.
Figure 44:
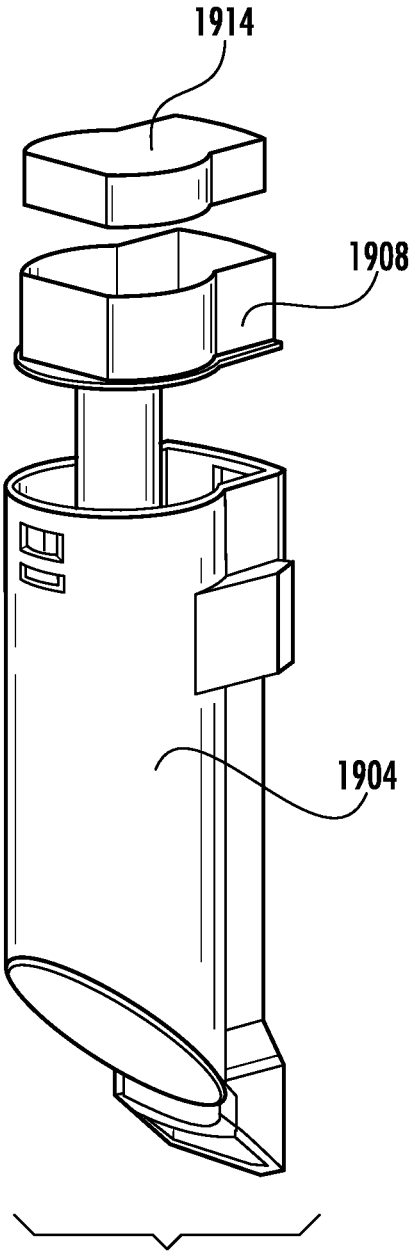
FIG. 44 shows another exploded view of the example embodiment of FIG. 37 consistent with embodiments of the present disclosure.

FIGS. 36A-36B shows an additional example embodiment of a surface cleaning device consistent with an embodiment of the present disclosure.

FIGS. 37-45 show an additional example embodiment of a hand-held surface cleaning device 1900 having a body 1901 that includes a handle 1907, an extendable crevice tool 1902, a cyclone assembly 1904, and a motor 1912 electrically coupled to at least one battery 1905. The battery 1905 can be stored in the handle 1907. As shown, the cyclone assembly 1904 includes an inlet 1906 that is fluidly coupled to the crevice tool 1902, a vortex finder 1908, a collection area 1910, and a filter 1914. In operation, air is drawn from a crevice tool inlet 1916 and into the cyclone assembly 1904. The air may include debris collected, for example, during a cleaning operation. The debris carried in the air may collect within the cyclone assembly 1904 (e.g., within the collection area 1910).

When a sufficient amount of debris is collected within the cyclone assembly 1904, an operator may empty the debris by causing a door 1918 to be opened. Once the door 1918 has been opened the debris may exit the cyclone assembly 1904 (e.g., by the force of gravity). An operator may cause the door 1918 to be opened by actuating a button (or trigger) 1920. In some instances, the actuation of the button 1920 may result in the movement of a push rod 1922. When the push rod 1922 is moved between a first and second position, the push rod 1922 may engage a latch 1924 holding the door 1918 in a closed position. As shown, when the latch 1924 is moved out of engagement with the door 1918, the door 1918 rotates about an axis 1926.

Once released, an operator may reclose the door 1918 by pushing the door 1918 back into engagement with the latch 1924. Additionally, or alternatively, the user may actuate the button 1920 a second time (or actuate a different button or trigger) to cause the door 1918 to close. In some instances, the latch 1924 may include a biasing member (e.g., a spring) that urges the latch 1924 towards an engagement position (e.g., a position in which the latch 1924 is capable of engaging the door 1918).

The crevice tool 1902 may be extendable from a first to a second position. For example, an operator may manually grasp the crevice tool 1902 and pull (or push) the crevice tool 1902 to cause the crevice tool 1902 to transition between the first and second positions. Additionally, or alternatively, the crevice tool 1902 may transition between the first and second positions in response to the actuation of a button (or trigger).

As also shown, at least a portion of the cyclone assembly 1904 may be removably coupled to the body 1901 of the hand-held surface cleaning device 1900. For example, removal of the cyclone assembly 1904 may allow a user to clean and/or replace the filter 1914. By way of further example, in some instances, the vortex finder 1908 may be removable. As shown a toe in feature 1917 may be provided to couple the cyclone assembly 1904 to the body 1901.

In some instances the hand-held surface cleaning device 1900 may be used in a robot vacuum cleaner system. For example, the hand-held surface cleaning device 1900 may be used to remove debris from a robotic vacuum cleaner.

In accordance with an aspect, a hand-held surface cleaning device is disclosed. The hand-held surface cleaning device comprising a body that extends from a first end to a second end, a handle portion defined by the body adjacent the first end, a nozzle with a dirty air inlet defined by the body adjacent the second end, a motor for generating suction and drawing air into the dirty air inlet, and a dust cup for receiving and storing dust and debris, the dust cup being rotatably coupled to the body of the hand-held surface cleaning device and configured to transition between a closed orientation to fluidly couple the dust cup with the dirty air inlet and the motor, and a release orientation to decouple the dust cup from the dirty air inlet and the motor to allow dirt and debris stored in the dust cup to exit from an opening of the dust cup.

In accordance with another aspect a docking system is disclosed. The docking system comprising a dock including a robotic vacuum coupling section, and a hand-held surface cleaning device comprising a body that extends from a first end to a second end, a handle portion defined by the body adjacent the first end, a nozzle with a dirty air inlet defined by the body adjacent the second end, a motor for generating suction and drawing air into the dirty air inlet; and a dust cup for receiving and storing dust and debris, the dust cup being rotatably coupled to the body of the hand-held surface cleaning device and configured to transition between a closed orientation to fluidly couple the dust cup with the dirty air inlet and the motor and a release orientation to decouple the dust cup from the dirty air inlet and the motor to allow dirt and debris stored in the dust cup to exit from an opening of the dust cup, a receptacle defined by the dock to receive and couple to the first end of the hand-held surface cleaning device and to cause the second end defining the handle portion to extend away from the dock.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. It will be appreciated by a person skilled in the art that a surface cleaning apparatus may embody any one or more of the features contained herein and that the features may be used in any particular combination or sub-combination. Modifications and substitutions by one of ordinary skill in the art are considered to be within the scope of the present disclosure, which is not to be limited except by the claims.

What is claimed is:

1. A hand-held surface cleaning device comprising:

a body that extends from a first end to a second end, the body comprising;

a handle portion adjacent the first end, and a nozzle with a dirty air inlet adjacent the second end;

a motor for generating suction and drawing air into the dirty air inlet; and a dust cup for receiving and storing debris, the dust cup being separate from the nozzle and rotatably coupled to the body of the hand-held surface cleaning device through a hinge and configured to rotate about the hinge relative to the nozzle to transition between a closed orientation wherein the dust cup is fluidly coupled with the dirty air inlet of the nozzle and the motor, and a release orientation wherein the dust cup is decoupled from the dirty air inlet of the nozzle and the motor to allow the debris stored in the dust cup to exit from an opening of the dust cup, wherein the dust cup remains rotatably coupled to the body through the hinge in the release orientation;

a filter arrangement disposed between the motor and the dust cup, wherein the hinge is provided between the filter arrangement and the second end, and wherein the dirty air inlet and the dust cup are fluidly coupled to each other based at least in part on an opening of each being aligned, and wherein the hand-held surface cleaning device further comprises a valve body positioned to prevent debris from exiting the hand-held cleaning device through the dirty air inlet in an absence of suction from the motor.

2. The hand-held surface cleaning device of claim 1, wherein the dust cup in the release orientation causes the dust cup to extend parallel with the body, and wherein the dust cup in the open orientation causes the dust cup to extend substantially transverse relative to the body.

3. The hand-held surface cleaning device of claim 1, wherein the body includes a button to cause the dust cup to transition from the closed orientation to the release orientation.

4. The hand-held surface cleaning device of claim 1, wherein the valve body is displaced towards the dust cup when suction is supplied from the motor, allowing for the debris to be drawn into the dirty air inlet and fluidly communicated to the dust cup.

5. The hand-held surface cleaning device of claim 1, wherein the dust cup includes an agitator member positioned on the dust cup adjacent the filter arrangement to contact at least a portion of the filter arrangement to dislodge dirt and debris when the dust cup transitions to the release or closed orientation.

6. The hand-held surface cleaning device of claim 5, wherein the agitator member comprises a plurality of bristles.

7. The hand-held surface cleaning device of claim 5, wherein at least a portion of the filter arrangement is removable from the body of the hand-held surface cleaning device when the dust cup is in the release orientation.

8. A docking system comprising:

a dock including a vacuum coupling section;

a hand-held surface cleaning device according to claim 1; and a receptacle defined by the dock to receive the second end of the hand-held surface cleaning device and to cause the first end defining the handle portion to extend away from the dock.

9. The docking system of claim 8, wherein the vacuum coupling section includes electrical contacts to electrically couple to a vacuum, and wherein the receptacle includes electrical contacts to electrically couple to the hand-held surface cleaning device.

10. The docking system of claim 8, wherein the body of the hand-held surface cleaning device includes a button to cause the dust cup to transition between the closed orientation and the release orientation.

11. The docking system of claim 8, further comprising a filter arrangement disposed between the motor and the dust cup of the hand-held surface cleaning device, and wherein the dust cup includes an agitator member positioned on the dust cup adjacent the filter arrangement to contact at least a portion of the filter arrangement to dislodge dirt and debris when the dust cup transitions to the release or closed orientation.

12. The docking system of claim 11, wherein the agitator member comprises a plurality of bristles.

13. The hand-held surface cleaning device of claim 1, wherein the hand-held surface cleaning device has a substantially continuous width from the motor section to the second end of the device.

14. A surface cleaning device comprising:

a frame;

a cleaning head including a second dirty air inlet; and a hand-held surface cleaning device according to claim 1 configured to be removably coupled to the frame, whereby suction generated by the hand-held surface cleaning device draws air into the second dirty air inlet.

15. The surface cleaning device of claim 14, wherein the frame defines a hand-held surface cleaner receptacle and wherein the hand-held surface cleaning device is configured to be removably disposed in the hand-held surface cleaner receptacle.

16. The surface cleaning device of claim 14, wherein the hand-held surface cleaning device is configured to be coupled to the frame such that suction generated by the hand-held surface cleaning device draws air into the second dirty air inlet to store debris in the dust cup.

17. The surface cleaning device of claim 14, further comprising a second dust cup and wherein the hand-held surface cleaning device is configured to be coupled to the frame such that suction generated by the hand-held surface cleaning device draws air into the second dirty air inlet to store debris in the second dust cup.

18. The surface cleaning device of claim 17, wherein the second dust cup is removable from the frame.

19. The surface cleaning device of claim 17, wherein the second dust cup comprises a door configured to open to allow debris stored in the second dust cup to exit the dust cup.

20. The surface cleaning device of claim 14, further comprising a second dust cup and wherein the hand-held surface cleaning device is configured to be coupled to the frame such that suction generated by the hand-held surface cleaning device draws air into the second dirty air inlet to store debris in the dust cup and the second dust cup.

21. The surface cleaning device of claim 14, further comprising a joint configured to allow a first portion of the frame to bend relative to a second portion of the frame.

22. A hand-held surface cleaning device comprising:

a body that extends from a first end to a second end, the body comprising;

a handle portion adjacent the first end, and a nozzle with a dirty air inlet adjacent the second end;

a motor for generating suction and drawing air into the dirty air inlet;

a dust cup for receiving and storing debris, the dust cup being separate from the nozzle and rotatably coupled to the body of the hand-held surface cleaning device through a hinge and configured to rotate about the hinge relative to the nozzle to transition between a closed orientation wherein the dust cup is fluidly coupled with the dirty air inlet of the nozzle and the motor, and a release orientation wherein the dust cup is decoupled from the dirty air inlet of the nozzle and the motor to allow the debris stored in the dust cup to exit from an opening of the dust cup, wherein the dust cup remains rotatably coupled to the body through the hinge in the release orientation; and a filter arrangement disposed between the motor and the dust cup, wherein the hinge is provided between the filter arrangement and the second end.

23. The hand-held surface cleaning device of claim 22, wherein the dust cup includes an agitator member positioned on the dust cup adjacent the filter arrangement to contact at least a portion of the filter arrangement to dislodge dirt and debris when the dust cup transitions to the release or closed orientation.

24. The hand-held surface cleaning device of claim 22, wherein at least a portion of the filter arrangement is removable from the body of the hand-held surface cleaning device when the dust cup is in the release orientation.

25. A docking system comprising:

a dock including a vacuum coupling section;

a hand-held surface cleaning device according to claim 22; and a receptacle defined by the dock to receive the second end of the hand-held surface cleaning device and to cause the first end defining the handle portion to extend away from the dock.

26. The docking system of claim 24, wherein the vacuum coupling section includes electrical contacts to electrically couple to a vacuum, and wherein the receptacle includes electrical contacts to electrically couple to the hand-held surface cleaning device.

27. The hand-held surface cleaning device of claim 1, wherein the body is a single piece.

28. The hand-held surface cleaning device of claim 1, wherein the dust cup is spring-biased toward the release orientation.

* * * * *